US012768056B2

(12) United States Patent
Chen et al.

(10) Patent No.: US 12,768,056 B2
(45) Date of Patent: Oct. 20, 2026

(54) PROCESS AND SYSTEM FOR THE SELECTIVE ELECTROCHEMICAL REDUCTION OF $CO_2$ IN ACIDIC CONDITIONS

(71) Applicants: TOTALENERGIES ONETECH, Courbevoie (FR); THE GOVERNING COUNCIL OF THE UNIVERSITY OF TORONTO, Toronto (CA)

(72) Inventors: Zhu Chen, Toronto (CA); Edward Sargent, Toronto (CA); David Sinton, Toronto (CA)

(73) Assignees: TOTALENERGIES ONETECH, Courbevoie (FR); THE GOVERNING COUNCIL OF THE UNIVERSITY OF TORONTO, Toronto (CA)

( * ) Notice: Subject to any disclaimer, the term of this patent is extended or adjusted under 35 U.S.C. 154(b) by 0 days.

(21) Appl. No.: 19/122,131

(22) PCT Filed: Oct. 20, 2023

(86) PCT No.: PCT/IB2023/000693
§ 371 (c)(1),
(2) Date: Apr. 17, 2025

(87) PCT Pub. No.: WO2024/084288
PCT Pub. Date: Apr. 25, 2024

(65) Prior Publication Data

US 2026/0028724 A1 Jan. 29, 2026

Related U.S. Application Data

(60) Provisional application No. 63/380,454, filed on Oct. 21, 2022.

(30) Foreign Application Priority Data

Oct. 27, 2022 (LU) ..... 502968

(51) Int. Cl.
*C25B 3/03* (2021.01)
*C25B 3/26* (2021.01)
(Continued)

(52) U.S. Cl.
CPC ..... *C25B 3/03* (2021.01); *C25B 3/26* (2021.01); *C25B 11/032* (2021.01); *C25B 11/081* (2021.01); *C25B 11/095* (2021.01)

(58) Field of Classification Search
None
See application file for complete search history.

(56) References Cited

U.S. PATENT DOCUMENTS

2011/0114502 A1 5/2011 Cole et al.
2012/0132538 A1 5/2012 Cole et al.
2012/0175269 A1 7/2012 Bocarsly et al.

OTHER PUBLICATIONS

Hollins, P., K. J. Davies, and J. Pritchard, "Infrared spectra of CO chemisorbed on a surface vicinal to Cu (110): The influence of defect sites" Surface science 138 (1984): 75-83.

(Continued)

*Primary Examiner* — Wojciech Haske
(74) *Attorney, Agent, or Firm* — Ewing & Jones, PLLC

(57) ABSTRACT

A surface-modified catalyst, a multilayer cathode and a system for the electrochemical reduction of carbon dioxide in an acidic medium releasing protons are described. More particularly, the surface-modified catalyst, the multilayer cathode and the system comprise least one heterocyclic organic molecule preventing protons from accessing an active site on a surface of the cathode catalyst material to decrease an hydrogen evolution reaction, as compared to the absence of said heterocyclic organic molecule. The use of the surface-modified catalyst, the multilayer cathode and the system for the production of multicarbon products as well as their processes of manufacturing are also described. Finally, (Continued)

also described are methods for electrochemical production of a multicarbon product using the multilayer cathode and the system.

26 Claims, 26 Drawing Sheets

(51) Int. Cl.
*C25B 11/032* (2021.01)
*C25B 11/081* (2021.01)
*C25B 11/095* (2021.01)

(56) References Cited

OTHER PUBLICATIONS

Lane, Melissa D., "Mid-infrared emission spectroscopy of sulfate and sulfate-bearing minerals" American Mineralogist 92 (2007): pp. 1-18.
Niaura, Gediminas, et al., "Surface-enhanced Raman spectroscopy of phosphate anions: adsorption on silver, gold, and copper electrodes" The Journal of Physical Chemistry B 101 (1997): 9250-9262.
Batista, Elisete A., and Marcia LA Temperini, "Spectroscopic evidences of the presence of hydrogenated species on the surface of copper during CO2 electroreduction at low cathodic potentials" Journal of Electroanalytical Chemistry 629 (2009): 158-163.
Katayama, Yu, et al. "An in situ surface-enhanced infrared absorption spectroscopy study of electrochemical CO2 reduction: selectivity dependence on surface C-bound and O-bound reaction intermediates" The Journal of Physical Chemistry C 123 (2019): 5951-5963.
Andrade, Gustavo FS, and Marcia LA Temperini, "1,10-Phenanthroline adsorption on iron electrode monitored by surface-enhanced Raman scattering (SERS). Comparison to SERS of Phen and its transition metal complex on silver electrode" The Journal of Physical Chemistry C, 111 (2007): 13821-13830.
Muniz-Miranda, et al., "SERS and DFT investigation on the adsorption of 1,10-phenanthroline on transition metal surfaces" Physical Chemistry Chemical Physics 12 (2010): 1145-1151.
Wuttig, Anna, et al. "Tracking a common surface-bound intermediate during CO2-to-fuels catalysis" ACS central science 2 (2016): 522-528.
Gunathunge, Charuni M., et al. "Probing promoting effects of alkali cations on the reduction of CO at the aqueous electrolyte/copper interface" Physical Chemistry Chemical Physics 19 (2017): 30166-30172.
Gunathunge, Charuni M., et al. "Revealing the Predominant Surface Facets of Rough Cu Electrodes under Electrochemical Conditions" ACS Catalysis 10.12 (2020): 28 pages.
Gunathunge, Charuni M., et al. "Spectroscopic observation of reversible surface reconstruction of copper electrodes under CO2 reduction" The Journal of Physical Chemistry C 121 (2017): 12337-12344.
Hori, Y., et al. "FTIR measurements of charge displacement adsorption of CO on poly-and single crystal (100) of Cu electrodes" Electrochimica acta 44 (1998): 1389-1395.
An, Hongyu, et al. "Sub-Second Time-Resolved Surface-Enhanced Raman Spectroscopy Reveals Dynamic CO Intermediates during Electrochemical CO2 Reduction on Copper" Angewandte Chemie International Edition 60 (2021): 16576-16584.
Ovalle, Vincent J., and Matthias M. Waegele, "Understanding the impact of N-arylpyridinium ions on the selectivity of CO2 reduction at the Cu/electrolyte interface" The Journal of Physical Chemistry C 123 (2019): 24453-24460.
Reske, Rulle, et al. "Particle size effects in the catalytic electroreduction of CO2 on Cu nanoparticles" Journal of the American Chemical Society 136 (2014): 6978-6986.
Sugimasa, Masatoshi, Junji Inukai, and Kingo Itaya, "Adlayer of 1,10-Phenanthroline on Cu (111) in acidic Solution: An in situ STM Study" Journal of The Electrochemical Society 150 (5) (2003): E266-E270.
Woodruff, D. P., et al. "Dipole coupling and chemical shifts in IRAS of CO adsorbed on Cu (110)" Surface Science 123 (1982): 397-412.
Hayden, B. E., K. Kretzschmar, and A. M. Bradshaw, "An infrared spectroscopic study of CO on Cu (111): The linear, bridging and physisorbed species" Surface Science 155 (1985): 553-566.
Li, Jingyi, et al. "Hydrogen bonding steers the product selectivity of electrocatalytic CO reduction" Proceedings of the National Academy of Sciences 116 No. 19 (2019): 9220-9229.
Chang, Xiaoxia, et al. "Determining intrinsic stark tuning rates of adsorbed CO on copper surfaces" Catalysis Science & Technology 11 (2021): 19 pages.
Malkani, A. S., et al. "Understanding the electric and nonelectric field components of the cation effect on the electrochemical CO reduction reaction" Science advances 6 (2020): eabd2569, 12 pages.
Borguet, Eric, and Hai-Lung Dai. "Site-specific properties and dynamical dipole coupling of CO molecules adsorbed on a vicinal Cu (100) surface" The Journal of chemical physics 101(10) (1994): 9080-9095.
Zhu, Shangqian, et al. "CO2 electrochemical reduction as probed through infrared spectroscopy" ACS Energy Letters 4 (2019): 682-689.
Gunathunge, Charuni M., et al. "Existence of an electrochemically inert CO population on Cu electrodes in alkaline pH" ACS Catalysis 8 (2018): 7507-7516.
Eren, Baran, et al. "Structural changes of Cu (110) and Cu (110)-(2×1)-O surfaces under carbon monoxide in the Torr pressure range studied with scanning tunneling microscopy and infrared reflection absorption spectroscopy" The Journal of Physical Chemistry C 120 (2016): 8227-8231.
Solymosi, Frigyes, "The bonding, structure and reactions of CO2 adsorbed on clean and promoted metal surfaces" Journal of Molecular Catalysis 65 (1991): 337-358.
De Luna, Phil, et al. "What would it take for renewably powered electrosynthesis to displace petrochemical processes?" Science 364. 6438 (2019) 12 pages.
Lewandowski, Steve. "Ethylene-Global." Asia chem. conf. 2016, 31 pages.
Huang, Jianan Erick, et al. "CO2 electrolysis to multicarbon products in strong acid." Science 372.6546 (2021) 7 pages.
Rabinowitz, Joshua A., and Matthew W. Kanan. "The future of low-temperature carbon dioxide electrolysis depends on solving one basic problem." Nature Communications 11.1 (2020): pp. 1-3.
Dinh, Cao-Thang, et al. "CO2 electroreduction to ethylene via hydroxide-mediated copper catalysis at an abrupt interface." Science 360 (2018): 6 pages.
García de Arquer, F. Pelayo, et al. "CO2 electrolysis to multicarbon products at activities greater than 1 A cm-2." Science 367 (2020): 7 pages.
Chen, Xinyi, et al. "Electrochemical CO2-to-ethylene conversion on polyamine-incorporated Cu electrodes." Nature Catalysis 4.1 (2021): 19 pages.
Kim, Jinmo, et al. "Branched copper oxide nanoparticles induce highly selective ethylene production by electrochemical carbon dioxide reduction." Journal of the American Chemical Society 141.17 (2019): 6986-6994.
Zhang, Bingxing, et al. "Highly electrocatalytic ethylene production from CO2 on nanodefective Cu nanosheets." Journal of the American Chemical Society 142.31 (2020): 13606-13613.
Li, Jun, et al. "Constraining CO coverage on copper promotes high-efficiency ethylene electroproduction." Nature Catalysis 2.12 (2019): 1124-1131.
Wang, Yuhang, et al. "Catalyst synthesis under CO2 electroreduction favours faceting and promotes renewable fuels electrosynthesis." Nature Catalysis (2020): 34 pages.
Zhong, Miao, et al. "Accelerated discovery of CO2 electrocatalysts using active machine learning" Nature 581 (2020): 178-183.
Lin, Song, et al. "Covalent organic frameworks comprising cobalt porphyrins for catalytic CO2 reduction in water" Science vol. 349 Issue 6253 (2015): 1208-1213.

(56) References Cited

OTHER PUBLICATIONS

Zhou, Yansong, et al. "Dopant-induced electron localization drives CO2 reduction to C2 hydrocarbons" Nature chemistry 10.9 (2018): 7 pages.
Wang, Xue, et al. "Efficient upgrading of CO to C3 fuel using asymmetric C—C coupling active sites" Nature communications 10 (2019): pp. 1-7.
Clark, Ezra L., et al. "Electrochemical CO2 reduction over compressively strained CuAg surface alloys with enhanced multi-carbon oxygenate selectivity" Journal of the American Chemical Society 139 (2017): 15848-15857.
Kim, Dohyung, et al. "Synergistic geometric and electronic effects for electrochemical reduction of carbon dioxide using gold-copper bimetallic nanoparticles" Nature communications 5 (2014): pp. 1-8.
Peterson, Andrew A., and Jens K. Nørskov, "Activity descriptors for CO2 electroreduction to methane on transition-metal catalysts" The Journal of Physical Chemistry Letters 3 (2012): 251-258.
Kuhl, Kendra P., et al. "Electrocatalytic conversion of carbon dioxide to methane and methanol on transition metal surfaces" Journal of the American Chemical Society 136 (2014): 7 pages.
Liu, Xinyan, et al. "Understanding trends in electrochemical carbon dioxide reduction rates" Nature communications 8 (2017): pp. 1-7.
Li, Fengwang, et al. "Molecular tuning of CO2-to-ethylene conversion" Nature 577 (2020): 509-513.
Li, Fengwang, et al. "Cooperative CO2-to-ethanol conversion via enriched intermediates at molecule-metal catalyst interfaces" Nature Catalysis 3 (2020): 75-82.
Xie, Ming Shi, et al. "Amino acid modified copper electrodes for the enhanced selective electroreduction of carbon dioxide towards hydrocarbons" Energy & Environmental Science 9 (2016): 11 pages.
Thevenon, Arnaud, et al. "In-situ nanostructuring and stabilization of polycrystalline copper by an organic salt additive promotes electrocatalytic CO2 reduction to ethylene" Angewandte Chemie 131 (2019): 9 pages.
Kim, Chanyeon, et al. "Tailored catalyst microenvironments for CO2 electroreduction to multicarbon products on copper using bilayer ionomer coatings" Nature Energy 6 (2021): 1026-1034.
Ahn, Sunyhik, et al. "Poly-amide modified copper foam electrodes for enhanced electrochemical reduction of carbon dioxide" ACS Catalysis 8 (2018): 37 pages.
Wei, Xing, et al. "Highly selective reduction of CO2 to C2+ hydrocarbons at copper/polyaniline interfaces" ACS Catalysis 10 (2020): 4103-4111.
Hod, Idan, et al. "Fe-porphyrin-based metal-organic framework films as high-surface concentration, heterogeneous catalysts for electrochemical reduction of CO2" ACS Catalysis 5 (2015): 9 pages.
Kornienko, Nikolay, et al. "Metal-organic frameworks for electrocatalytic reduction of carbon dioxide" Journal of the American Chemical Society 137 (2015): 7 pages.
Nam, Dae-Hyun, et al. "Metal-organic frameworks mediate Cu coordination for selective CO2 electroreduction" Journal of the American Chemical Society 140 (2018): 11378-11386.
Fan, Lei, et al. "Proton sponge promotion of electrochemical CO2 reduction to multi-carbon products" Joule 6 (2022): 205-220.
De Luna, Phil, et al. "Catalyst electro-redeposition controls morphology and oxidation state for selective carbon dioxide reduction" Nature Catalysis 1 (2018): 103-110.
Hoang, Thao TH, et al. "Nanoporous copper-silver alloys by additive-controlled electrodeposition for the selective electroreduction of CO2 to ethylene and ethanol" Journal of the American Chemical Society 140 (2018): 5791-5797.
Gabardo, Christine M., et al. "Continuous carbon dioxide electroreduction to concentrated multi-carbon products using a membrane electrode assembly" Joule 3 (2019): 2777-2791.
Ozden, Adnan, et al. "Cascade CO2 electroreduction enables efficient carbonate-free production of ethylene" Joule 5 (2021): 706-719.
Huang, Jianan Erick, et al. "CO2 electrolysis to multicarbon products in strong acid" Science 372 (2021): 1074-1078.
Te Velde, G., et al. "Chemistry with ADF" Journal of Computational Chemistry 22, 9 (2001): 931-967.
Neugebauer, Johannes, et al. "Quantum chemical calculation of vibrational spectra of large molecules-Raman and IR spectra for buckminsterfullerene" Journal of computational chemistry 23 (2002): 895-910.
Hahn, Christopher, et al. "Engineering Cu surfaces for the electrocatalytic conversion of CO2: Controlling selectivity toward oxygenates and hydrocarbons" Proceedings of the National Academy of Sciences 114, 23 (2017): 5918-5923.
Kim, Youn-Geun, et al. "The evolution of the polycrystalline copper surface, first to Cu (111) and then to Cu (100), at a fixed CO2RR potential: A study by operando EC-STM" Langmuir 30 (2014): 15053-15056.
Pérez-Gallent, Elena, et al. "Structure-and potential-dependent cation effects on CO reduction at copper single-crystal electrodes" Journal of the American Chemical Society 139 (2017): 16412-16419.
Sandberg, Robert B., et al. "CO—CO coupling on Cu facets: Coverage, strain and field effects" Surface Science 654 (2016): 56-62.
Schouten, Klaas Jan P., Elena Pérez Gallent, and Marc TM Koper, "The influence of pH on the reduction of CO and CO2 to hydrocarbons on copper electrodes" Journal of Electroanalytical Chemistry 716 (2014): 53-57.
Gao, J. S., and Z. Q. Tian, "Surface enhanced Raman scattering of pyridine at copper electrodes excited with a 514.5 nm line" Chemical physics letters 262 (1996): 151-154.
Buckley, Aya K., et al. "Electrocatalysis at organic-metal interfaces: identification of structure-reactivity relationships for CO2 reduction at modified Cu surfaces" Journal of the American Chemical Society 141 (2019): 7355-7364.
Hope, Gregory A., and Ronald Woods, "Transient adsorption of sulfate ions during copper electrodeposition" Journal of The Electrochemical Society 151(9), (2004): C550-C553.
Solovyeva, Elena V., et al. "SERS investigation of neocuproine adsorption on silver: Influence of electrode potential on methyl groups" Journal of Raman Spectroscopy 49 (2018): 8 pages.
Zhan, Chao, et al. "Revealing the CO coverage-driven C—C coupling mechanism for electrochemical CO2 reduction on Cu2O nanocubes via operando Raman spectroscopy" ACS catalysis 11 (2021): 7694-7701.
Hori, Yoshio, et al. "Infrared spectroscopy of adsorbed CO and intermediate species in electrochemical reduction of CO2 to hydrocarbons on a Cu electrode" Electrochimica acta 40, 16 (1995): 2617-2622.
Koga, O., et al. "Infrared spectroscopic and voltammetric study of adsorbed CO on stepped surfaces of copper monocrystalline electrodes" Electrochimica acta 50 (2005): 2475-2485.
International Search Report and Written Opinion issued in Application No. PCT/IB2023/000693, dated May 15, 2024, 11 pages.
C. Yang, et al., "Organic-Inorganic Hybrid Nanomaterials for Electrocatalytic CO2 Reduction", Small 2020, vol. 16, No. 29, p. 2001847.
International Preliminary Report on Patentability issued in Application No. PCT/IB2023/000693, dated Dec. 6, 2024, 15 pages.

PROCESS AND SYSTEM FOR THE SELECTIVE ELECTROCHEMICAL REDUCTION OF $CO_2$ IN ACIDIC CONDITIONS

CROSS-REFERENCE TO RELATED APPLICATIONS

This application claims the benefit of PCT/IB2023/000693 filed Oct. 20, 2023, which claims priority from U.S. 63/380,454 filed Oct. 21, 2022 and LU502968 filed Oct. 27, 2022, all which are incorporated herein by reference in their entireties for all purposes.

TECHNICAL FIELD

The technical field generally relates to electrochemical carbon dioxide ($CO_2$) reduction, and more specifically to systems and methods for the production of multicarbon ($C_{2+}$) products such as ethylene via the electrochemical $CO_2$ reduction ($CO_2R$).

BACKGROUND

The electrochemical $CO_2R$ is a promising avenue for producing renewable fuels, chemical feedstocks, and valuable chemicals from $CO_2$ emissions using renewable energy.[1] Among the diverse products of $CO_2R$, ethylene ($C_2H_4$) is one desirable molecule given its large demand in the chemical industry.[2]

The electrochemical $CO_2R$ to $C_2H_4$ process requires high selectivity (faradaic efficiency, FE) and high carbon conversion efficiency (i.e. a high single-pass utilization of $CO_2$). Performing the electrochemical $CO_2R$ in acidic conditions (pH<7) enables greater $CO_2$ utilization than in alkaline and neutral conditions in view of loss of $CO_2$ to bicarbonate and carbonate in these mid-pH and high-pH conditions.[3-4] However, in acidic conditions, the selectivity of the reduction reaction toward a single product has so far been low.[5-11] One of the main reasons for the low FE is the hydrogen evolution reaction (HER) which competes with the electrochemical $CO_2R$ under low pH conditions.

One strategy used to solve this problem involves concentrating potassium cations in the vicinity of electrochemically active sites accelerates $CO_2$ activation to enable efficient $CO_2R$ under low pH conditions. This approach uses an electrolysis system using a dual-layer gas diffusion electrode consisting of a layer of copper nanoparticles coated with a layer of carbon nanoparticles, an iridium oxide-coated titanium anode and a Nafion™ 117 membrane.[3] This electrolysis system operates in phosphoric acid ($H_3PO_4$, 1 M) electrolyte containing potassium chloride (KCl, 2-3 M). This approach reduces FE for hydrogen production from about 70% to about 40%, and improves the FE toward $C_2H_4$ from about 0% to about 25% compared to the baseline obtained with copper nanoparticles catalysts. Although this strategy still allows for improving the FE toward $C_2H_4$, it still remains lower than 30%.

US 2011/0114502 discloses a method for reducing carbon dioxide to one or more products is disclosed. The method may include steps (A) to (C). Step (A) may bubble the carbon dioxide into a solution of an electrolyte and a catalyst in a divided electrochemical cell. The divided electrochemical cell may include an anode in a first cell compartment and a cathode in a second cell compartment. The cathode generally reduces the carbon dioxide into the products. Step (B) may vary at least one of (i) which of the products is produced and (ii) a faradaic yield of the products by adjusting one or more of (a) a cathode material and (b) a surface morphology of the cathode. Step (C) may separate the products from the solution. Documents US 2012/0175269 and US 2012/0132538 disclose similar processes.

Nevertheless, there is still a need for new methods and systems for the selective production of $C_{2+}$ products, such as $C_2H_4$, via the electrochemical $CO_2R$.

SUMMARY

According to a first aspect, the disclosure provides for method for electrochemical production of ethylene comprising the steps of:

providing an acidic catholyte;

providing a multilayer cathode in said acidic catholyte;

contacting carbon dioxide with the multilayer cathode, such that the carbon dioxide diffuses through the gas diffusion layer and contacts the cathode catalyst layer;

applying a voltage to provide a current density to cause the carbon dioxide contacting the cathode catalyst layer to be electrochemically reduced into the ethylene; and recovering ethylene;

wherein the method is remarkable in that the multilayer cathode comprises a gas diffusion layer; and a surface-modified catalyst deposited on the gas diffusion layer, wherein the surface-modified catalyst comprises:

a cathode catalyst material with a surface presenting at least one active site for sustaining reduction of $CO_2$ into ethylene, wherein the cathode catalyst material is copper or an alloy thereof; and one or more heterocyclic organic molecules which is adsorbed on the surface of the cathode catalyst material.

Indeed, it has been found It was possible by the adsorption of one or more heterocyclic organic molecules on the surface of the cathode catalyst material to decrease a hydrogen evolution reaction and therefore promote the reduction of $CO_2$ into ethylene. As demonstrated by the examples the process of the disclosure allows for improving the FE toward $C_2H_4$ to 30% or higher, for example to 35% or higher, for example to 40% or higher.

Thus in the process according to the disclosure, at least one heterocyclic organic molecule prevents protons from accessing an active site on a surface of the cathode catalyst material to decrease a hydrogen evolution reaction, as compared to the absence of said heterocyclic organic molecule.

So the surface-modified catalyst for the electrochemical reduction of carbon dioxide in an acidic medium releasing protons, may comprise a cathode catalyst material sustaining reduction of $CO_2$ into multicarbon products; and at least one heterocyclic organic molecule preventing protons from accessing an active site on a surface of the cathode catalyst material to decrease an hydrogen evolution reaction, as compared to the absence of said heterocyclic organic molecule.

In other words, at least one heterocyclic organic molecule is adsorbed on said at least one active site of the surface of the cathode catalyst material and/or which is at a distance of said at least one active site ranging between 1 nm and 2 nm.

So the surface-modified catalyst for the electrochemical reduction of carbon dioxide in an acidic medium releasing protons, may comprise a cathode catalyst material with a surface presenting at least one active site for sustaining reduction of $CO_2$ into multicarbon products; and at least one heterocyclic organic molecule which is adsorbed on said at least one active site of the surface of the cathode catalyst material and/or which is at a distance of said at least one active site ranging between 1 nm and 2 nm.

As Regards the Acidic Catholyte and the Acidic Conditions

In an embodiment, the acidic catholyte has a pH ranging from 0.1 to 4.0 or from 0.2 to 3.5 or from 0.3 to 3.0 or from 0.5 to 2.8; preferably, a pH ranging from 0.8 to 2.5, more preferably, a pH ranging from 0.9 to 2.2; even more preferably, a pH ranging from 1.0 to 2.0; most preferably, a pH ranging from 1.1 to 1.8; and even most preferably a pH ranging from 1.2 to 1.5.

In some implementations, the acidic catholyte stream comprises at least one salt in an acidic solvent. It is understood that the acidic solvent is an aqueous solution of an acid and that the salt acts as a cation donor.

Thus an embodiment, the acidic catholyte comprises one or more acids at a concentration ranging from 0.01 to 1.0 M and one or more alkali metal cation donors at a concentration ranging from 0 to 3 M.

For example, the acidic catholyte comprises one or more acids selected from hydrochloric acid, sulfuric acid, hydrobromic acid, hydriodic acid, perchloric acid, and chloric acid; preferably sulfuric acid.

For example, the one or more acids are present at a concentration ranging from 0.01 to 2.0 M; preferably, from 0.02 to 1.5 M; more preferably ranging from 0.03 to 1.0 M; even more preferably from 0.04 to 0.8 M.

For example, the acidic catholyte comprises one or more alkali metal cation donors; wherein the one or more alkali metal halides are selected from caesium chloride, caesium iodide, caesium sulfate, caesium phosphate, caesium hydroxide, potassium chloride, potassium phosphate monobasic, potassium sulfate, potassium iodide, potassium hydroxide, lithium chloride, lithium iodide, lithium sulfate, lithium phosphate, lithium hydroxide, sodium chloride, sodium sulphate, sodium iodide, sodium phosphate, and sodium hydroxide; preferably selected from potassium chloride, potassium phosphate monobasic, potassium sulfate, potassium iodide, and potassium hydroxide; more preferably the one or more alkali metal cation donors are or comprise potassium chloride.

For example, the acidic catholyte comprises one or more alkali metal cation donors being one or more alkali metal halide; with preference, the one or more alkali metal halide are or comprise one or more alkali metal chloride selected from lithium chloride (LiCl), sodium chloride (NaCl), potassium chloride (KCl), rubidium chloride (RbCl), and caesium chloride (CsCl).

With preference the one or more alkali metal cation donors are present at a concentration ranging from 0 to 3 M; preferably ranging from 0.5 to 2.8 M; more preferably ranging from 1.0 to 2.6 M; and most preferably ranging from 1.5 to 2.5 M.

Thus, the one or more alkali metal halide are present at a concentration ranging from 0 to 3 M; preferably ranging from 0.5 to 2.8 M; more preferably ranging from 1.0 to 2.6 M; and most preferably ranging from 1.5 to 2.5 M.

As Regards the One or More Heterocyclic Organic Molecules

Without being bound by a theory, the one or more heterocyclic organic molecules will adsorb on the surface of the catalyst material on an active site for sustaining the reduction of $CO_2$ into ethylene or in the near vicinity of such active site when the reaction is performed under acidic conditions. Thus, at least one heterocyclic organic molecule is adsorbed on the active site of the surface of the cathode catalyst material, or at least one heterocyclic organic molecule is in sufficiently close proximity to the active site of the cathode catalyst material to decrease the hydrogen evolution reaction.

With preference, the one or more heterocyclic organic molecules include at least one heteroatom selected from N, S and P; with preference, the one or more heterocyclic organic molecules include at least two heteroatoms; and/or the one or more heterocyclic organic molecules include at least one heteroatom being N.

For example, the one or more heterocyclic organic molecules are or comprise one or more aromatic heterocyclic amine molecules; with preference, the one or more heterocyclic organic molecules are or comprise substituted or unsubstituted dinitrogen heterocyclic amines.

In some embodiments, the one or more heterocyclic organic molecules include at least one group containing a heteroatom selected from N, S and P; with preference, the group containing a heteroatom is an NH group.

In an embodiment, the one or more heterocyclic organic molecules are selected from 1,7-phenanthroline, 1,10-phenanthroline, 4,7-phenanthroline, neocuproine, dichloro-(1,10-phenanthroline) copper (II), 1,8-naphtrydine, adenine, benzotriazole, and guanine. With preference, the one or more heterocyclic organic molecule is selected from 1,7-phenanthroline, 1,10-phenanthroline, neocuproine, adenine, benzotriazole, and guanine. More preferably, the one or more heterocyclic organic molecule is selected from 1,10-phenanthroline, adenine, benzotriazole, and guanine. With preference, at least one heterocyclic organic molecule is 1,10-phenanthroline.

In a preferred embodiment, the cathode catalyst material is copper and the adsorption energy of the one or more heterocyclic organic molecules is in the range of from about −0.1 eV to about −0.8 eV as determined by spin-polarized density functional theory (DFT).

With preference, at least one heterocyclic organic molecule has an adsorption energy higher than to that of hydrogen on the active site on the surface of the cathode catalyst material as determined by spin-polarized density functional theory (DFT). For example, the heterocyclic organic molecule has an adsorption energy of Cu(100) surface equal to or below −0.17 eV; preferably equal to or below −0.18 eV, more preferably equal to or below than −0.19 eV; and even more preferably equal to or below than −0.20 eV. Without being bound by a theory, such a molecule will help to limit HER.

With preference, at least one heterocyclic organic molecule has an adsorption energy lower than to that of carbon monoxide on the active site on the surface of the cathode catalyst material as determined by DFT. For example, the heterocyclic organic molecule has an adsorption energy of Cu(100) surface equal to or greater than −0.86 eV; preferably equal to or greater than −0.85 eV, more preferably equal to or greater than −0.80 eV; and even more preferably equal to or greater than −0.75 eV. Without being bound by a theory, such a molecule will not affect C—C coupling.

With preference, at least one heterocyclic organic molecule has an adsorption energy of Cu(100) surface ranging from −0.17 to −0.86 eV; with preference from −0.18 to −0.80 eV; more preferably from −0.19 to 0.75 eV as determined by DFT.

In a preferred embodiment, the one or more heterocyclic organic molecules are provided within the acidic catholyte stream that flows along the cathode catalyst layer.

For example, the one or more heterocyclic organic molecules are provided in the acidic catholyte stream at a concentration ranging from 0.01 mM to 2.0 mM; preferably, from 0.05 mM to 1.5 mM; more preferably from 0.1 mM to 1.0 mM; even more preferably, from 0.15 mM to 0.8 mM; and even more preferably from 0.2 mM to 0.6 mM.

As Regards the Cathode Catalyst Material and the Multilayered Cathode

The cathode catalyst material is selected to promote the electrochemical reduction of carbon dioxide.

For example, the cathode catalyst material comprises one or more of Cu(100), Cu(111), and Cu(110) as determined by X-ray diffraction (XRD); with preference the cathode catalyst material comprises Cu(100).

In some embodiments, the cathode catalyst material is an alloy comprising copper and at least one other element selected from silver, gold, nickel, tin, gallium, zinc, palladium, cadmium, indium, platinum, mercury, thallium, lead, bismuth and cobalt.

With preference, the cathode catalyst material is in the form of nanoparticles; with preference, the nanoparticles have an average particle size of less than 50 nm as determined by scanning electron microscopy.

For example, the cathode catalyst material is in the form of nanoparticles having an average particle size in the range of from 1 nm to 50 nm as determined by scanning electron microscopy; preferably from 5 nm to 45 nm; more preferably from 10 nm to 40 nm, even more preferably from 15 nm to 35 nm; and most preferably from 20 nm to 30 nm.

For example, the multilayer cathode further comprises a current collector adjacent to the gas diffusion layer.

With preference, the gas diffusion layer in the multilayer cathode comprises a porous material; preferably the porous material is a fluoropolymer; more preferably, the fluoropolymer is polytetrafluoroethylene or expanded polytetrafluoroethylene.

With preference, the gas diffusion layer in the multilayer cathode is made of a polytetrafluoroethylene filter or a carbon paper substrate treated with polytetrafluoroethylene.

For example, the gas diffusion layer in the multilayer cathode a porosity with pore size in the range of from about 0.01 μm to 2 μm as determined by scanning electron microscopy.

For example, the cathode catalyst layer in the multilayer cathode has a thickness in the range of from about 5 μm to about 10 μm as determined by scanning electron microscopy.

For example, the multilayer cathode further comprises a cation conducting ionomer layer deposited onto the cathode catalyst layer; preferably, the multilayer cathode further comprises an additional electrically conductive layer deposited onto the cation conducting ionomer layer.

For example, the cation conducting ionomer layer comprises a cation conducting ionomer; with preference, the cation conducting ionomer is a tetrafluoroethylene-perfluoro-3,6-dioxa-4-methyl-7-octenesulfonic acid copolymer; and/or the cation conducting ionomer layer further comprises a metal catalyst.

As Regards the Anode and the Acidic Anolyte

In some implementations, the anode catalyst layer comprises an anode catalyst material that promotes electrochemical oxidation of water.

In some embodiments, the anode catalyst layer comprises an anode catalyst material that is a metal or a metal oxide; with preference the metal is a noble metal; more preferably, the noble metal is platinum.

For example, the metal oxide is selected from iridium oxide, nickel oxide, iron oxide, cobalt oxide, nickel-iron oxide, iridium-ruthenium oxide and platinum oxide; with preference, the metal oxide is iridium oxide.

For example, the anode catalyst material is on a support.

For example, the acidic anolyte comprises one or more acids selected from hydrochloric acid, sulfuric acid, hydrobromic acid, hydriodic acid, perchloric acid, and chloric acid; preferably sulfuric acid. For example, the one or more acids are present at a concentration ranging from 0.01 to 2.0 M; preferably, from 0.02 to 1.5 M; more preferably ranging from 0.03 to 1.0 M; even more preferably from 0.04 to 0.8 M.

For example, the acidic anolyte comprises on one or more alkali metal halide; with preference, the one or more alkali metal halide are or comprise one or more alkali metal chloride selected from lithium chloride (LiCl), sodium chloride (NaCl), potassium chloride (KCl), rubidium chloride (RbCl), and caesium chloride (CsCl).

Thus, the one or more alkali metal halide are present at a concentration ranging from 0 to 3 M; preferably ranging from 0.5 to 2.8 M; more preferably ranging from 1.0 to 2.6 M; and most preferably ranging from 1.5 to 2.5 M.

According to a second aspect, the disclosure provides a system for carrying out the process according to the first aspect, the system comprising:

- a cathodic compartment comprising a cathodic liquid chamber being configured to receive an acidic catholyte stream; and a multilayer cathode with the cathode catalyst layer being positioned for contacting the acidic catholyte stream;
- an anodic compartment comprising an anodic liquid chamber configured to receive an acidic anolyte stream, and an anode including on one side an anode catalyst layer for contacting the acidic anolyte stream; and
- a cation exchange membrane disposed between the cathodic compartment and the anodic compartment;

characterized in that the multilayer cathode comprises a gas diffusion layer; and a surface-modified catalyst deposited on the gas diffusion layer, wherein the surface-modified catalyst comprises:

- a cathode catalyst material with a surface presenting at least one active site for sustaining reduction of $CO_2$ into ethylene, wherein the cathode catalyst material is copper or an alloy thereof; and
- one or more heterocyclic organic molecule which is adsorbed on the surface of the cathode catalyst material.

In another aspect, the disclosure relates to a system for the electrochemical reduction of carbon dioxide ($CO_2$) in acidic conditions, the system comprising:

- a cathodic compartment comprising:
- a cathodic liquid chamber being configured to receive an acidic catholyte stream; and
- a multilayer cathode as defined herein, with the cathode catalyst layer being positioned for contacting the acidic catholyte stream;
- an anodic compartment comprising:
- an anodic liquid chamber configured to receive an acidic anolyte stream, and
- an anode including on one side an anode catalyst layer for contacting the acidic anolyte stream; and
- a cation exchange membrane disposed between the cathodic compartment and the anodic compartment.

In another aspect, the disclosure relates to the use of the system as defined herein in the electrochemical reduction of carbon dioxide in acidic conditions.

According to a third aspect, the disclosure provides for a multilayer cathode for use in a method according to the first aspect or in a system according to the second aspect, the multilayered cathode comprising a gas diffusion layer; and a surface-modified catalyst deposited on the gas diffusion layer, wherein the surface-modified catalyst comprises:

a cathode catalyst material with a surface presenting at least one active site for sustaining reduction of $CO_2$ into ethylene, wherein the cathode catalyst material is copper or an alloy thereof; and one or more heterocyclic organic molecule which is adsorbed on the surface of the cathode catalyst material.

For example, the disclosure provides for a multilayer cathode for the electrochemical reduction of carbon dioxide in an acidic catholyte releasing protons, the multilayer cathode comprising:

a gas diffusion layer; and a surface-modified catalyst deposited on the gas diffusion layer, the surface-modified catalyst comprising:

a cathode catalyst layer comprising a cathode catalyst material that promotes the electrochemical reduction of carbon dioxide into multicarbon products; and at least one heterocyclic organic molecule preventing protons from accessing an active site on a surface of the cathode catalyst layer to decrease an hydrogen evolution reaction, as compared to the absence of said heterocyclic organic molecule.

For example, the disclosure relates to a multilayer cathode for the electrochemical reduction of carbon dioxide in an acidic catholyte releasing protons, the multilayer cathode comprising:

a gas diffusion layer; and a surface-modified catalyst deposited on the gas diffusion layer, the surface-modified catalyst comprising:

a cathode catalyst layer comprising a cathode catalyst material with a surface presenting at least one active site for sustaining reduction of $CO_2$ into multicarbon products; and at least one heterocyclic organic molecule which is adsorbed on said at least one active site of the surface of the cathode catalyst material and/or which is at a distance of said at least one active site ranging between 1 nm and 2 nm.

In another aspect, the disclosure relates to the use of the multilayer cathode as defined herein in an electrochemical reduction of carbon dioxide in acidic conditions.

According to a fourth aspect, the disclosure provides for a surface-modified catalyst for the electrochemical reduction of carbon dioxide in an acidic medium releasing protons, may comprise a cathode catalyst material sustaining reduction of $CO_2$ into multicarbon products; and at least one heterocyclic organic molecule preventing protons from accessing an active site on a surface of the cathode catalyst material to decrease an hydrogen evolution reaction, as compared to the absence of said heterocyclic organic molecule.

In another definition the invention provides a surface-modified catalyst for the electrochemical reduction of carbon dioxide in an acidic medium releasing protons, may comprise a cathode catalyst material with a surface presenting at least one active site for sustaining reduction of $CO_2$ into multicarbon products; and at least one heterocyclic organic molecule which is adsorbed on said at least one active site of the surface of the cathode catalyst material and/or which is at a distance of said at least one active site ranging between 1 nm and 2 nm.

The surface modified-catalyst is for use in a method according to the first aspect or in a system according to the second aspect or in the multilayered cathode according to the third aspect.

In another aspect, the disclosure relates to the use of the surface-modified catalyst as defined herein in an electrochemical reduction of carbon dioxide in acidic conditions.

According to a fifth aspect, the disclosure relates to a method of manufacturing a multilayer cathode for the electrochemical reduction of carbon dioxide in an acidic catholyte releasing protons as defined herein, the method including the steps of:

providing a gas diffusion layer;

depositing a cathode catalyst material that promotes the electrochemical reduction of carbon dioxide into multicarbon products on one side of a gas diffusion layer to provide a cathode catalyst layer deposited thereon; and providing at least one heterocyclic organic molecule preventing protons from accessing an active site on a surface of the cathode catalyst layer to decrease an hydrogen evolution reaction, as compared to the absence of said heterocyclic organic molecule.

The multilayer cathode is according to the third aspect.

In some implementations, the method further comprises affixing the other side of the gas diffusion layer on a current collector.

In some implementations, the step of depositing the cathode catalyst material onto the gas diffusion layer is performed by a physical vapor deposition method. For example, the physical vapor deposition method is sputter deposition.

In some implementations, the method further comprises depositing a cation conducting ionomer layer onto the cathode catalyst layer. For example, the step of depositing the cation conducting ionomer solution onto the cathode catalyst layer is performed by a spray coating method. With preference, the spray coating method is an airbrush coating method.

In some implementations, the cation conducting ionomer solution comprises a cathode catalyst material and a cation conducting ionomer in a solvent.

In some implementations, the method further comprises depositing an additional electrically conductive layer onto the cation conducting ionomer layer.

In some implementations, the at least one heterocyclic organic molecule is provided within an acidic catholyte stream.

According to a sixth aspect, the disclosure relates to a method of manufacturing a system for the electrochemical reduction of carbon dioxide ($CO_2$) in acidic conditions as defined herein, the method including the steps of:

providing a cathodic compartment comprising a cathodic liquid chamber being configured to receive an acidic catholyte stream;

placing a multilayer cathode as defined herein or obtained by a process as defined herein within the cathodic compartment, with the cathode catalyst layer being positioned for contacting the acidic catholyte stream;

providing an anodic compartment comprising an anodic liquid chamber being configured to receive an anodic catholyte stream;

placing an anode including on one side an anode catalyst layer within the anodic compartment, with the anode catalyst layer being positioned for contacting the acidic anolyte stream; and placing a cation exchange membrane between the cathodic compartment and the anodic compartment.

The system is according to the second aspect.

In some implementations, the method further comprises depositing an anode catalyst material onto one side of an anode to produce the anode including on one side an anode catalyst layer. For example, the step of depositing an anode catalyst material onto one side of the anode layer is performed by a spray coating method. With preference, the spray coating method is an airbrush coating method.

In some implementations, the method further comprises affixing the other side of the anode on a current collector.

In some implementations, the method further comprises providing the cathodic liquid chamber with the acidic catholyte stream.

In some implementations, the method further comprises providing the anodic liquid chamber with the acidic anolyte stream.

DETAILED DESCRIPTION

Figure 1:
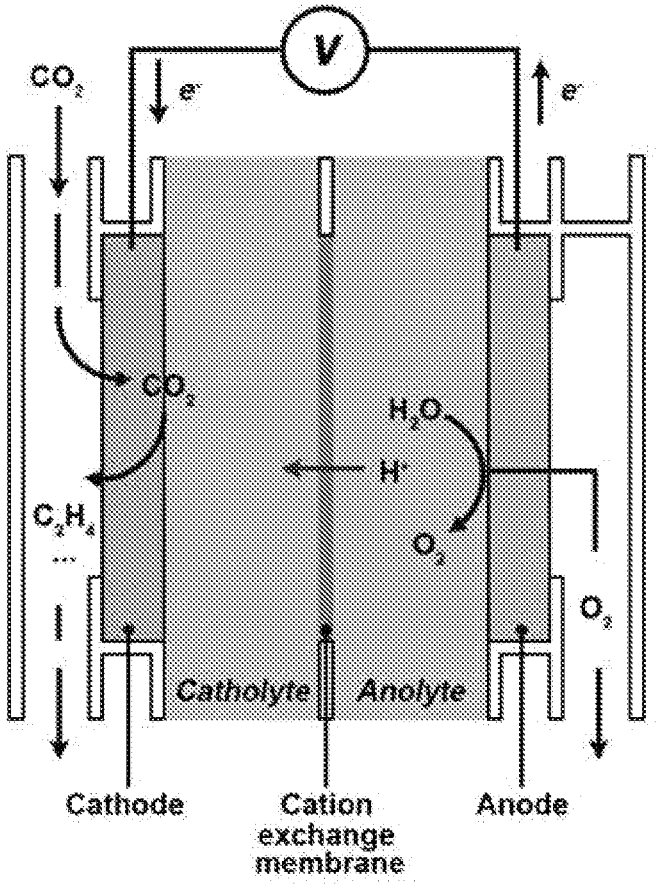
FIG. 1 is a schematic representation of a system for the electrochemical reduction of $CO_2$ in acidic conditions according to one implementation. The schematic representation shows the different components of the system as well as the reactions at the anode and at the cathode and the electron and ion transport.

The following detailed description and examples are illustrative and should not be interpreted as further limiting the scope of the technology. On the contrary, it is intended to cover all alternatives, modifications and equivalents that can be included as defined by the present description. The objects, advantages and other features of the methods will be more apparent and better understood upon reading the following non-restrictive description and references made to the accompanying drawings.

When trade names are used herein, it is intended to independently include the tradename product and the active ingredient(s) of the tradename product.

All technical and scientific terms and expressions used herein have the same definitions as those commonly understood by the person skilled in the art when relating to the present technology. The definition of some terms and expressions used herein is nevertheless provided below for clarity purposes.

When the term "about" are used herein, it means approximately, in the region of or around. When the term "about" is used in relation to a numerical value, it modifies it; for example, by a variation of 10% above and below its nominal value. This term can also take into account the rounding of a number or the probability of random errors in experimental measurements; for instance, due to equipment limitations.

When a range of values is mentioned in the present application, the lower and upper limits of the range are, unless otherwise indicated, always included in the definition. When a range of values is mentioned in the present application, then all intermediate ranges and subranges, as well as individual values included in the ranges, are intended to be included.

It is worth mentioning that throughout the following description when the article "a" is used to introduce an element, it does not have the meaning of "only one" and rather means "one or more". When the term "comprising" or its equivalent terms "including" or "having" are used herein, it does not exclude other elements. For the purposes of the present disclosure, the expression "consisting of" is considered to be a preferred implementation of the term "comprising". If a group is defined hereinafter to include at least a certain number of implementations, it is also to be understood to disclose a group, which preferably consists only of these implementations.

The chemical structures described herein are drawn according to conventional standards. Also, when an atom, such as a carbon atom as drawn, seems to include an incomplete valency, then the valency is assumed to be satisfied by one or more hydrogen atoms even if they are not necessarily explicitly drawn.

As used herein, the term "heterocyclic organic molecule" and equivalent expressions refer to a compound including a substituted or unsubstituted heteroaryl group. The term "heteroaryl" refers to an aromatic group having 4n+2 π(pi) electrons, wherein n is an integer from 1 to 3, in a conjugated monocyclic or polycyclic system, including spiro (sharing one atom) or fused (sharing at least one bond) carbocyclic ring systems, and having five to fourteen ring members, where at least one ring member is a heteroatom (e.g. N, S or P) or a group containing such heteroatom (e.g. NH, $NR_x$ ($R_x$ is alkyl, acyl, aryl, heteroaryl or cycloalkyl). For more clarity, a polycyclic ring system includes at least one heteroaromatic ring.

The term "substituted", when in association with any of the foregoing groups refers to a group substituted at one or more position with appropriate substituents. Examples of substituents include, without limitation, hydroxy, primary, secondary or tertiary amine, amide, nitro, azido, trifluoromethyl, lower alkyl, cycloalkyl, heterocycloalkyl, aryl, heteroaryl, lower alkoxy, aryloxy, benzyloxy, benzyl, carboxylate, alkoxycarbonyl, sulfonyl, sulfonate, sulfonamide, silane, siloxane, thiocarboxylate, phosphonato, phosphinato, oxo, and the like. Any of the above substituents can be further substituted if permissible, e.g. if the group contains an alkyl group, an alkoxy group, an aryl group, or other. The above substituents can be C-attached or heteroatom-attached (e.g. via a nitrogen atom), where such is possible.

As used herein, the term "alkyl" refers to saturated hydrocarbons having from one to sixteen carbon atoms, including linear or branched alkyl groups. Examples of alkyl groups include, without limitation, methyl, ethyl, propyl, butyl, pentyl, hexyl, heptyl, octyl, nonyl, decyl, isopropyl, tert-butyl, sec-butyl, isobutyl, and the like. When the alkyl group is located between two functional groups, then the term alkyl also encompasses alkylene groups such as methylene, ethylene, propylene, and the like.

The term "cycloalkyl" and equivalent expressions refer to a group including a saturated or partially unsaturated (non-aromatic) carbocyclic ring in a monocyclic or polycyclic ring system, including spiro (sharing one atom) or fused (sharing at least one bond) carbocyclic ring systems, having from three to fifteen ring members. The term cycloalkyl includes both unsubstituted cycloalkyl groups and substituted cycloalkyl groups.

The term "aryl" refers to aromatic groups having 4n+2 π(pi) electrons, wherein n is an integer from 1 to 3, in a conjugated monocyclic or polycyclic system (fused or not) and having from six to fourteen ring atoms. A polycyclic ring system includes at least one aromatic ring. Aryl can be directly attached, or connected via a $C_1$-$C_3$alkyl group (also referred to as arylalkyl or aralkyl). The term aryl includes both unsubstituted aryl groups and substituted aryl groups.

Various catalysts, cathodes, systems and processes described herein are related to the production of $C_{2+}$ products via the electrochemical $CO_2R$ in acidic conditions (pH<7).

More particularly, the present technology relates to catalysts, cathodes, systems and processes for the production of $C_{2+}$ products via the electrochemical $CO_2R$ in acidic conditions that can substantially suppress HER without negatively impacting the $C_{2+}$ product reaction pathway.

The selectivity of $CO_2R$ and HER is related to the binding energy of reaction intermediates, which can be tuned by directly modifying the electronic structure of $CO_2R$ catalysts.[12-17] However, this approach is limited by scaling relationships, where optimizing the stability of one intermediate without affecting another is rather difficult.[18-20] Recent studies employ molecules,[21-24] polymers,[25-27] and metal organic frameworks[13, 28-30] to change the local environment of active sites in Cu catalyst. Thus, the present technology aims at overcoming the linear scaling relationships by regulating HER and $CO_2R$ separately using molecular promoters.

Surface-Modified Cathode Catalysts for the Production of $C_{2+}$ Products in Acidic Conditions The present technology relates to a surface-modified cathode catalyst for the electrochemical reduction of $CO_2$ in acidic conditions. The surface-modified cathode catalyst includes a cathode catalyst material sustaining reduction of $CO_2$ into multicarbon products and at least one heterocyclic organic molecule preventing protons from accessing an active site on a surface of the cathode catalyst material to decrease an hydrogen evolution reaction, as compared to the absence of said heterocyclic organic molecule.

According to one example, the at least one heterocyclic organic molecule in sufficiently close proximity to an active site on a surface of the cathode catalyst material to decrease the HER, as compared to the absence of said heterocyclic organic molecule.

The expression "in sufficiently close proximity to an active site on a surface of the cathode catalyst material" can include a heterocyclic organic molecule present near an active site and within the electric double layer formed by contact between a catholyte solution and the surface of the cathode catalyst material. For example, the distance between the heterocyclic organic molecule and an active site on the surface of the cathode catalyst material can be in the range of from about 1 nm to about 2 nm, limits included.

The expression "in sufficiently close proximity to an active site" can also include a heterocyclic organic molecule adsorbed on an active site on the surface of the cathode catalyst material.

According to another example, the surface-modified catalyst can include at least one heterocyclic organic molecule adsorbed on an active site on the surface of the cathode catalyst material and at least one heterocyclic organic molecule sufficiently near an active site on the surface of the cathode catalyst material to decrease the HER.

According to another example, the cathode catalyst material can promote the electrochemical reduction of $CO_2$. Any compatible cathode catalyst material that promotes the electrochemical reduction of $CO_2$ is contemplated. The cathode catalyst material can include copper and an alloy thereof. For example, the catalyst material can be an alloy comprising copper and at least one other element. For example, the other element can be silver, gold, nickel, tin, gallium, zinc, palladium, cadmium, indium, platinum, mercury, thallium, lead, bismuth or cobalt. In some examples of interest, the cathode catalyst material is copper.

According to another example, the cathode catalyst material can be in the form of particles. For example, the cathode catalyst material can be in the form of microparticles or nanoparticles, and preferably nanoparticles. In some examples of interest, the nanoparticles can have an average particle size of less than about 50 nm. For example, the nanoparticles can have an average particle size in the range of from about 1 nm to about 50 nm, or from about 5 nm to about 45 nm, or from about 10 nm to about 40 nm, or from about 15 nm to about 35, or from about 20 nm to about 30, limits included.

According to another example, the heterocyclic organic molecule can be selected for its ability to increase selectivity towards at least one predetermined valuable $C_{2+}$ product, such as $C_2H_4$. For example, the heterocyclic organic molecule can be selected for its ability to increase selectivity toward $C_2H_4$.

According to another example, the heterocyclic organic molecule can be selected for its adsorption behavior. For example, the heterocyclic organic molecule can have an adsorption energy on the surface of the cathode catalyst material that is higher than that of hydrogen and lower than that of carbon monoxide. For example, the heterocyclic organic molecule can adsorb at low-coordination sites on the surface of the cathode catalyst material.

According to another example, the heterocyclic organic molecule can include a five-membered ring, a six-membered ring, or a combination of both. The heterocyclic organic molecule can include at least one heteroatom selected from the group consisting of a N, S and P, or a group containing such heteroatom.

For example, the one or more heterocyclic organic molecules are or comprise one or more aromatic heterocyclic amine molecules; with preference, the one or more heterocyclic organic molecules are or comprise substituted or unsubstituted dinitrogen heterocyclic amines. For example, the one or more heterocyclic organic molecules are or comprise substituted or unsubstituted dinitrogen aromatic heterocyclic amines.

According to another example, the heterocyclic organic molecule can be a nitrogen-containing heterocyclic organic molecule and includes at least one nitrogen heteroatom or a nitrogen-containing group. For example, the nitrogen-containing heterocyclic organic molecule can include an amine group, a pyrrolic group, or a pyridinic group. Non-limiting examples of nitrogen-containing heterocyclic organic molecules include 1,7-phenanthroline, 1,10-phenanthroline, 4,7-phenanthroline, neocuproine, dichloro-(1,10-phenanthroline) copper (II), 1,8-naphthydine, adenine, benzotriazole, and guanine. With preference, the one or more heterocyclic organic molecule is selected from 1,7-phenanthroline, 1,10-phenanthroline, neocuproine, adenine, benzotriazole, and guanine. More preferably, the one or more heterocyclic organic molecule is selected from 1,10-phenanthroline, adenine, benzotriazole, and guanine. With preference, at least one heterocyclic organic molecule is 1,10-phenanthroline.

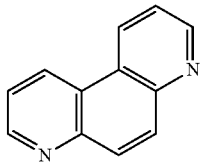

4,7-Phenanthroline

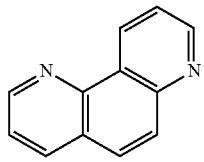

1,7-Phenanthroline

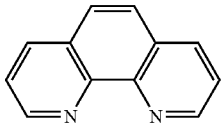

1,10-Phenanthroline

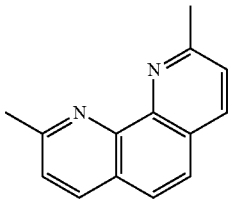

Neocuproine

-continued

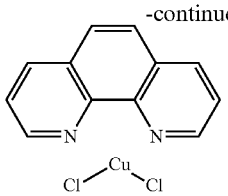

Dichloro(1,10-phenanthroline)copper(II)

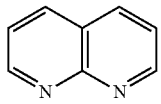

1,8-Naphthyridine

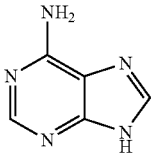

Adenine

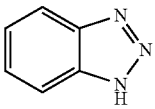

Benzotriazole

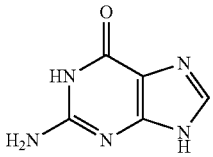

Guanine

Without wishing to be bound by theory, the heterocyclic organic molecule as defined herein can adsorb at low-coordination sites on the surface of the cathode catalyst material to substantially reduce HER. Low-coordination sites on the surface of the cathode catalyst material can include steps, edges, corners, kinks, and defects. For more clarity, the heterocyclic organic molecule as defined herein does not substantially adsorb at terrace sites on the surface of the cathode catalyst material, which are needed for the production of $C_{2+}$ products. It is to be understood that the heterocyclic organic molecule as defined herein can carry out a selective site-blocking mechanism, whereby their adsorption at low-coordination sites on the surface of the cathode catalyst material reduces HER, but does not poison terrace sites that are needed for $C_{2+}$ products formation.

For example, the one or more heterocyclic organic molecules are provided in the acidic catholyte stream at a concentration ranging from 0.01 mM to 2.0 mM; preferably, from 0.05 mM to 1.5 mM; more preferably from 0.1 mM to 1.0 mM; even more preferably, from 0.15 mM to 0.8 mM; and even more preferably from 0.2 mM to 0.6 mM.

In some cases, the cathode catalyst material is copper and the adsorption energy of the heterocyclic organic molecule is in the range of from about −0.1 eV to about −0.8 eV, limits included. For example, the terrace sites can be the Cu atoms on the (100), (111), and (110) surfaces, while low-coordination sites can be Cu atoms on the steps, kinks, and corners. On (111) surface, the terrace sites can be identified by a coordination number of 9, while step sites have a coordination number of 7. Thus, the low-coordination sites have coordination numbers of less than 9. It is to be noted that the coordination numbers can differ depending on the crystal structure and termination. In some examples, the cathode catalyst material is copper and the desired $C_{2+}$ product is $C_2H_4$, and above about 30% FE toward $C_2H_4$ can be obtained in acidic $CO_2R$. For example, compared to the highest efficiency prior $CO_2$-to-$C_2H_4$ production in acidic conditions, the surface-modified cathode catalyst as defined herein can provide an increase in energy efficiency of about 60%.

With preference, at least one heterocyclic organic molecule has an adsorption energy higher than to that of hydrogen on the active site on the surface of the cathode catalyst material as determined by spin-polarized density functional theory (DFT). For example, the heterocyclic organic molecule has an adsorption energy of Cu(100) surface equal to or below −0.17 eV; preferably equal to or below −0.18 eV, more preferably equal to or below than −0.19 eV; and even more preferably equal to or below than −0.20 eV. Without being bound by a theory, such a molecule will help to limit HER.

With preference, at least one heterocyclic organic molecule has an adsorption energy lower than to that of carbon monoxide on the active site on the surface of the cathode catalyst material as determined by DFT. For example, the heterocyclic organic molecule has an adsorption energy of Cu(100) surface equal to or greater than −0.86 eV; preferably equal to or greater than −0.85 eV, more preferably equal to or greater than −0.80 eV; and even more preferably equal to or greater than −0.75 eV. Without being bound by a theory, such a molecule will not affect C—C coupling.

With preference, at least one heterocyclic organic molecule has an adsorption energy of Cu(100) surface ranging from −0.17 to −0.86 eV; with preference from −0.18 to −0.80 eV; more preferably from −0.19 to 0.75 eV as determined by DFT.

According to another example, the heterocyclic organic molecule can be selected, tuned or modified to modulate its adsorption behavior at an active site on the surface of the cathode catalyst material. The heterocyclic organic molecule can include two or more heteroatoms or heteroatom-containing groups positioned in close proximity to each other. For instance, the heterocyclic organic molecule can include two or more heteroatoms or heteroatom-containing groups positioned next to each other or separated by one or two carbon atoms. Non-limiting examples of such heterocyclic organic molecules include benzotriazole, 1,8-naphthyridine and 1,10-phenantroline. For example, the position of the two or more heteroatoms or heteroatom-containing groups relative to each other can be tuned depending on the separation of the active sites on the surface of the cathode catalyst material. The adsorption energy can also be modulated by adjusting the steric hindrance via the addition of a at least one sterically hindering substituent to the heterocyclic organic molecule. For example, the sterically hindering substituent can substantially reduce the adsorption energy when the heterocyclic organic molecule is adsorbed on an active site on the surface of the cathode catalyst material.

It is noted that organic molecules have been employed in neutral and alkaline conditions to modify the catalyst surface[21-22, 31] or to function as structure-directing agents during catalyst synthesis.[24, 32-33] Nitrogen-containing heterocycles can influence the local reaction environment of $CO_2R$ by interacting with both $CO_2$ and Cu via the lone pair of electrons of the pyridinic-, or pyrrolic-nitrogen atoms. N-heterocycles have been implemented in alkaline $CO_2R$ and demonstrated abilities to influence selectivity.[21, 23] However, the requirement for HER suppression is substantially greater in acidic $CO_2R$ as compared to that in neutral and alkaline conditions.

Multilayer Cathode for the Production of $C_{2+}$ Products in Acidic Conditions

The present technology also relates to a multilayer cathode for the electrochemical reduction of $CO_2$ in an acidic catholyte releasing protons, the multilayer cathode including:

- a gas diffusion layer; and
- a surface-modified catalyst deposited on the gas diffusion layer, the surface-modified catalyst including:
  - a cathode catalyst layer including a cathode catalyst material that promotes the electrochemical reduction of carbon dioxide into multicarbon products; and
  - at least one heterocyclic organic molecule preventing protons from accessing an active site on a surface of the cathode catalyst layer to decrease an hydrogen evolution reaction, as compared to the absence of said heterocyclic organic molecule.

According to one example, the gas diffusion layer can include a porous material. Any known compatible porous material is contemplated. The porous material can be a carbon paper or a porous polymer material. For instance, the porous polymer material can be a fluoropolymer such as PTFE and expanded polytetrafluoroethylene (ePTFE). For example, the gas diffusion layer can be made of a PTFE filter. Alternatively, the gas diffusion layer can be made of a carbon paper substrate with or without a PTFE treatment, preferably with a PTFE treatment. In some examples, the gas diffusion layer has a porosity with pore size in the range of from about 0.01 μm to 2 μm, limits included.

According to another example, the multilayer cathode can further include a current collector adjacent to the gas diffusion layer.

According to another example, the gas diffusion layer can include a cathode catalyst coating layer disposed thereon. For example, cathode catalyst coating layer includes a cathode catalyst material (e.g. a cathode catalyst material as defined above). The catalyst coating layer can be substantially thin. For instance, the cathode catalyst coating layer can have a thickness in the range of from about 200 nm to about 750 nm, limits included. The cathode catalyst coating layer can be substantially uniform across the entire surface of the gas diffusion layer. Alternatively, the cathode catalyst coating layer can be deposited on at least a portion of the surface of the gas diffusion layer. For example, the cathode catalyst coating layer can be heterogeneously dispersed on the surface of the porous material of the gas diffusion layer.

According to another example, the cathode catalyst layer can include a cathode catalyst material, for example, the cathode catalyst material can be as defined above.

According to another example, the cathode catalyst layer can have a thickness in the range of from about 5 μm to about 10 μm, limits included. The cathode catalyst layer can be disposed on the porous material of the gas diffusion layer or on cathode catalyst coating layer of the gas diffusion layer. For instance, the cathode catalyst material of the cathode catalyst layer can act as a primary catalyst, while the cathode catalyst material of the cathode catalyst coating layer can act as a secondary catalyst. It is to be understood that the cathode catalyst layer has a substantially larger surface area and/or substantially higher mass compared to the cathode catalyst coating layer.

According to another example, the multilayer cathode can further include a cation conducting ionomer layer deposited onto the cathode catalyst layer. The cation conducting ionomer layer can include a substantially small amount of a cation conducting ionomer, and optionally a solvent. Any compatible cation conducting ionomer is contemplated. In some examples of interest, the cation conducting ionomer is Nafion™ 117. The cation conducting ionomer layer can include the cation conducting ionomer at a cathode catalyst material: cation conducting ionomer weight ratio of at least about 20:1. For example, the cation conducting ionomer layer can be made exclusively the cation conducting ionomer, and optionally the solvent.

According to another example, the cation conducting ionomer layer can be substantially thin. The cation conducting ionomer layer can be substantially uniform across the entire surface cathode catalyst layer. Alternatively, the cation conducting ionomer layer can be deposited on at least a portion of the surface of the cathode catalyst layer. For example, the cation conducting ionomer layer can be heterogeneously dispersed on the surface of the cathode catalyst layer.

According to another example, the multilayer cathode can further include an acidic catholyte layer or an acidic catholyte stream that flows along the cathode catalyst layer. For example, the at least one heterocyclic organic molecule is further provided within the acidic catholyte layer or stream.

According to another example, the multilayer cathode can further include an additional electrically conductive layer deposited onto the cation conducting ionomer layer. For example, the additional electrically conductive layer can include carbon nanoparticles and optionally at least one of a solvent, an ionomer (e.g. a cation conducting ionomer as defined above) and PTFE nanoparticles. For example, the additional electrically conductive layer can act as a physical barrier and can improve the stability of the multilayer cathode by preventing the cathode catalyst layer to remain in contact with the acidic catholyte layer or stream.

According to another example, the acidic catholyte layer or stream can include at least one salt in an acidic solvent. The salt can be present in the acidic catholyte layer or stream at a concentration in the range of from about 0 M to about 3 M, limits included. The salt can be an ionic salt, for example, the ionic salt can be an alkali metal halide salt such as an alkali metal chloride salt. Non-limiting examples of alkali metal chloride salts include lithium chloride (LiCl), sodium chloride (NaCl), potassium chloride (KCl), rubidium chloride (RbCl), and caesium chloride (CsCl). In some examples of interest, the salt is potassium chloride (KCl). The acidic solvent can be an aqueous acidic solvent. In some examples of interest, the acidic solvent is an aqueous solution of sulfuric acid ($H_2SO_4$).

In an embodiment, the acidic catholyte has a pH ranging from 0.1 to 4.0 or from 0.2 to 3.5 or from 0.3 to 3.0 or from 0.5 to 2.8; preferably, a pH ranging from 0.8 to 2.5, more preferably, a pH ranging from 0.9 to 2.2; even more preferably, a pH ranging from 1.0 to 2.0; most preferably, a pH ranging from 1.1 to 1.8; and even most preferably a pH ranging from 1.2 to 1.5.

In some implementations, the acidic catholyte stream comprises at least one salt in an acidic solvent. It is understood that the acidic solvent is an aqueous solution of an acid and that the salt acts as a cation donor.

Thus an embodiment, the acidic catholyte comprises one or more acids at a concentration ranging from 0.01 to 1.0 M and one or more alkali metal cation donors at a concentration ranging from 0 to 3 M.

For example, the acidic catholyte comprises one or more acids selected from hydrochloric acid, sulfuric acid, hydrobromic acid, hydriodic acid, perchloric acid, and chloric acid; preferably sulfuric acid.

For example, the one or more acids are present at a concentration ranging from 0.01 to 2.0 M; preferably, from 0.02 to 1.5 M; more preferably ranging from 0.03 to 1.0 M; even more preferably from 0.04 to 0.8 M.

For example, the acidic catholyte comprises one or more alkali metal cation donors; wherein the one or more alkali metal halides are selected from caesium chloride, caesium iodide, caesium sulfate, caesium phosphate, caesium hydroxide, potassium chloride, potassium phosphate monobasic, potassium sulfate, potassium iodide, potassium hydroxide, lithium chloride, lithium iodide, lithium sulfate, lithium phosphate, lithium hydroxide, sodium chloride, sodium sulphate, sodium iodide, sodium phosphate, and sodium hydroxide; preferably selected from potassium chloride, potassium phosphate monobasic, potassium sulfate, potassium iodide, and potassium hydroxide; more preferably the one or more alkali metal cation donors are or comprise potassium chloride.

For example, the acidic catholyte comprises one or more alkali metal cation donors being one or more alkali metal halide; with preference, the one or more alkali metal halide are or comprise one or more alkali metal chloride selected from lithium chloride (LiCl), sodium chloride (NaCl), potassium chloride (KCl), rubidium chloride (RbCl), and caesium chloride (CsCl).

With preference the one or more alkali metal cation donors at a concentration ranging from 0 to 3 M; preferably ranging from 0.5 to 2.8 M; more preferably ranging from 1.0 to 2.6 M; and most preferably ranging from 1.5 to 2.5 M.

According to another example, the acidic catholyte layer can be substantially uniform across the entire surface of the cation conducting ionomer layer. Alternatively, the acidic catholyte layer can be deposited on at least a portion of the surface of the cation conducting ionomer layer. For example, the acidic catholyte layer can be heterogeneously dispersed on the surface of the cation conducting ionomer layer.

It is to be understood that the heterocyclic organic molecule prevents protons from accessing an active site on a surface of the cathode catalyst material of the cathode catalyst layer or of the cation conducting ionomer layer to decrease a hydrogen evolution reaction, as compared to the absence of said heterocyclic organic molecule.

System for the Production of $C_{2+}$ Products in Acidic Conditions

The present technology also relates to a system for the electrochemical reduction of $CO_2$ in acidic conditions including a multilayer cathode as defined above.

More particularly, the system for the electrochemical reduction of $CO_2$ in acidic conditions includes:

- a cathodic compartment including:
  - a cathodic liquid chamber being configured to receive an acidic catholyte stream, and
  - a multilayer cathode as defined above, with the cathode catalyst layer being positioned for contacting the acidic catholyte stream;
- an anodic compartment comprising:
  - an anodic liquid chamber configured to receive an acidic anolyte stream, and
  - an anode including on one side an anode catalyst layer for contacting the acidic anolyte stream; and
- a cation exchange membrane disposed between the cathodic compartment and the anodic compartment.

For a more detailed understanding of the disclosure, reference is first made to FIG. 1, which provides a schematic representation of a system for the electrochemical reduction of $CO_2$ in acidic conditions in accordance with a possible embodiment.

As illustrated in FIG. 1, the system can include a cathode compartment, an anode compartment and a cation exchange membrane separating the anode and cathode compartments.

Still referring to FIG. 1, the cathode compartment includes a multilayer cathode as defined above (the different layers of the multilayer cathode not being shown in FIG. 1). For more clarity, the catholyte shown in FIG. 1 can be the acidic catholyte layer or stream of the multilayer cathode as defined above.

Still referring to FIG. 1, the anode compartment includes an anode including on one side an anode catalyst layer (not shown in FIG. 1) for contacting the acidic anolyte stream. For more clarity, the anolyte shown in FIG. 1 can be an acidic anolyte layer or an acidic anolyte stream.

According to one example, the anode catalyst layer can include an anode catalyst material that promotes electrochemical oxidation of water while being stable in acidic conditions (pH<7). Any compatible anode catalyst material that promotes electrochemical oxidation of water is contemplated. The anode catalyst material can include a metal selected from the group consisting of iridium, nickel, iron, cobalt, ruthenium, platinum and an alloy including at least one thereof. The anode catalyst material can be a metal oxide, where the metal is as described herein. Non-limiting examples of anode catalyst materials include iridium oxide, nickel oxide, iron oxide, cobalt oxide, nickel-iron oxide, iridium-ruthenium oxide and platinum oxide. The anode catalyst layer can further include a support material such as a titanium substrate (for example, a titanium mesh or felt). In some examples of interest, the anode can include a pristine or a titanium supported iridium oxide anode catalyst.

For more clarity, the anolyte layer or stream shown in FIG. 1 includes an acidic anolyte (pH<7). The acidic anolyte layer or stream can include an acidic solvent and optionally at least one salt. The salt, if present in the anolyte layer or stream, can be at a concentration in the range of from about 0 M to about 3 M, limits included. The salt can be an ionic salt, for example, the ionic salt can be an alkali metal halide salt such as an alkali metal chloride salt. Non-limiting examples of alkali metal chloride salts include lithium chloride (LiCl), sodium chloride (NaCl), potassium chloride (KCl), rubidium chloride (RbCl), and caesium chloride (CsCl). In some examples of interest, the salt is potassium chloride (KCl). The acidic solvent can be an aqueous acidic solvent. In some examples of interest, the acidic solvent is an aqueous solution of sulfuric acid ($H_2SO_4$).

As illustrated in FIG. 1, the cation exchange membrane is disposed between the acidic catholyte layer or stream and the acidic anolyte layer or stream. For example, the cation exchange membrane can be used as a separator and as a solid electrolyte to selectively transport protons across the system. Any compatible cation exchange membrane is contemplated, for example, the cation exchange membrane can be a perfluorosulfonic acid polymer membrane or a perfluorosulfonic acid-PTFE copolymer membrane. In some examples of interest, the cation exchange membrane can be a Nafion™ membrane such as a Nafion™ 117 membrane having a thickness of about 183 μm (Fuel Cell Store).

According to another example, the system as defined herein can be an electrolyzer. Any compatible type of electrolyzer is contemplated. For example, the system as defined herein can be a flow cell, a slim flow cell or a membrane electrode assembly system.

Method of Manufacturing a Multilayer Cathode for the Production of $C_{2+}$ Products in Acidic Conditions The present technology also relates to a method of manufacturing a multilayer cathode for the electrochemical reduction of carbon dioxide in an acidic catholyte releasing protons as defined herein, the method including the steps of:

- depositing a cathode catalyst material that promotes the electrochemical reduction of carbon dioxide into multicarbon products onto one side of a gas diffusion layer to provide a cathode catalyst layer deposited thereon; and
- providing at least one heterocyclic organic molecule preventing protons from accessing an active site on a surface of the cathode catalyst layer to decrease an hydrogen evolution reaction, as compared to the absence of said heterocyclic organic molecule.

wherein the cathode catalyst material, the cathode catalyst layer, the gas diffusion layer, and the at least one heterocyclic organic molecule are as defined above.

According to one example, the method can further include affixing the other side of the gas diffusion layer on a current collector as defined above.

According to another example, the step of depositing the cathode catalyst material onto the gas diffusion layer can be performed by a physical vapor deposition method, for example, by sputter deposition.

According to another example, the method can further include depositing a cation conducting ionomer layer onto the cathode catalyst layer. For example, the step of depositing a cation conducting ionomer solution onto the cathode catalyst layer can be performed by a conventional coating method. Any compatible coating method is contemplated. For example, the step of depositing a cation conducting ionomer solution onto the cathode catalyst layer can be performed by a spray coating method such as an airbrush coating method.

According to another example, the method can further include depositing an additional electrically conductive layer onto the cation conducting ionomer layer. For example, the step of depositing the additional electrically conductive layer onto the cation conducting ionomer layer can be performed by a conventional coating method. Any compatible coating method is contemplated. For example, the step of depositing the additional electrically conductive layer onto the cation conducting ionomer layer can be performed by a spray coating method such as an airbrush coating method.

According to another example, the cation conducting ionomer solution can include a cathode catalyst material as defined above and a cation conducting ionomer as defined above in a solvent. For example, the solvent can be methanol.

Method of Manufacturing a System for the Production of $C_{2+}$ Products in Acidic Conditions The present technology also relates to a method of manufacturing a system for the electrochemical reduction of $CO_2$ in acidic conditions as defined herein, the method including the steps of:

- providing a cathodic compartment including a cathodic liquid chamber being configured to receive an acidic catholyte stream;
- placing a multilayer cathode as defined herein or obtained by a process as defined herein within the cathodic compartment, with the cathode catalyst layer being positioned for contacting the acidic catholyte stream;
- providing an anodic compartment comprising an anodic liquid chamber being configured to receive an anodic catholyte stream;
- placing an anode including on one side an anode catalyst layer within the anodic compartment, with the anode catalyst layer being positioned for contacting the acidic anolyte stream; and
- placing a cation exchange membrane between the cathodic compartment and the anodic compartment.

According to one example, the method can further include depositing an anode catalyst material onto one side of the anode to produce the anode including on one side an anode catalyst layer. For example, the step of depositing an anode catalyst material onto one side of the anode can be performed by a conventional coating method. Any compatible coating method is contemplated. For example, the step of depositing an anode catalyst material onto one side of the anode can be performed by a spray coating method such as an airbrush coating method.

According to another example, the method can further include annealing the anode catalyst layer. The annealing step can be carried out at a temperature and for a period of time sufficient to anneal the anode catalyst material of the anode catalyst layer. For example, the annealing step can be carried out under an air atmosphere in an oven at a temperature above 300° C.

According to another example, the method can further include affixing the other side of the anode on a current collector as defined above.

According to another example, the method can further include providing the cathodic liquid chamber with the acidic catholyte stream or layer.

According to another example, the method can further include providing the anodic liquid chamber with the acidic anolyte stream or layer.

Method for the Production of $C_{2+}$ Products in Acidic Conditions

The present technology also relates to the use of the multilayer cathode or the system as defined herein for the production of a $C_{2+}$ product.

The present technology also relates to a method for electrochemical production of a $C_{2+}$ product using the multilayer cathode or the system as defined herein, the method comprising the steps of:

- contacting $CO_2$ with the multilayer cathode, such that the $CO_2$ diffuses through the gas diffusion layer and contacts the cathode catalyst layer;
- applying a voltage to provide a current density to cause the $CO_2$ contacting the cathode catalyst layer to be electrochemically reduced into the $C_{2+}$ product; and
- recovering the $C_{2+}$ product.

According to one example, the method as described herein can be applied to a wide variety of $CO_2$ gas streams such as, for example, flue gas and air.

According to another example, the $C_{2+}$ product can be any suitable $C_{2+}$ products, for example, the $C_{2+}$ product can be $C_2H_4$.

In cases where the $C_{2+}$ product is $C_2H_4$, the system as defined above is used can convert $CO_2$ into $C_2H_4$ using electricity and water in electrolytes with pH<7 (i.e., the acidic catholyte and anolyte as defined above). Two main reactions occur in the system: $CO_2$ reduction (Equation 1) occurs on the cathode and oxygen evolution reaction (Equation 2) occurs on the anode to complete the electrochemical reactions.

$$2CO_2 + 12H^+ + 12e- \rightarrow C_2H_4\,(g) + 4H_2O \quad (1)$$

$$4H_2O \rightarrow O_2 + 4H^+ + 4e^- \quad (2)$$

According to some examples, the system as defined above can be designed to facilitate the above chemical reactions (Equations 1 and 2), and/or the facilitate the transport of electrons ($e^-$) and protons ($H^+$). It is to be understood that the cathode can convert $CO_2$ to $C_2H_4$ (Equation 1), the acidic catholyte layer can conduct ions and can substantially suppress HER, the cation exchange membrane can transport cations from the anode to the cathode, the acidic anolyte layer or stream can conduct ions, and the anode can produce oxygen (Equation 2).

For example, the acidic anolyte comprises one or more acids selected from hydrochloric acid, sulfuric acid, hydrobromic acid, hydriodic acid, perchloric acid, and chloric acid; preferably sulfuric acid. For example, the one or more acids are present at a concentration ranging from 0.01 to 2.0 M; preferably, from 0.02 to 1.5 M; more preferably ranging from 0.03 to 1.0 M; even more preferably from 0.04 to 0.8 M.

In some cases where the $C_{2+}$ product is $C_2H_4$, the technology as described herein can achieve FE for converting $CO_2$ to $C_2H_4$ above 30%, preferably above 50%, and more preferably above 55%. In comparison, the state-of-the-art technology which uses a gas diffusion electrode that consists of two layers: a base layer of copper nanoparticles, and a top layer of carbon nanoparticles, only achieves <30% FE for $C_2H_4$.

As mentioned above, these heterocyclic organic molecules can suppress HER, but do not negatively affect $C_{2+}$ product formation by selectively blocking active sites on the cathode catalyst material that favor HER. Thus, the technology as described herein uses heterocyclic organic molecules to increase the selectivity for the $C_{2+}$ product formation from the electrochemical reduction of $CO_2$ in acidic conditions.

As mentioned above, the heterocyclic organic molecules can be tuned to substantially outcompete the adsorption of hydrogen on low-coordinate sites on the surface of the cathode catalyst material, which are active for hydrogen production, a side reaction. At the same time, the adsorption energy of the heterocyclic organic molecules can be tuned to not significantly poison the sites for $C_{2+}$ product formation. This strategy enables selective blocking of cathode catalyst material sites to substantially suppress HER without negatively impacting $C_{2+}$ product formation.

EXAMPLES

The following non-limiting examples are illustrative embodiments and should not be construed as limiting the scope of the present invention. These examples will be better understood with reference to the accompanying Figures.

Example 1: Experimental Conditions and Methods

X-Ray Diffraction: XRD data can be obtained from a D8 ADVANCE diffractometer (Bruker) using a Cu Kα X-ray source (1.5406 Å). Peaks were attributed using the PDF-2/release 2013 RDB database XPS measurement: Surface elemental composition is determined by X-ray photoelectron spectroscopy (XPS; Thermo Electron Escalab 250) using a monochromated Al Ka radiation (1486.6 eV) and photoelectron take-off angle of 90°. Survey and high resolution spectra energy is 100 eV and 20 eV, respectively. Thermo Electron software Advantage is used for curve fitting of the XPS spectra.

(a) Material

High purity copper (Cu) sputtering targets (99.99%, Kurt J. Lesker Company, EJTCUXX403A2) was used in the fabrication of sputtered Cu catalysts. High surface area CuNPs, (99.8%, 25 nm, stock #: US1828, US Research Nanomaterials Inc.) were used in the preparation of CuNPs electrodes. A high surface area carbon powder (Carbon Black—Vulcan XC-72R, FuelCell Store, Product Code: 590106-1) was used to prepare porous carbon-coated electrodes. All N-heterocycles: 4,7-phenanthroline (4,7-Phen, 301868), 1,7-phenanthroline (1,7-Phen, 301841), neocuproine (Neo, N1501), 1,10-phenanthroline (1,10-Phen, 131377), adenine (Ade, A8626), benzotriazole (Bta, B11400), 1,8-naphthyridine (1,8-Naph, CDS021459) and dichloro(1,10-phenanthroline) copper (II) ($CuCl_2$-Phen, 362204) were purchased from Sigma-Aldrich. Sulfuric acid ($H_2SO_4$, Fischer Chemicals, A300S), potassium sulfate ($K_2SO_4$, Aldrich, P0772), and potassium chloride (KCl, Aldrich, P3911) were used in the preparation of supporting electrolytes. PTFE gas diffusion layers with 450 nm pore size were purchased from Beijing Zhongxingweiye Instrument Co., Ltd. Nafion™ 117 membrane was purchased from the FuelCell Store.

(b) Catalyst Synthesis

Magnetron sputtering (Angstron Engineering, Nextdep) was used to deposit 200 nm of Cu catalyst on a PTFE GDL at a rate of 1 Å/s in high vacuum. CuNPs electrodes were prepared by spray-coating a CuNPs catalyst ink onto sputtered Cu. The catalyst ink consists of CuNPs, Nafion™ 117 ionomer solution (527084, Aldrich), and methanol. A standard catalyst ink contained 40 mg of CuNPs, 30 uL of Nafion™ 117 ionomer suspended in 2.5 mL of methanol for a 12 $cm^2$ electrode. A porous carbon coating was prepared by spray-coating high surface area carbon nanoparticles onto the CuNPs electrodes. The carbon nanoparticles were suspended in methanol with Nafion™ 117 ionomer and PTFE nanoparticles before spray coating. A standard carbon ink contained 9 mg of carbon, 3 mg of PTFE, 30 μL of Nafion™ 117 ionomer solution in 2.5 mL of methanol.

(c) Catalyst Characterization

Scanning electron microscopy (SEM, Hitachi S3500) and transmission electron microscopy (TEM, Hitachi HF3300) were used to characterize the crystallinity and morphology of CuNPs. Surface sensitive elemental analysis was performed by X-ray photoelectron spectroscopy (XPS, Thermo Scientific K-Alpha) using an Al Kα source. The XPS data were analyzed using CasaXPS. In-situ XAS measurements were conducted at 9BM of the Advanced Photon Source (Argonne National Laboratory, IL), in partnership with the Canadian Light Source (Saskatoon, SK). The XAS data were processed by Athena and Artemis software incorporated into the standard IFEFFIT package. Ex situ and in situ Raman spectroscopy (Renishaw Invia Raman) was performed to investigate N-heterocycle adsorption and CO speciation on Cu, CuNPs, and C-coated CuNPs during and/or after $CO_2$ reduction reaction.

(d) $CO_2$ Reduction in a Flow Cell

The flow cell measurement system consisted of three chambers, namely, two chambers for liquid electrolytes (catholyte and anolyte) and one gas flow chamber. Each chamber had an inlet and outlet. The catholyte used in all experiments was a 2.5 M KCl solution in 0.05 M $H_2SO_4$, and the anolyte used in all experiments was 0.05 M $H_2SO_4$. For experiments containing N-heterocycles, each molecule was added to the catholyte at a concentration of 0.25 mM. The electrolytes were circulated throw the flow cell using peristaltic pumps. $CO_2$ (Linde Gas) flow through the gas flow chamber was controlled using a mass flow controller (Brooks Instrument, GF100). The $CO_2$ flow rate was fixed at 40 sccm unless stated otherwise. The catalyst-coated working electrodes, Nafion™ 117 membrane, and a platinum mesh (Fisher Scientific, AA41814FF) counter electrode were sandwiched between the three chambers during the acidic $CO_2R$. The working electrode potential was measured against an Ag/AgCl reference electrode (CH Instruments, CHI111P) that was inserted into the catholyte chamber.

(e) $CO_2$ Reduction in a Full Cell

A slim flow cell was used to measure the full cell performance. The slim flow cell comprised an anolyte chamber, a catholyte chamber, and a gas flow chamber. The catholyte chamber was made of polyether ether ketone (PEEK) and had a total thickness of 1/16". The dimensions were reduced in order to decrease the ohmic losses between the cathode and the anode. In the full cell measurement, oxygen evolution reaction took place on the anode and was catalyzed by an iridium oxide catalyst supported on a titanium felt ($IrO_x$—Ti).[34] The typical loading of $IrO_x$ was about 1.5 mg $cm^{-2}$.

(f) Electrochemical Measurement

All electrochemical measurements were performed using a potentiostat (Autolab PGSTAT302N) connected to a current booster (Metrohm Autolab, 10 A). The $CO_2R$ performance was evaluated in galvanostatic modes using either a three-electrode (flow cell) or a two-electrode setup (full cell). Electrochemical measurements acquired in a flow cell assembly varied from −0.4 $Acm^{-2}$ to −1.2 $Acm^{-2}$. Full cell measurements were recorded under a constant current of −0.6 $Acm^{-2}$. In all acidic $CO_2R$ measurements, a cathodic potential was applied before the catholyte was placed in contact with the working electrode. This was to avoid premature dissolution of the Cu-based catalyst by strong acid. To evaluate the ability of N-heterocycles to suppress hydrogen evolution, potentiostatic experiments were carried out in a three-electrode flow cell setup. The $CO_2$ flow was replaced by a N2 flow and the electrode potential was held at −2 V vs. Ag/AgCl for 10 min before switching the molecule-free catholyte with one that includes 0.25 mM of N-heterocycles.

(g) In Situ Raman Spectroscopy

A custom-made cell was used to carry out in situ Raman spectroscopy. In an epi-illumination configuration, a 785 nm laser was used as the excitation source. The laser power was kept lower than 0.20 mW in all experiments to minimize sample damage. The scattered Raman light was collected by a water immersion objective (Leica, 63×, NA 0.9). Raman spectrometer calibration was done with the Si peak. In all in situ Raman experiments, the 2.5 M KCl in the catholyte was replaced by 0.6 M $K_2SO_4$. This was to avoid chlorine evolution at the platinum counter electrode. Cu catalysts were used in the in situ Raman experiment.

(h) $CO_2R$ Reaction Product Analysis

The gas-phase products were collected using gas-tight syringes and analyzed with gas chromatography (GC, Shimadzu, GC-2014). The gas chromatograph was equipped with a thermal conductivity detector (TCD) for the detection of $H_2$, $O_2$, $N_2$, and CO, and a flame ionization detector (FID) for the detection of $CH_4$ and $C_2H_4$. Helium (Linde, 99.999%) was used as the carrier gas. For quantification, 1 mL of gas sample was injected into the GC, and the FE is calculated using Equation 3:

$$FE\,(\%) = \frac{nFvr}{iV_m} \tag{3}$$

where n is the number of electrons transferred, F is the Faraday constant, ν is the $CO_2$ flow rate, r is the concentration of the gas product in parts per million (ppm), i is the total current and $V_m$ is the unit molar volume of gas. To accurately measure the concentration of $H_2$, the gas and the catholyte compartment outlets were connected to an air-tight glass container. Gas samples were taken from the exhaust port of this glass container. This was necessary to account for the $H_2$ gas leaving through the $CO_2$ side (via the gas diffusion layer) and the liquid side (via the catholyte flow).

The liquid products were analyzed using proton nuclear magnetic resonance ($^1H$ NMR) spectroscopy (600 MHZ, Agilent DD2 NMR Spectrometer) with water suppression. Dimethyl sulfoxide (DMSO) was used as the internal reference and deuterium oxide ($D_2O$) as the lock solvent. The FE of liquid product is calculated using Equation 4:

$$FE\,(\%) = \frac{nFm_{product}}{Q} \tag{4}$$

where n is the number of electrons transferred, F is the Faraday constant, $m_{product}$ is the total moles of products, and Q, measured in coulomb is the total charge passed during the electrolysis experiment.

The energy efficiency (EE) for the formation of $C_2H_4$ is calculated using Equation 5:

$$EE\,(\%) = \frac{FE_{C_2H_4} * (E_a^o - E_c^o)}{V_{full}} \tag{5}$$

where $FE_{C_2H_4}$ denotes the FE of $C_2H_4$, $$E_a^o$$

and $$E_c^o$$

are the equilibrium potentials for the anode and cathode ($CO_2$—$C_2H_4$) reactions and $V_{full}$ is the volume, respectively.

The single-pass utilization (SPU) of $CO_2$ for a particular product is determined using Equation 6:

$$SPU = \frac{60\,s * \frac{j}{nF}}{v\,(L/min) * 1(min)/24.05\left(\frac{L}{mol}\right)} \tag{6}$$

where j is the partial current density of a specific product, n is the number of electrons transferred for every molecule of the product, F is the Faraday constant, and ν is the $CO_2$ flow rate.

(i) Energy Assessment

The energy assessment of the acidic $CO_2R$ system was carried out using a techno-economic model (TEA) similar to the one implemented in previous work. 35 Since the main product is $C_2H_4$, the TEA model considered $C_2H_4$ as a basis for comparison. To calculate the energy consumption in $C_2H_4$ production from $CO_2$, the model used performance metrics such as FE, current density, full-cell potential, and SPU. The energy intensity for $C_2H_4$ production is outlined in Tables 1 to 3. The model considered a $C_2H_4$ production capacity of 1 tonne per day. The model considered hydrogen as the side product from HER at the cathode product stream. A pressure swing adsorption (PSA) gas separation unit was modeled downstream of the cathode products to separate $C_2H_4$ from unreacted $CO_2$ and hydrogen. The unreacted $CO_2$ was assumed to be recirculated to the cathode inlet of the electrolyzer. Oxygen was considered the only product from the oxygen evolution reaction at the anode product stream. An electrolyte requirement of 100 L per $m^2$ of electrolyzer area was considered. This consideration was based on lab-scale $CO_2RR$ electrolyzers, and the electrolyte cost was reduced to daily cost to reflect it on the production energy intensity of $C_2H_4$. The model considered various components, namely, the electrolyzer, the catalyst, the membrane, the balance of plant, the installation, the feedstock, the electricity, and the cathode separation. The model also considered an extra 10% of electricity energy cost for maintenance during plant operation. Step-by-step calculations of producing $C_2H_4$ from $CO_2$ in acidic $CO_2R$ and model assumptions were provided in previous work.[35] The energy intensity of producing $C_2H_4$ from $CO_2$ was built on these cost evaluations and was calculated stopping prior to multiplying by the electricity price.

TABLE 1

Flow rate-dependent energy intensity of producing $C_2H_4$

| Parameters | 40 sccm | 20 sccm | 10 sccm | 5 sccm | 2 sccm |
|---|---|---|---|---|---|
| Cell voltage (V) | 4.2 | 4.2 | 4.2 | 4.2 | 4.2 |
| Faradaic efficiency (%) | 55.1 | 53.9 | 48.4 | 44.2 | 43.4 |
| Current density (mA $cm^{-2}$) | 1100 | 1100 | 1000 | 900 | 900 |
| $C_2H_4$ Single pass conversion (%) | 2.8 | 5.3 | 9.6 | 17.6 | 43.3 |
| Electrolyzer specific energy distribution (GJ/(tonne $C_2H_4)^{-1}$) | | | | | |
| Electrolyzer electricity | 315.2 | 322.2 | 358.8 | 392.9 | 400.2 |
| Cathode separation | 59.1 | 32.9 | 20.6 | 14.1 | 8.9 |
| Anode separation (Carbonate) | 0.0 | 0.0 | 0.0 | 0.0 | 0.0 |
| Carbonate regeneration | 0.0 | 0.0 | 0.0 | 0.0 | 0.0 |
| Overall energy | 374.3 | 355.1 | 379.4 | 407.0 | 409.1 |

TABLE 2

High energy efficiency conditions (50 sccm for the Science reference and 40 sccm)

| Parameters | Current best[36] | This work |
|---|---|---|
| Cell voltage (V) | 4.2 | 4.2 |
| Faradaic efficiency (%) | 28 | 55.1 |
| Current density (mA $cm^{-2}$) | 1200 | 1100 |
| $C_2H_4$ Single pass conversion (%) | 2.1 | 2.8 |
| Electrolyzer specific energy distribution (GJ/(tonne $C_2H_4)^{-1}$) | | |
| Electrolyzer electricity | 620.3 | 315.2 |
| Cathode separation | 86.2 | 59.1 |
| Anode separation (Carbonate) | 0.0 | 0.0 |
| Carbonate regeneration | 0.0 | 0.0 |
| Overall energy | 706.5 | 374.3 |

TABLE 3

High single-pass conversion efficiency conditions (3 sccm for the Science reference and 2 sccm)

| Parameters | Current best[36] | This work |
|---|---|---|
| Cell voltage (V) | 4.2 | 4.2 |
| Faradaic efficiency (%) | 26 | 43.4 |
| Current density (mA $cm^{-2}$) | 1200 | 900 |
| $C_2H_4$ Single pass conversion (%) | 26.4 | 43.3 |

TABLE 3-continued

High single-pass conversion efficiency conditions (3 sccm for the Science reference and 2 sccm)

| Parameters | Current best[36] | This work |
|---|---|---|
| Electrolyzer specific energy distribution (GJ/(tonne $C_2H_4)^{-1}$) | | |
| Electrolyzer electricity | 620.3 | 400.2 |
| Cathode separation | 28.8 | 8.9 |
| Anode separation (Carbonate) | 0.0 | 0.0 |
| Carbonate regeneration | 0.0 | 0.0 |
| Overall energy | 649.1 | 409.1 |

(1) DFT Calculations

All spin-polarized density functional theory (DFT) calculations were performed using the Vienna Ab initio Simulation Package (VASP). The projector augmented-wave method (PAW) was employed with a cut-off energy of 400 eV. The DFT calculations were performed using general gradient approximation (GGA) applying Perdew-Burke-Ernzerhof (PBE) as the exchange-correlation functional. All periodic (5×5) models had four atomic layers with a vacuum space of 15 Å along the z-axis. The two layers at the bottom were fixed to mimic the bulk of the metal Cu and other atoms were relaxed to mimic the Cu surface. The Cu(100) surface was selected to calculate the adsorption energy of N-heterocycles because Cu(100) has been reported to be highly active for $C_2H_4$ formation. The k-point grid was set to (2×2×1). For structural optimization, the electronic self-consistent energy and force were converged to $10^{-6}$ eV and 0.03 eV/Å. To determine the relative adsorption strength and stability of adsorbents on the Cu surface, different adsorption configurations were tested. The adsorption energy is defined in Equation 7:

$$E_{ads} = E_{mol/Cu} - E_{mol} - E_{Cu} \tag{7}$$

(k) Raman Calculation

Raman calculations were performed with the Amsterdam Density Functional (ADF) computational chemistry package.[7] Full geometry optimization, vibrational modes, and Raman intensity calculations were completed using Becke-Perdew (BP86) generalized gradient approximation (GGA) exchange correlation functional and a triple-ζ polarized (TZP) Slater orbital basis set with zeroth order regular approximation (ZORA). For the ground-state geometry optimization, the energy difference tolerance was set to be $10^{-5}$ Hartree and nuclear gradient tolerance $10^{-4}$ Hartree/Å. For molecules interacting with the electrode, the surface was modeled as a tetrahedral metal cluster, with the adsorbed molecule adsorbed on the tip of the tetrahedron.

The calculated Raman scattering intensity is determined by the following Equation 8:[38]

$$\frac{d\sigma}{d\Omega} = \frac{h}{8\epsilon_0^2 c\tilde{\upsilon}_p}(\tilde{\upsilon}_{in} - \tilde{\upsilon}_p)^4\left(45\bar{\alpha}_p'^2 + 7\bar{\gamma}_p'^2\right)\frac{1}{45\left[1 - \exp\left(-hc\tilde{\upsilon}_p/k_B T\right)\right]} \tag{8}$$

where $\tilde{\nu}_{in}$ is the frequency of the excitation laser, and $\tilde{\nu}p$ is the frequency of $p^{th}$ vibrational mode of the calculated structure. $\bar{\alpha}'_p$ and $\bar{\Gamma}'_p$ represent the isotropic and anisotropic polarizability tensors of the $p^{th}$ vibrational mode, respectively.

The Raman lineshapes of each vibrational mode were calculated using Equation 8 at the excitation wavelength of 785 nm and 298 K with a Lorentzian broadening full width at half maximum (FWHM) of 15 $cm^{-1}$.

Example 2: Results and Discussion

Figure 2:
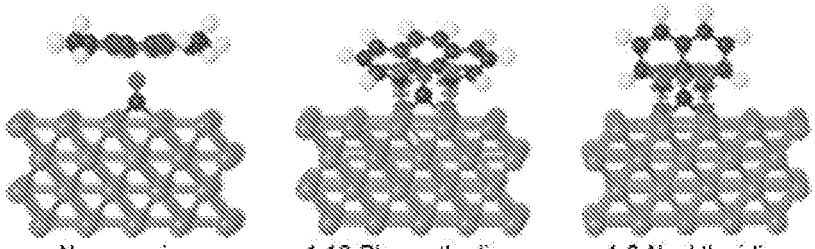
FIG. 2 presents the co-adsorption of CO and neocuproine (Neo), 1,10-phenanthroline (1,10-Phen) and 1,8-naphthyridine (1,8-Naph) on Cu(100), as described in Example 2.
Figure 3:
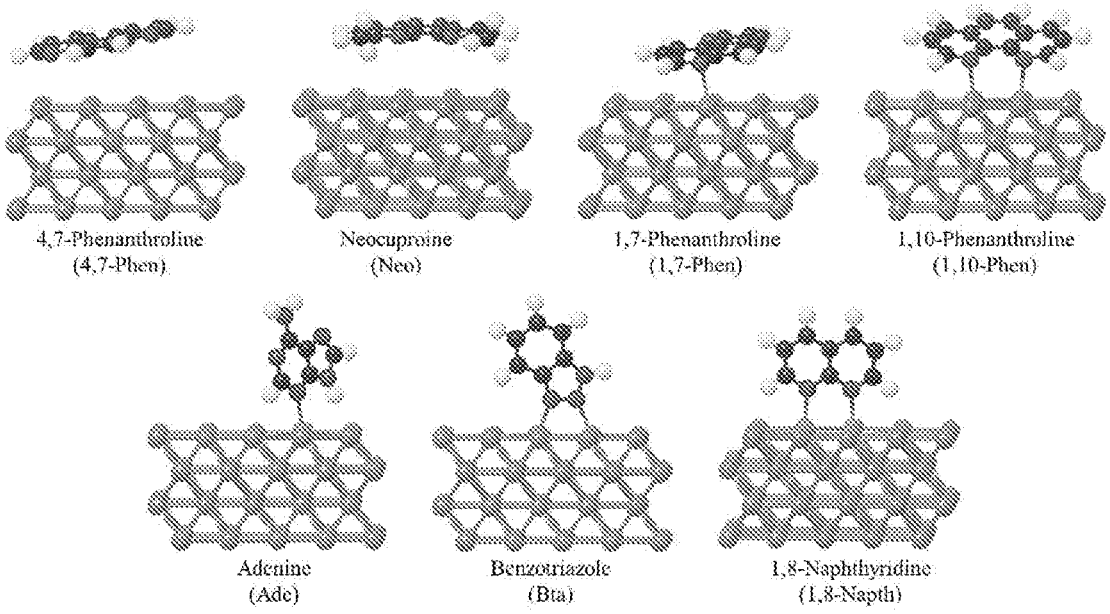
FIG. 3 presents the optimized adsorption structure of 4,7-phenanthroline (4,7-Phen), Neo, 1,7-phenanthroline (1,7-Phen), 1,10-Phen, adenine (Ade), benzotriazole (Bta) and 1,8-Naph on Cu(100), as described in Example 2.
Figure 4:
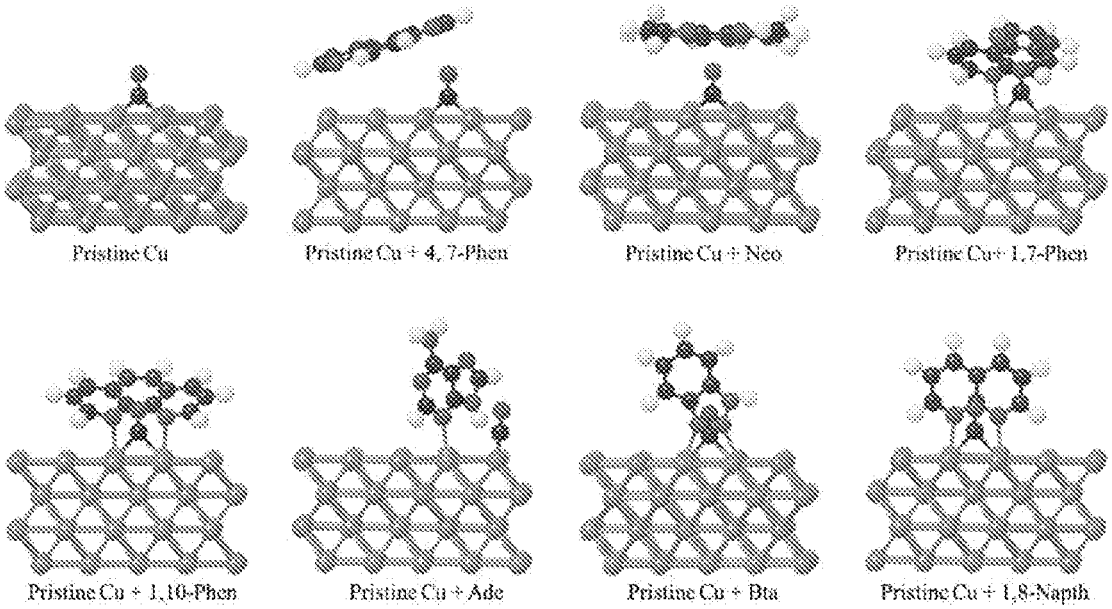
FIG. 4 presents the optimized adsorption geometry of CO on Cu(100) with and without 4,7-Phen, Neo, 1,7-Phen, 1,10-Phen, Ade, Bta and 1,8-Naph, as described in Example 2.
Figure 5:
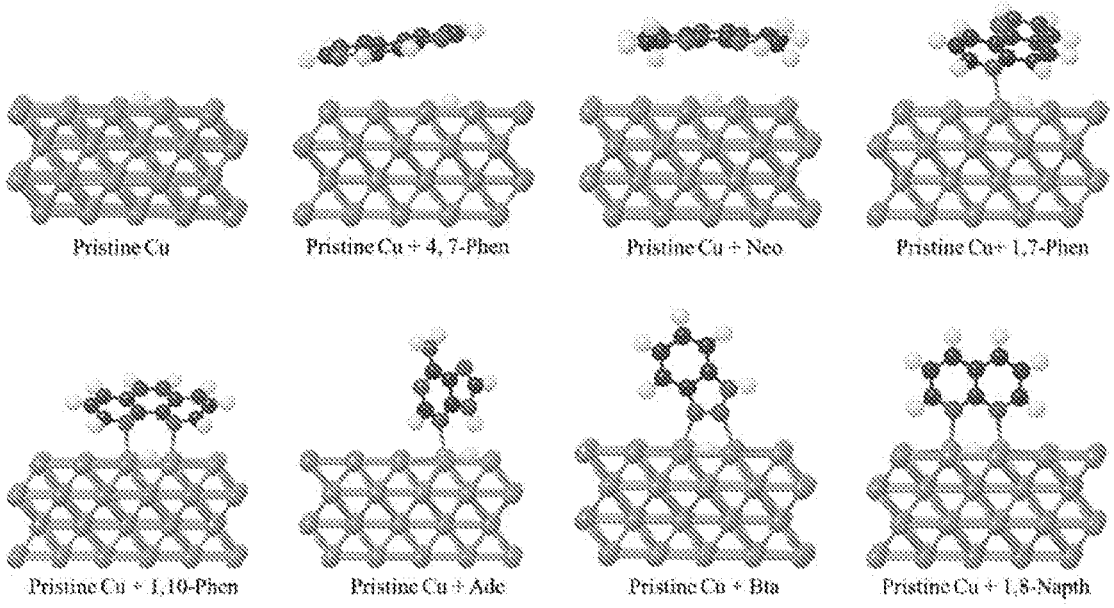
FIG. 5 presents the optimized adsorption geometry of H on Cu(100) with and without 4,7-Phen, Neo, 1,7-Phen, 1,10-Phen, Ade, Bta and 1,8-Naph, as described in Example 2.

The density functional theory (DFT) calculations was applied to investigate the influence of N-heterocycles on the adsorption of H and CO on the Cu(100) surface (FIGS. 2 to 5). The DFT calculations were focused on the Cu(100) surface based on empirical evidence of Cu(100) formation under $CO_2R$ conditions[39-40], and its high activity for the C—C coupling reaction[11, 41-33]. The initial N-heterocycles investigated were neocuproine (Neo), 1,10-phenanthroline (1,10-Phen), and 1,8-naphthyridine (1,8-Naph) (FIG. 2). These N-heterocycles contain pyridinic nitrogen groups that are known to interact with Cu,[44] and prior reports have demonstrated that N-containing organic molecules and polymers can influence the selectivity of $CO_2R$[21, 45]. The DFT calculations revealed no obvious change in the adsorption energy of CO ($E_{ad,CO}$) with and without co-adsorbed N-heterocycles due to limited interactions between the surface species (FIG. 2, Table 4).

TABLE 4

Calculated adsorption energies of CO and H on pristine Cu and Cu with co-adsorbed N-heterocycles

| Molecules | $E_{ads,\ CO}$ (eV) | $E_{ads,\ H}$ (eV) |
|---|---|---|
| Pristine Cu | −0.86 | −0.17 |
| Pristine Cu + 4,7-phenanthroline (4,7-Phen) | −0.82 | −0.15 |
| Pristine Cu + neocuproine (Neo) | −0.74 | −0.14 |
| Pristine Cu + 1,7-phenanthroline (1,7-Phen) | −0.85 | −0.15 |
| Pristine Cu + 1,10-phenanthroline (1,10-Phen) | −0.85 | −0.07 |
| Pristine Cu + adenine (Ade) | −0.85 | −0.09 |
| Pristine Cu + benzotriazole (Bta) | −0.84 | −0.02 |
| Pristine Cu + 1,8-naphthyridine (1,8-Naph) | −0.84 | −0.03 |

This precludes the direct (de) stabilization of CO on the surface of Cu by co-adsorbed N-heterocycles of different molecular structures. However, it was noticed that, when the position of the N functional groups was changed or made methyl substitutions, the charge exchange between adsorbates and the Cu surface was significantly influenced, producing very different adsorption energies for the N-heterocycles, while $E_{ad,co}$ remains unchanged. A decrease in the adsorption energy of H ($E_{ad,H}$) was also observed when molecules having greater $E_{ad,mol}$ were deployed. The DFT calculations results suggest the potential to modulate $H_{ad}$ and $CO_{ad}$ on the Cu surface.

Figure 6:
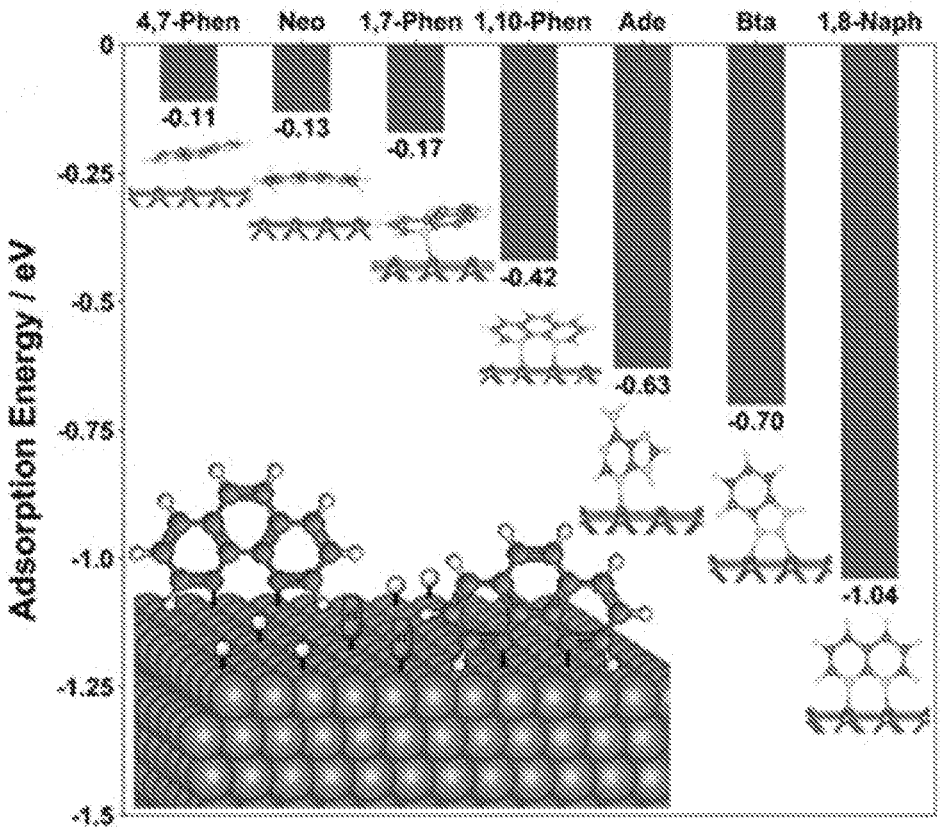
FIG. 6 presents the adsorption configuration and energy of 4,7-Phen, Neo, 1,7-Phen, 1,10-Phen, Ade, Bta and 1,8-Naph on Cu(100), as described in Example 2. The inset is a schematic representation of the co-adsorption of H, CO, and N-heterocycles.
Figure 7:
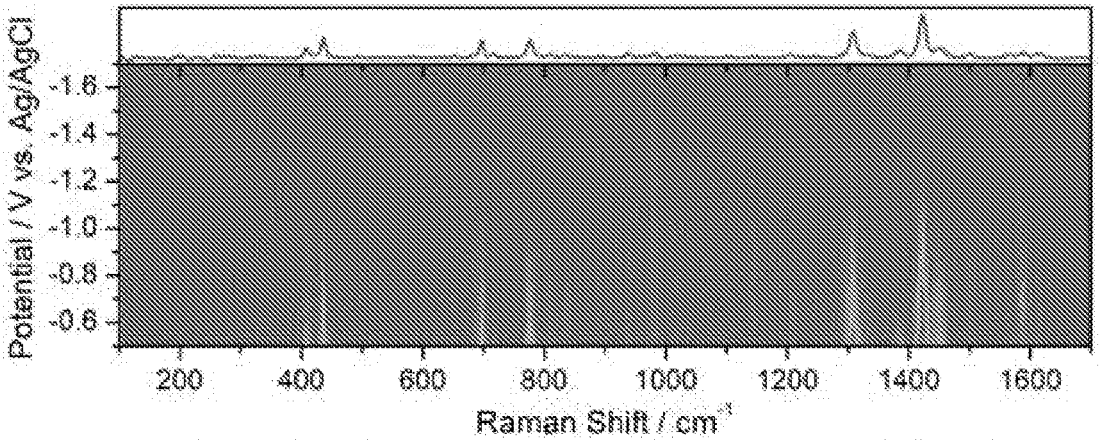
FIG. 7 is a potential dependent in situ surface-enhanced Raman spectroscopy (SERS) plot of Neo, as described in Example 2.
Figure 8:
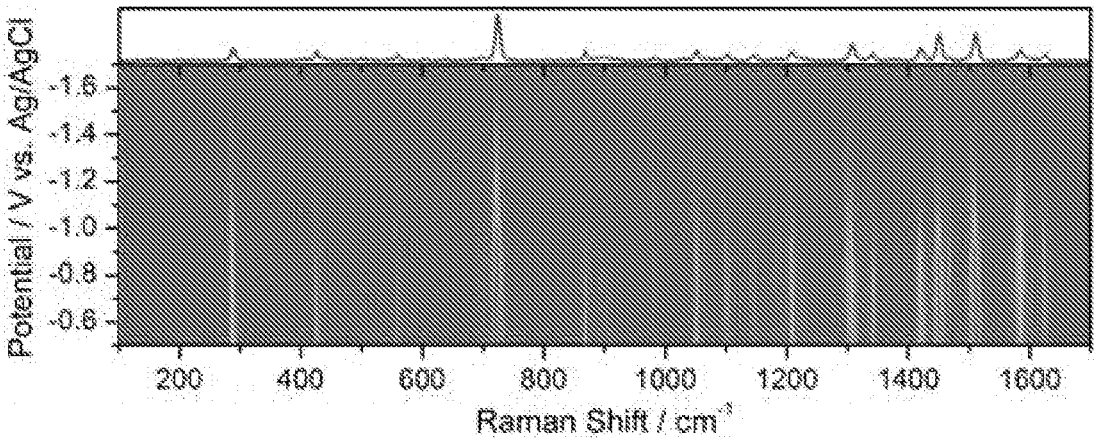
FIG. 8 is a potential dependent in situ SERS plot of 1,10-Phen, as described in Example 2.
Figure 9:
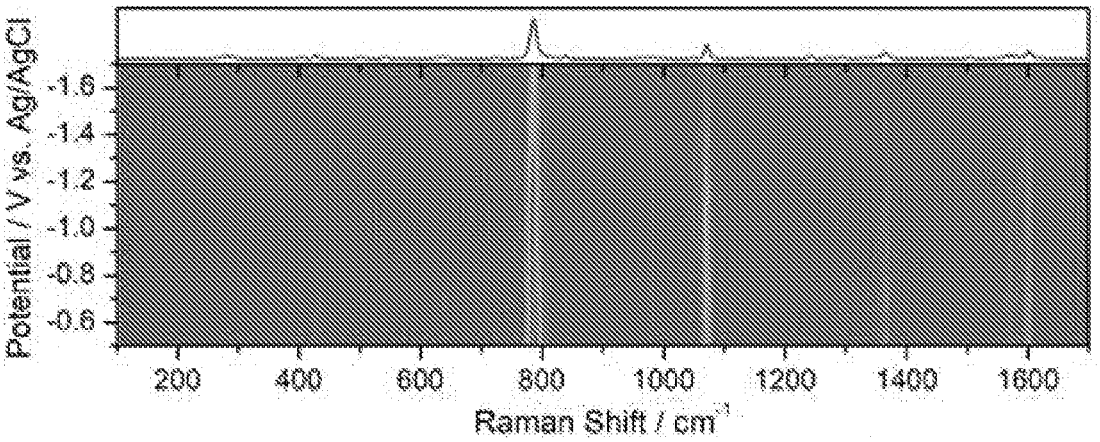
FIG. 9 is a potential dependent in situ SERS plot of 1,8-Naph, as described in Example 2.
Figure 10:
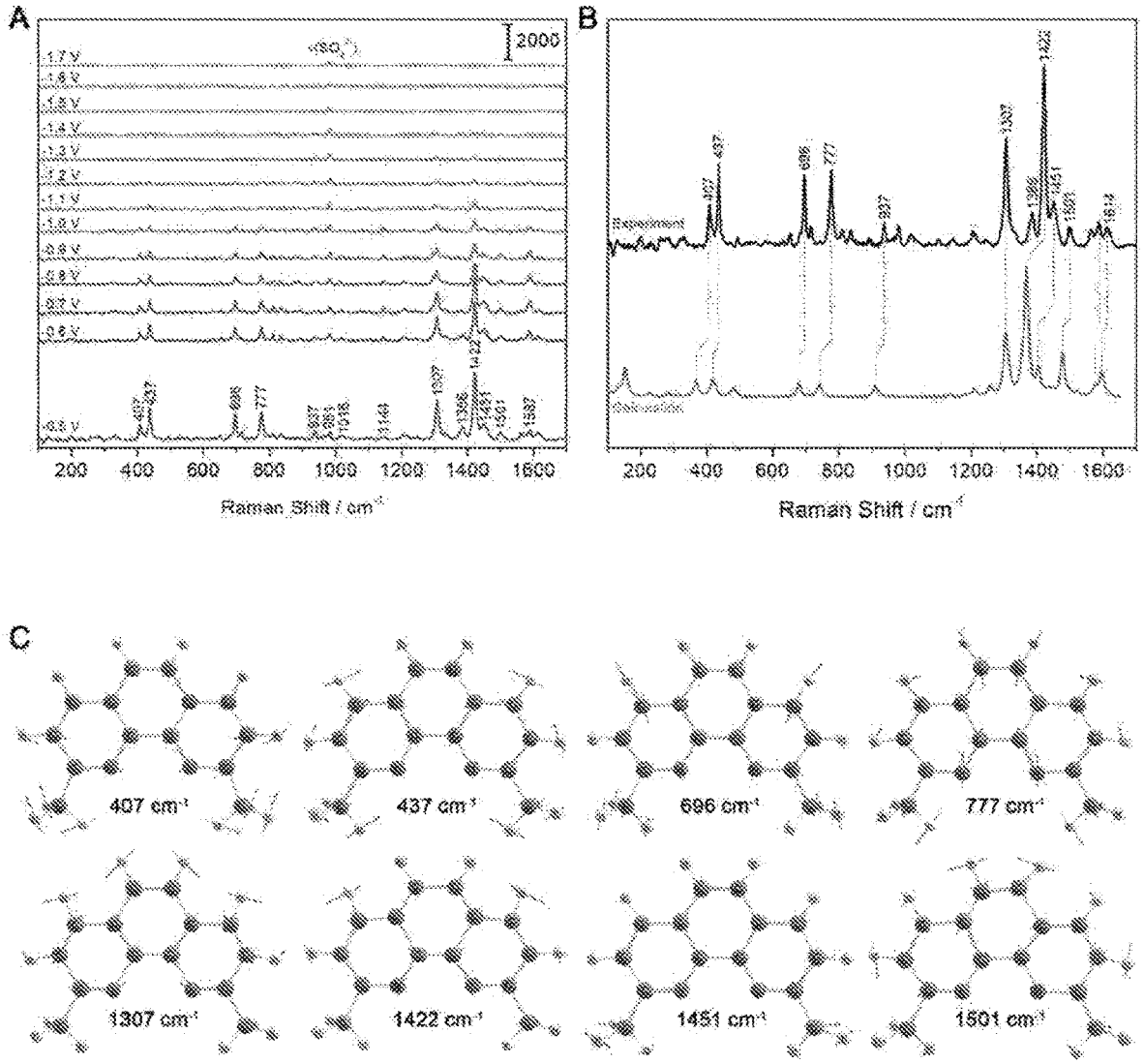
FIG. 10 presents in (A) potential dependent SERS spectrum of Neo; in (B) a comparison of the experimental and calculated SERS spectrum of Neo; and in (C) the dominant vibrational modes of Neo, as described in Example 2. The concentration of Neo is 0.25 mM.

A wider set of N-heterocycles having adsorption energies $E_{ad,mol}$ ranging from −0.11 eV to −1.04 eV was then explored, the wider set fully extending across the range of $E_{ad,H}$ and $E_{ad,CO}$ (FIG. 6). The adsorption strength on Cu catalysts were studied with the aid of surface-enhanced Raman spectroscopy (SERS). FIGS. 7 to 9 present potential dependent in situ SERS results obtained for Neo, 1,10-Phen, and 1,8-Naph, respectively. It was found that the N-heterocycles with greater DFT-predicted $E_{ad,mol}$ remain at the surface under higher negative applied potentials (see also FIG. 10 for controls)[46].

The relatively constant intensity of the $v(SO_4^{2-})$ from the electrolyte compared to the intensity of Neo confirm the desorption of this molecule (FIG. 10(A)). The in situ SERS of Neo are in good agreement with the previously reported SERS spectrum of Neo on Ag.[47] The in situ SERS spectrum of Neo shows a blueshift compared to the calculated spectrum. This can be related to the underestimation of the normal mode frequency in Raman calculation. Nonetheless, dominant vibrational features can be identified using the calculated spectrum and prior results (FIG. 10(C)). The intense vibrational peaks can involve the stretching, bending, scissoring, and wagging of the substituted methyl ($CH_3$) groups at the 2 and 9 positions. This suggests the proximity of the $CH_3$ groups to the Cu surface. Under such adsorption configuration, the formation of a Cu—N bond that would result in strong adsorption could significantly distort the molecule, and thus not favored.

Figure 11:
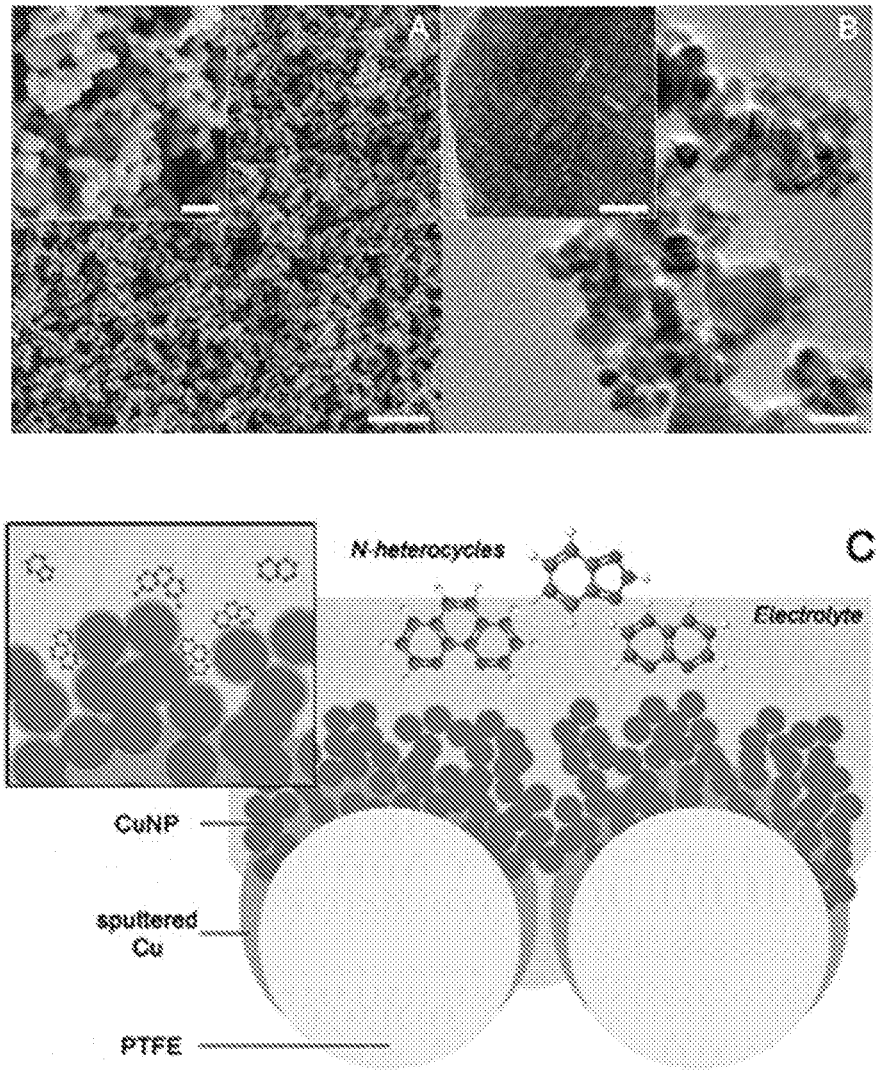
FIG. 11(A) shows scanning electron micrographs of copper nanoparticles (CuNPs) air-brushed onto a Cu-deposited polytetrafluoroethylene (PTFE) gas diffusion layer, as described in Example 2. The scale bars correspond to 1 μm and 100 nm in the main image and inset, respectively.
FIG. 11(B) shows transmission electron micrographs of CuNPs, as described in Example 2. The scale bars correspond to 25 and 5 nm in the main image and inset, respectively. The pairs of white lines indicate the lattice spacing of the Cu(100) crystal planes.
FIG. 11(C) is a schematic representation of a CuNPs-based electrode, which consists of CuNPs air-brushed onto a 200 nm layer of sputtered Cu coated on a PTFE GDL. The inset is a schematic representation of a direct addition of molecules into an electrolyte.
Figure 12:
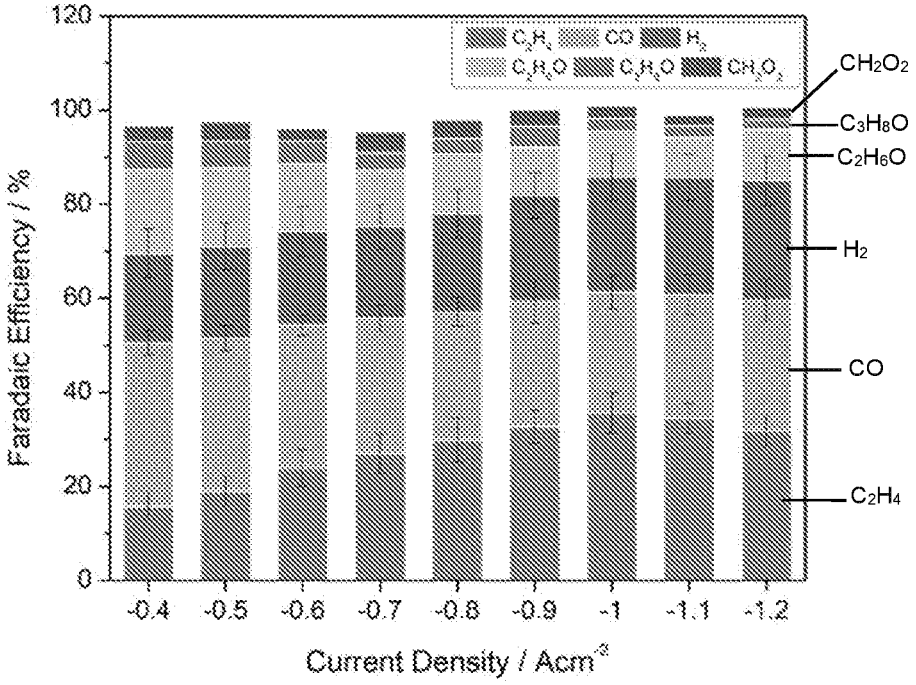
FIG. 12 is a bar graph showing the product distributions of acidic $CO_2R$ using CuNPs catalysts without N-heterocycles, as described in Example 2. The catholyte was 2.5 M potassium chloride (KCl) in 0.05 M sulfuric acid ($H_2SO_4$), and the anolyte was 0.05 M $H_2SO_4$. The $CO_2$ flow rate was 40 standard cubic centimeters per minute (sccm). Error bars represent the standard deviation of three measurements from different electrodes.
Figure 13:
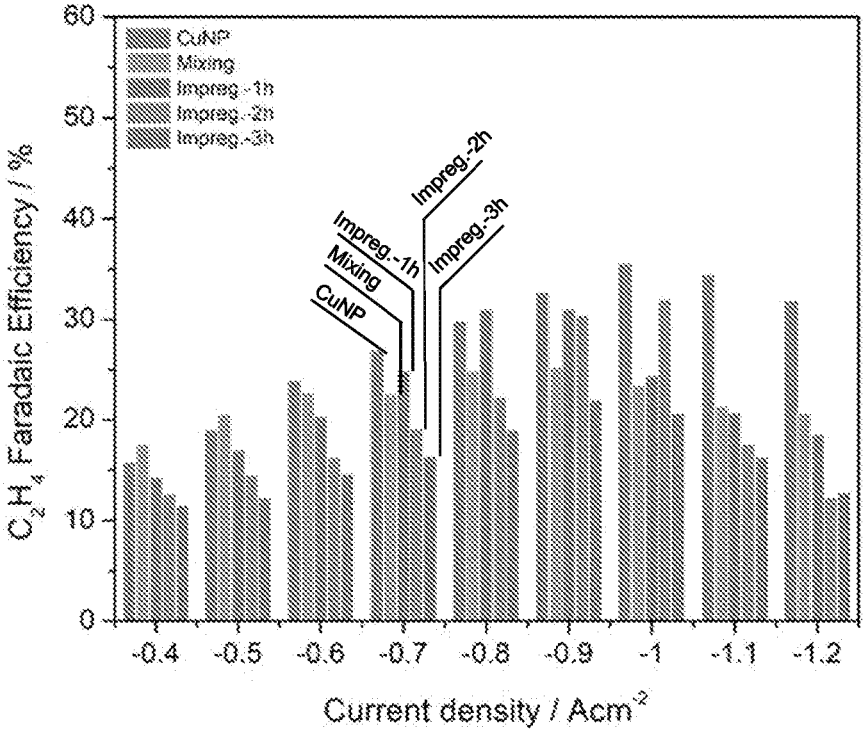
FIG. 13 is a bar graph showing the comparisons among the $FE_{C_2H_4}$, of CuNPs catalysts with and without N-heterocycle modification at different impregnation times, as described in Example 2. The catholyte was 2.5 M KCl in 0.05 M $H_2SO_4$, and the anolyte was 0.05 M $H_2SO_4$. The $CO_2$ flow rate was 40 sccm.

In the initial experimental assessment of N-heterocycles, these molecules were physically mixed with CuNPs, FIG. 11 and FIG. 12), or pre-adsorbed on CuNPs before electrode preparation. Both strategies failed to create a substantially stable catalyst: N-heterocycle interface and were not able to substantially improve the $FE_{C2H4}$ compared to the baseline performance of CuNPs (FIG. 13). Direct anchoring of the N-heterocycles onto Cu was not attempted, as it might indiscriminately modify all copper sites, and run counter to the goal of suppressing HER but not C—C coupling. In the end, a facile yet effective approach was employed to create a catalyst: N-heterocycle interface by directly adding N-heterocycles into the electrolyte while using CuNPs as the $CO_2R$ catalysts (FIG. 11(C)).

As mentioned above, two strategies were employed to evaluate the influence of 1,10-Phen on the selectivity of acidic $CO_2R$. CuNPs and from about 1 mg to about 5 mg of 1,10-Phen were physically mixed to prepare a catalyst ink according to the steps outlined in Example 1 (b) (FIG. 13 uses 3 mg of 1,10-Phen). A second technique involves pre-adsorption of 1,10-Phen on CuNPs before the preparation of electrodes. CuNPs were dispersed and incubated in a methanol solution containing 5 mM of 1,10-Phen for from about 1 hour to about 3 hours. The catalysts were collected by centrifugation at 5 000 rpm then rinse and dried with methanol prior to electrode preparation following the steps outlined in the Example 1 (b).

Figure 14:
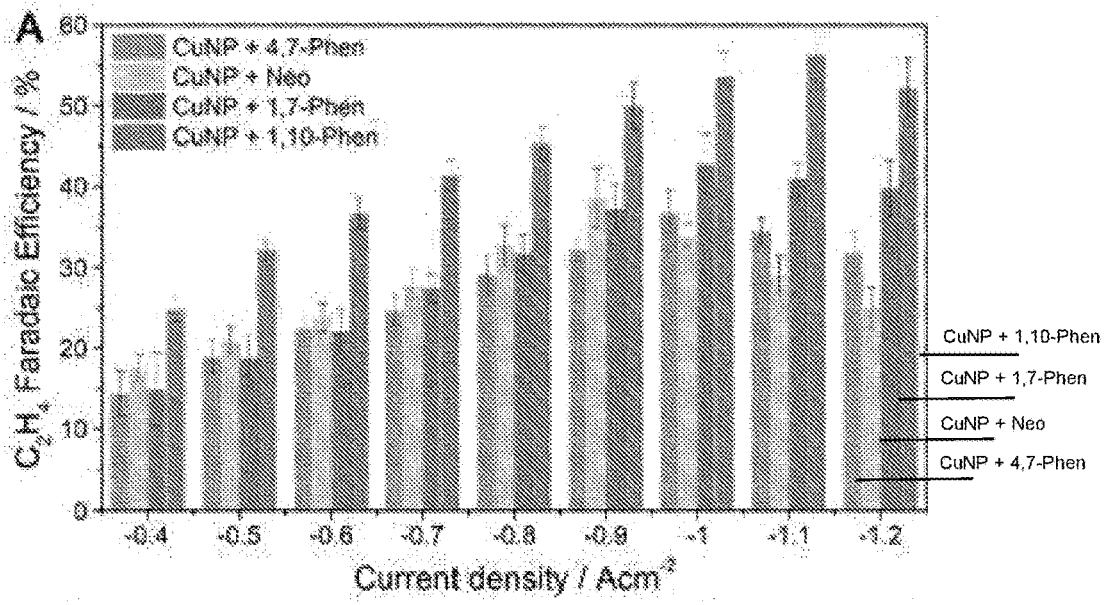
FIG. 14(A) is a bar graph showing the comparisons among the $FE_{C_2H_4}$ of CuNPs catalysts with different phenanthroline-based N-heterocycles, as described in Example 2.
FIG. 14(B) is a bar graph showing the dependence of the $FE_{C_2H_4}$ on the concentration of 1,10-Phen, as described in Example 2.
FIG. 14(C) is a bar graph showing the comparisons between the FECHA of 1,10-Phen and $CuCl_2$-Phen, as described in Example 2.
FIG. 14(D) shows the Raman spectrum of 1,10-Phen in solid-state form (black), under applied potentials (red, and blue), and $CuCl_2$-Phen in solid-state form (green), as described in Example 2. The in situ Raman spectra were acquired under −0.8 V and −1.0 V vs. Ag/AgCl, and are scaled for better presentation.
FIG. 14(E) shows the low wavenumber regions of the Raman spectra in FIG. 14(D), as described in Example 2. The arrows represent the atomic displacement vectors corresponding to the 249/287 $cm^{-1}$ vibrational mode.
FIG. 14(F) is a bar graph showing the comparisons between the $FE_{C_2H_4}$ of CuNPs catalysts with Ade, Bta, and 1,8-Naph, as described in Example 2.
FIG. 14(G) is a graph of the $H_2$ and CO FE of CuNPs catalysts with and with N-heterocycles, as described in Example 2. The $CO_2$ flow rate was 40 sccm in all experiments. Error bars represent the standard deviation of measurements acquired with three different electrodes.
Figure 14:
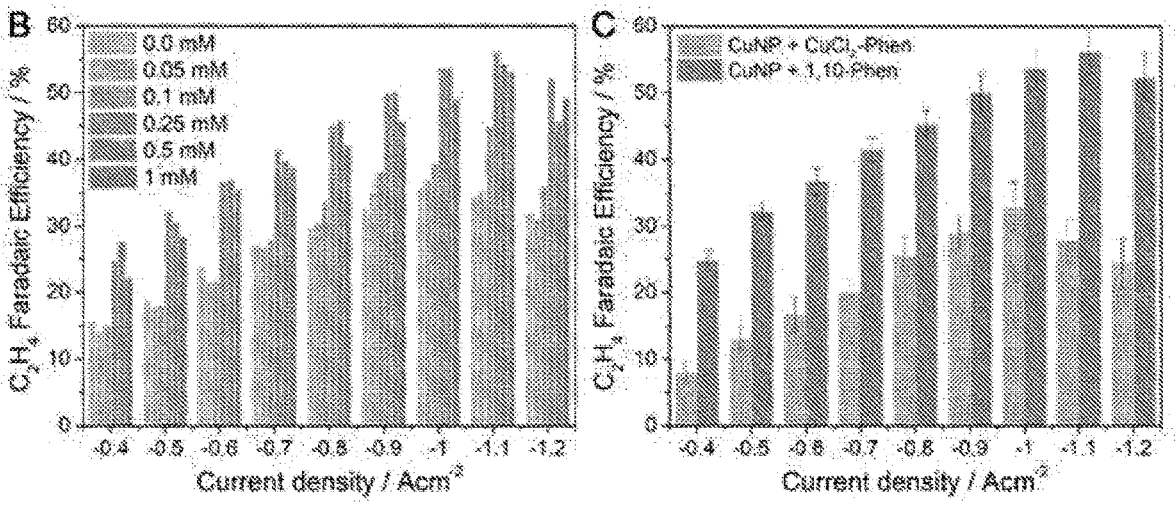
Figure 14:
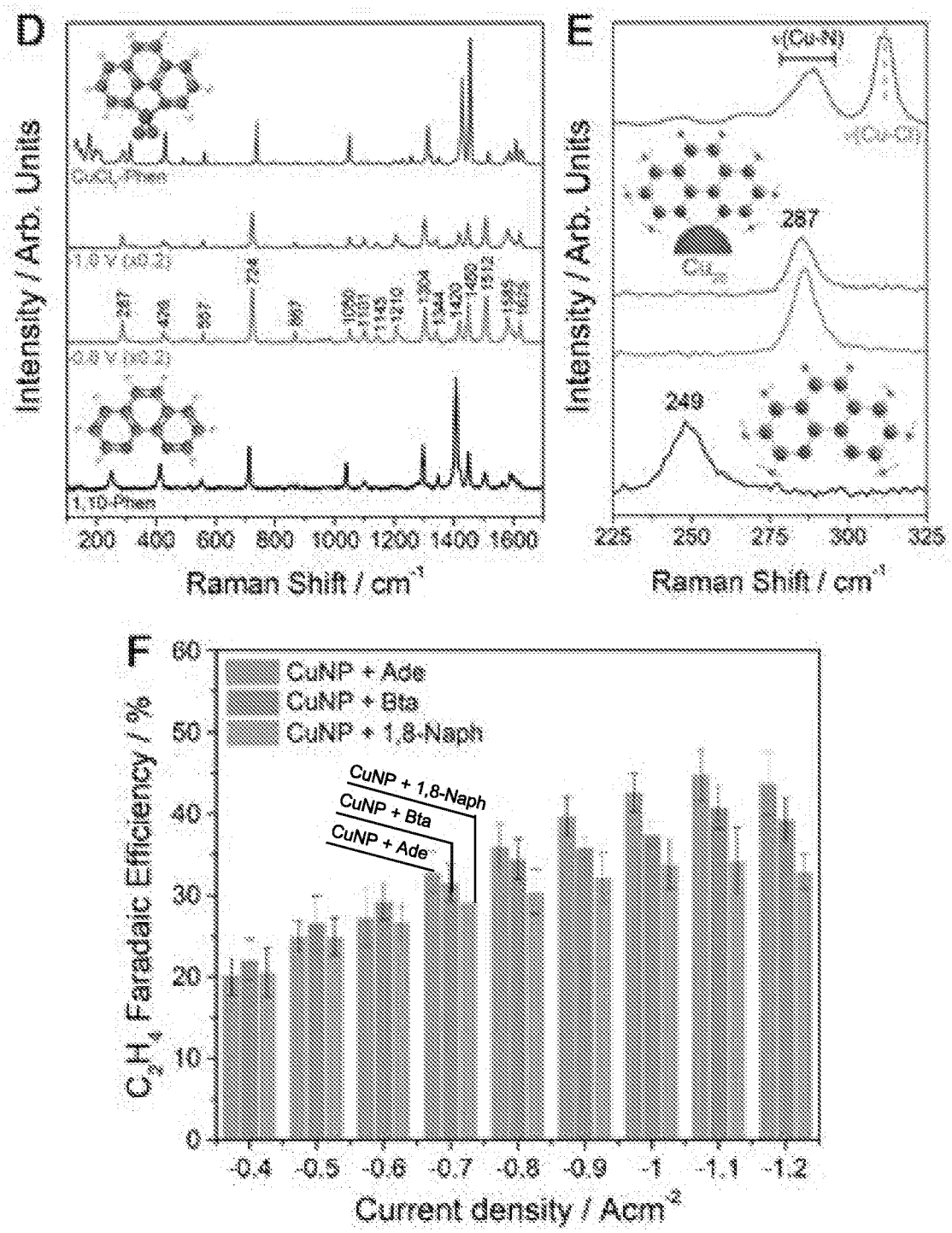
Figure 14:
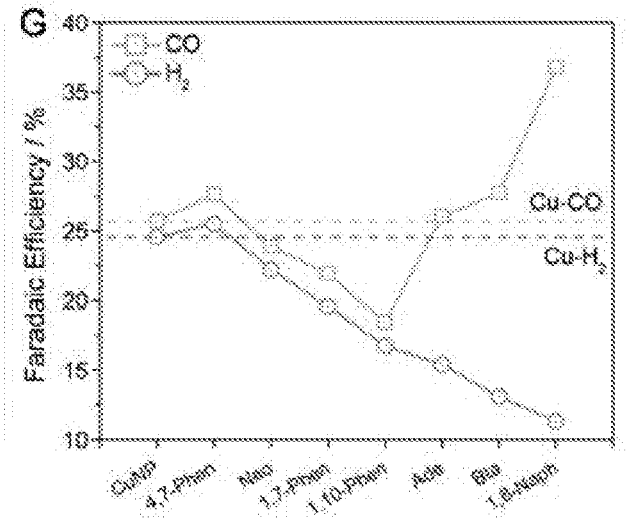
Figure 15:
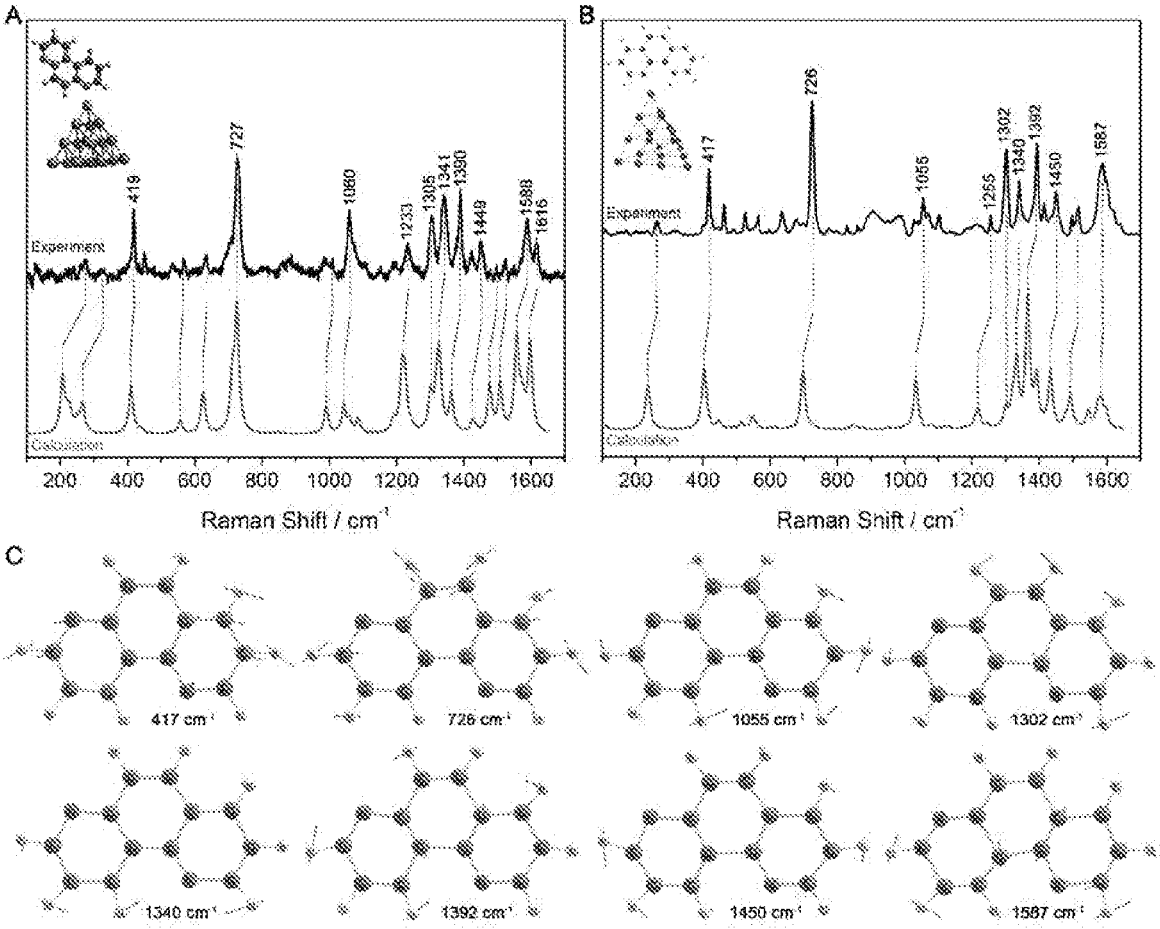
FIG. 15 presents in (A) in situ and calculated SERS spectra of 4,7-Phen; in (B) in situ and calculated SERS spectra of 1,7-Phen, the inset shows the adsorption model used in the Raman calculation represented by the adsorption of N-heterocycles on the apex of a tetragonal metal cluster; and in (C) the dominant vibrational modes of 1,7-Phen, as described in Example 2. These modes are selected for representation due to their prominence in the SERS spectra of 4,7-Phen. The concentration of 4,7-Phen and 1,7-Phen is 0.25 mM.
Figure 16:
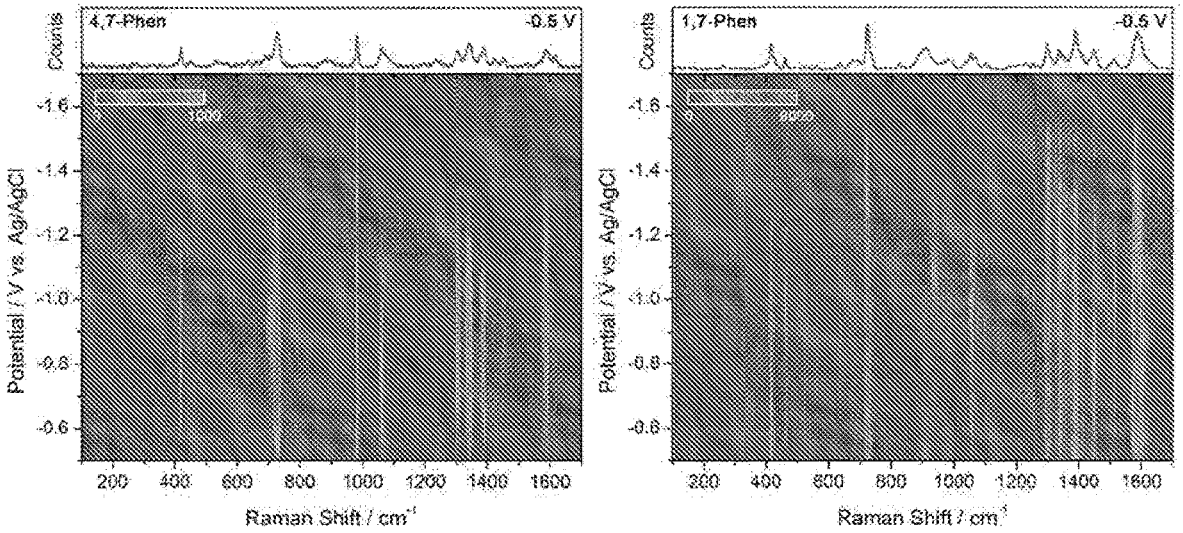
FIG. 16 shows potential dependent in situ SERS plots in (A) of 4,7-Phen; and in (B) of 1,7-Phen, as described in Example 2. The concentration of 4,7- and 1,7-Phen is 0.25 mM.

The product distributions in acidic $CO_2R$ (pH ~1.23) on CuNPs as a function of N-heterocycle was explored. In the case of Neo, 4,7-Phen, and 1,7-Phen, higher $E_{ad,mol}$ resulted in an increase in $FE_{C2H4}$; however, the improvement is substantially modest relative to molecular-adsorbate-free controls (FIGS. 12 and 14(A)). No strong correlation between the structure of these N-heterocycles with the $FE_{C2H4}$, was observed, and in situ characterization showed that these molecules readily desorb from the Cu surface under high negative applied potentials, consistent with weak adsorption predicted using DFT (FIGS. 15 and 16).

Figure 17:
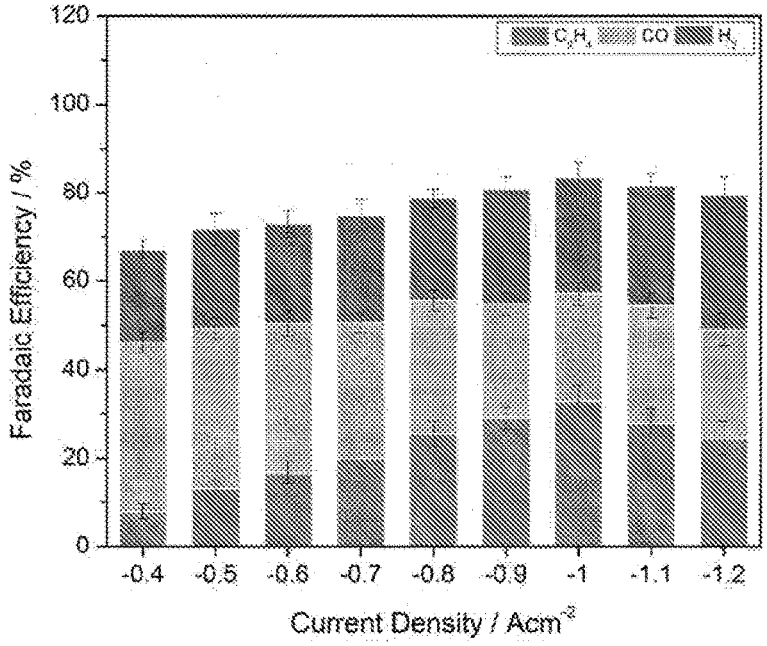
FIG. 17 is a bar graph showing gas-phase production distributions of acidic $CO_2R$ on a CuNPs catalyst with 0.25 mM of $CuCl_2$-Phen.
Figure 18:
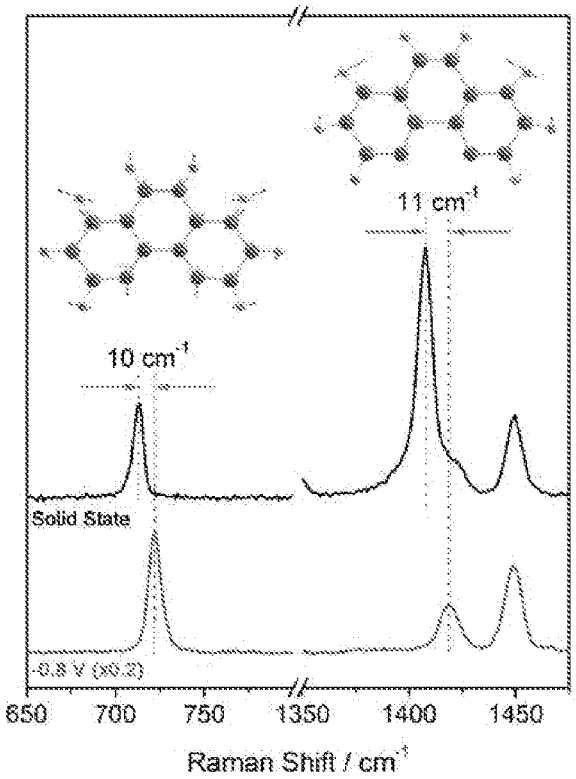
FIG. 18 the Raman spectra blue shifts of 1,10-Phen in the solid-state form and upon adsorption on Cu at −0.8 V vs. Ag/AgCl, as described in Example 2. The atomic displacements associated with the vibrational models are indicated by arrows.

$FE_{C2H4}$ in the presence of 1,10-Phen, an N-heterocycle with greater $E_{ad,mol}$ compared to other phenanthroline-based molecules, was then examined. A maximum $FE_{C2H4}$ of 55% upon the incorporation of 1,10-Phen in acidic $CO_2R$ was obtained. Through a concentration-dependent study, it was found that $FE_{C2H4}$ varied with the surface coverage of 1,10-Phen, rather than with the amount of dissolved 1,10-Phen (FIG. 14(B)). The possibility of homogeneous catalysis involving a 1,10-Phen-Cu complex was investigated. $CuCl_2$-Phen was introduced into the reaction, and no effect from $CuCl_2$-Phen was found on $FE_{C2H4}$, suggesting that 1,10-Phen enhances $C_2H_4$ formation in a heterogeneous reaction (FIGS. 14(C) and 17). When the Raman spectra of 1,10-Phen in solid-state form, under applied potentials, and complexed to Cu were compared (FIGS. 14(D), 14(E) and 18), a strong interaction between 1,10-Phen and Cu (large blueshift in the vibrational frequency of the in-plane-bending mode from 249 to 287 $cm^{-1}$) was found. These characterizations of 1,10-Phen suggest that it is the strong Cu-adsorbate interaction that favors $C_2H_4$ production.

The positive correlation between $FE_{C2H4}$ and $E_{ad,mol}$ motivated the study of Ade, Bta, and 1,8-Naph, each of which possesses greater $E_{ad,mol}$ than that of 1,10-Phen. $FE_{C2H4}$ decreased with increasing $E_{ad,mol}$. In the case of Ade and Bta, a greater $FE_{C2H4}$ compared to pure CuNPs was attained, whereas 1,8-Naph had similar $FE_{C2H4}$ to CuNPs (FIG. 14(F)).

The effect of the various N-heterocycles on the FE of $H_2$ and CO was also examined. The production of $H_2$ showed a continuous decrease with increasing $E_{ad,mol}$, whereas no systematic change in the FE of CO was observed (FIGS. 14(G) and 19 to 23). A minimum in the CO FE coincides with maximum $FE_{C2H4}$ as observed for 1,10-Phen, whereas N-heterocycles that demonstrated greater $FE_{C2H4}$, such as Bta, had similar or higher FE for CO compared to that of CuNPs.

In order to understand the impact of N-heterocycles on the selectivity of acidic $CO_2R$, CO and H adsorption were looked at jointly. In situ SERS allowed to probe adsorbed surface species and reaction intermediates during acidic $CO_2R$. The focus was put on CO coverage ($\theta_{CO}$) on the Cu catalyst as well as on the occupation of different surface sites by $CO_{ad}$. When Neo and 1,10-Phen were investigated, it was found that their v (Cu—CO) peak was in the same position, at 366 $cm^{-1}$,[48] which can be understood as meaning that their adsorption mainly affected $\theta_{CO}$ on the Cu surface, but not $E_{ad,CO}$. (FIG. 24(A)). The absence of the v(Cu—CO) peak upon the addition of 1,8-Naph can be explained via a reduced $\theta_{CO}$ at different adsorption sites, which from an analysis of the v(CO) peak: atop-bound CO ($CO_{top}$) was determined as the dominant surface species on the Cu surface with and without co-adsorbed N-heterocycles (FIGS. 24(B) and 25 to 28). The integrated area of the v(CO) peak was proportional to the $\theta_{CO}$ on Cu.[49-50] With the addition of Neo, 1,10-Phen, and 1,8-Naph, the integrated area of $CO_{top}$ decreased in the order of the increasing $E_{ad,mol}$ (FIGS. 24(C) and 29). This suggests that a lower $\theta_{CO}$ can be due to the partial coverage of the Cu surface by N-heterocycles, which reduces the number of available sites for CO adsorption (for a more detailed discussion, see Example 3).

Figure 25:
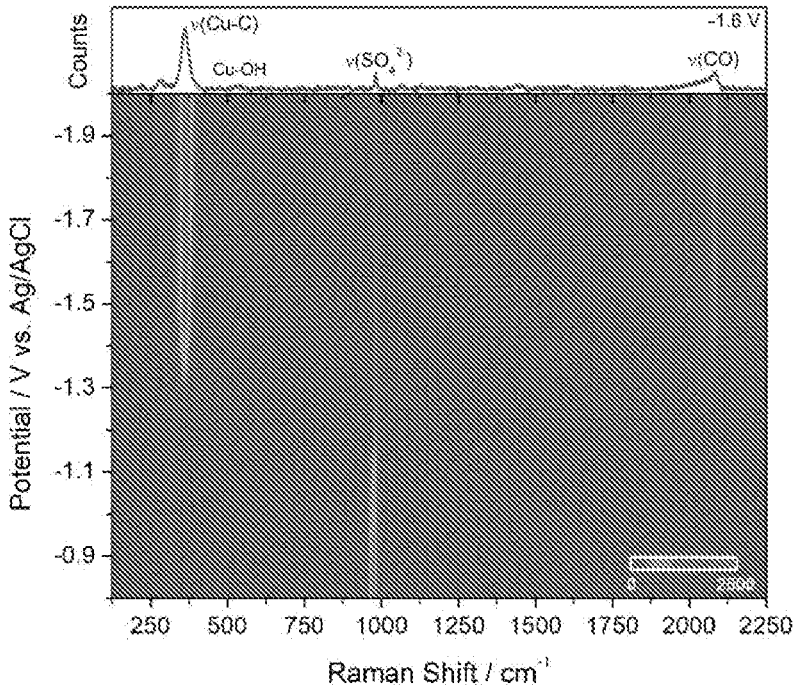
FIG. 25 is a potential dependent in situ SERS plot of Cu during acidic $CO_2R$, as described in Example 2.
Figure 26:
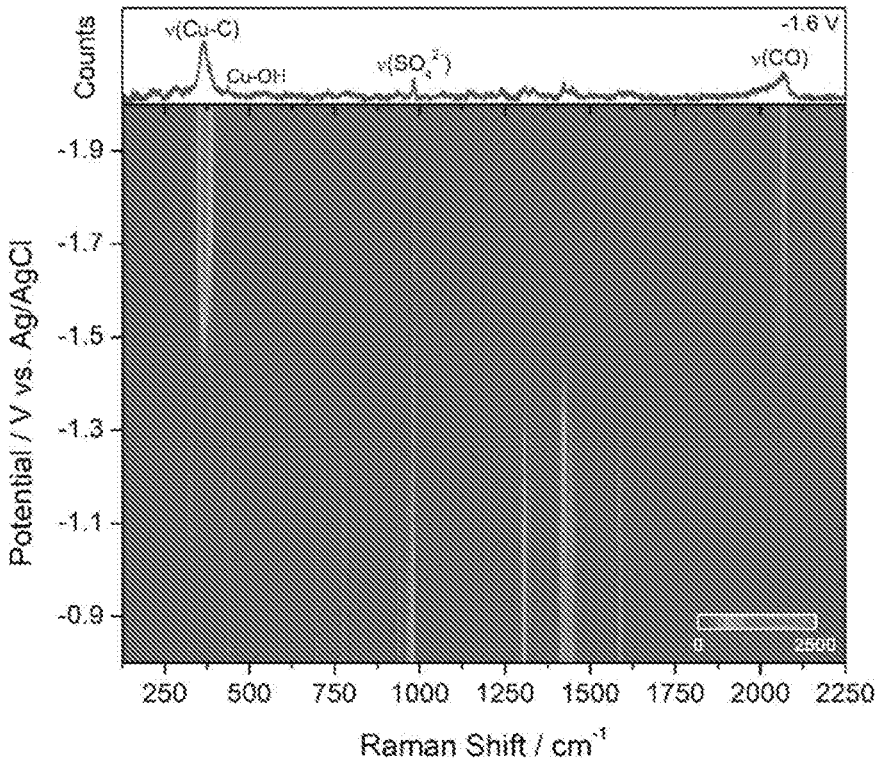
FIG. 26 is a potential dependent in situ SERS plot of Neo during acidic $CO_2R$, as described in Example 2. The concentration of Neo is 0.25 mM.

Referring to FIG. 25, the initially broad and intense $v(SO_4^{2-})$ peak on Cu catalysts at lower cathodic potentials can be due to specifically adsorbed $SO_4^{2-}$ anions on Cu, which desorbs from the surface at about −1.2 V vs. Ag/AgCl.[51] This is evident from a shift in the peak position from 973 $cm^{-1}$ to 982 $cm^{-1}$ and a reduction in the peak intensities. The peak at 316 $cm^{-1}$ can be assigned to the Cu—O vibration, where the O atom can be from the sulfate anion.[52-53] Several peaks from 1200 $cm^{-1}$ to 1650 $cm^{-1}$ have been suggested in the literature to indicate traces of short-chain monocarboxylic acid from $CO_2R$ under low cathodic potentials[54-55], or due to exogenous carbon contamination.

Figure 27:
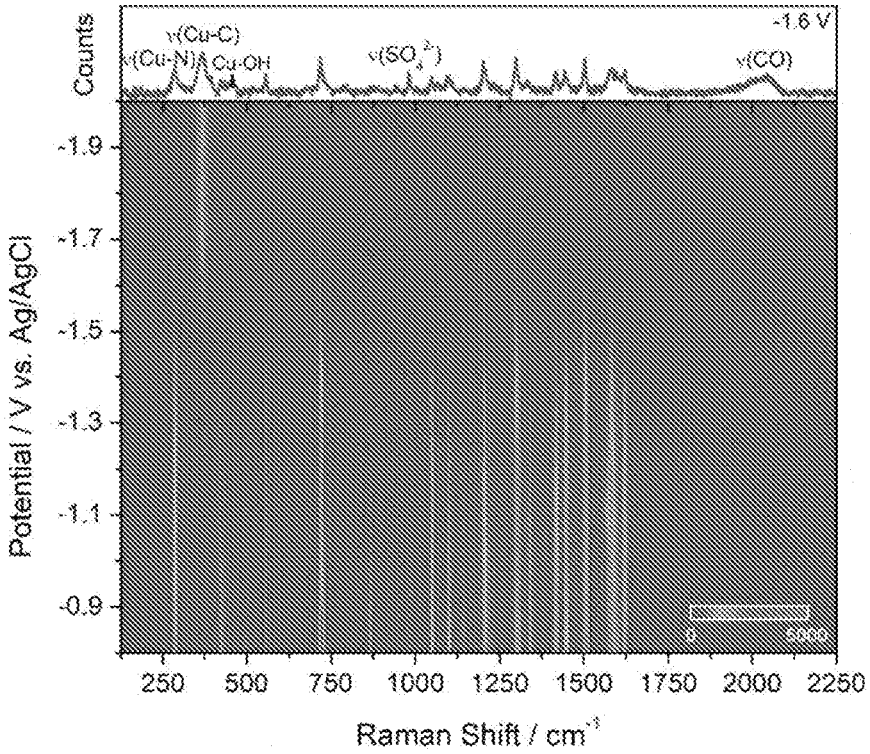
FIG. 27 is a potential dependent in situ SERS plot of 1,10-Phen during acidic $CO_2R$, as described in Example 2. The concentration of 1,10-Phen is 0.25 mM.
Figure 28:
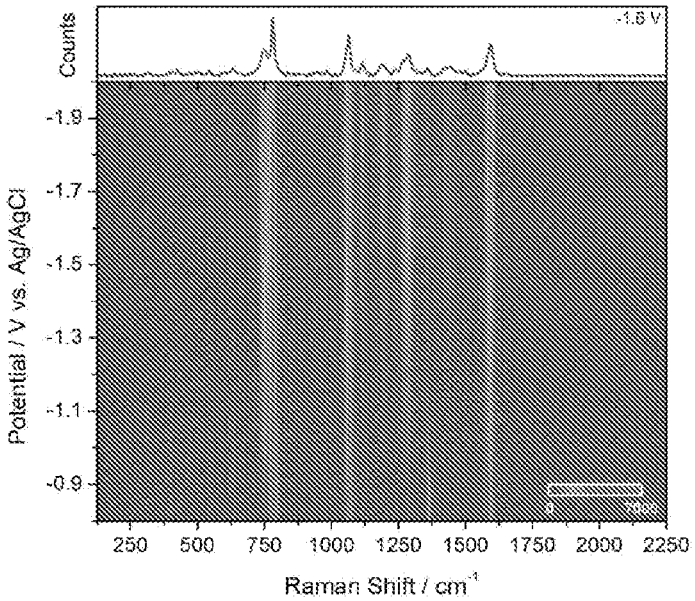
FIG. 28 is a potential dependent in situ SERS plot of 1,8-Naph during acidic $CO_2R$, as described in Example 2. The concentration of 1,8-Naph is 0.25 mM.

Referring to FIG. 27, the SERS spectra of 1,10-Phen reported herein substantially agrees with previously reported results.[56-57]

Figure 29:
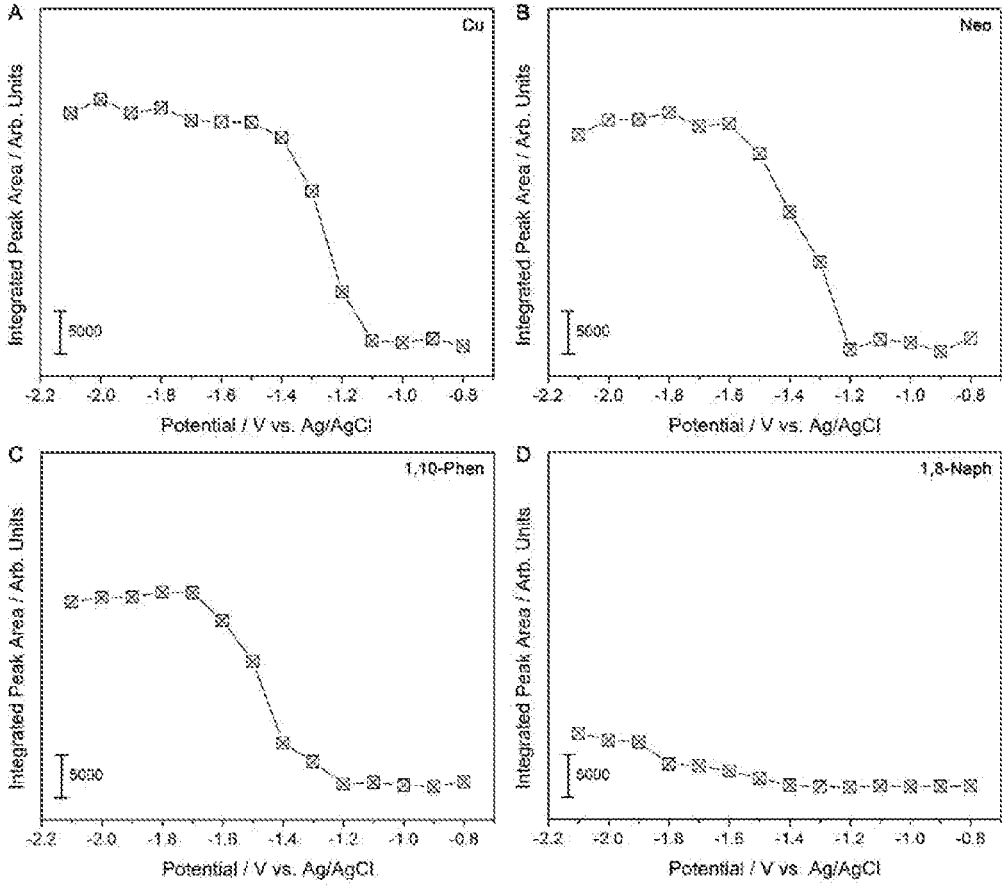
FIG. 29 presents the integrated area of the v(CO) peak obtained from the in situ SERS spectra in (A) of Cu; in (B) of Neo; in (C) of 1,10-Phen; and in (D) of 1,8-Naph, as described in Example 2. The concentration of N-heterocycles is 0.25 mM.

Referring to FIG. 29, the v(CO) peak integration was performed following background subtraction and scaling of the SERS spectra by the intensity of the sulfate anion peak. The intensity of the $v(SO_4^{2-})$ peak does not vary with applied potentials making it a good reference for v(CO) peak comparison. The v(CO) area of Cu and Neo electrodes are very similar (26754 arb. units vs. 26772 arb. units). However, a reduction in the v(CO) area can be observed following the addition of 1,10-Phen and 1,8-Naph. It is noted that although the integrated area of the v(CO) region is proportional to the coverage of CO ($\theta_{CO}$) on Cu, rigorous quantification could be affected by dipole-dipole coupling effects (for a more detailed discussion, see Example 3). The reduction in $\theta_{CO}$ observed for 1,10-Phen supports the occupation of Cu sites by 1,10-Phen during acidic $CO_2R$ reaction. The significant reduction in $\theta_{CO}$ observed for 1,8-Naph is consistent with greater $E_{ad,mol}$ compared to that of CO.

A few studies have reported a decline in the v(CO) peak area at higher cathodic potentials.[58-59] However, this behavior is not observed in the present examples. The reported decline in the v(CO) peak has been attributed to CO reduction at negative potentials, which lowers the $\theta_{CO}$. The absence of this decline the present examples can be due to two factors. First, high enough negative potentials to observe a rapid consumption of CO may not have been applied. This can be due to difficulties with spectrum acquisition in the presence of $H_2$ bubble formation. Second, the reported decline of the v(CO) peak area could be due to limited CO transport to a solid electrode in aqueous conditions where the solubility of CO is low and the diffusion path is long. Whereas, the present in situ SERS results were obtained on gas diffusion electrodes with better mass transfer properties.

In addition to influencing overall $\theta_{CO}$, N-heterocycles can also change the occupancy of different surface Cu sites, which was analyzed by using CO as a probe molecule. The broad asymmetric $CO_{top}$ peak deconvoluted into three components centered at 2044, 2082, and 2092 $cm^{-1}$ correspond to $CO_{top}$ adsorbed at terrace sites, low-coordination sites, and isolated sites (FIGS. 24(D) and 30).[49-50,60-63] In the presence of Neo, a slight redshift was observed in the overall $CO_{top}$ peak, suggesting a minor change to CO adsorption on the Cu surface. In contrast, co-adsorbed 1,10-Phen reduced the occupancy of $CO_{top}$ at the low-coordination sites substantially, but the population of $CO_{top}$ on terrace sites was unaffected. A similar result has been reported for CO co-adsorption with pyridine on polycrystalline Cu.[64] Upon the inclusion of 1,8-Naph, $CO_{top}$ adsorbs primarily on isolated sites, a species speculated to promote CO formation (for a more detailed discussion, see Example 4).[63] By analyzing the $CO_{ad}$ speciation in the context of the $E_{ad,mol}$ of N-heterocycles, it can be assumed that N-heterocycles with intermediate $E_{ad,mol}$ selectively adsorb at low-coordination sites, but do not affect CO adsorption on the terrace sites. Since low-coordination sites have been demonstrated to be more active for HER,[65] and terrace sites have shown high activities for the C—C coupling reaction, a key step in $C_2H_4$ formation,[11, 41-46] the preferential adsorption of N-heterocycles on different Cu sites provides a mechanism for selective site-blocking.

Figure 30:
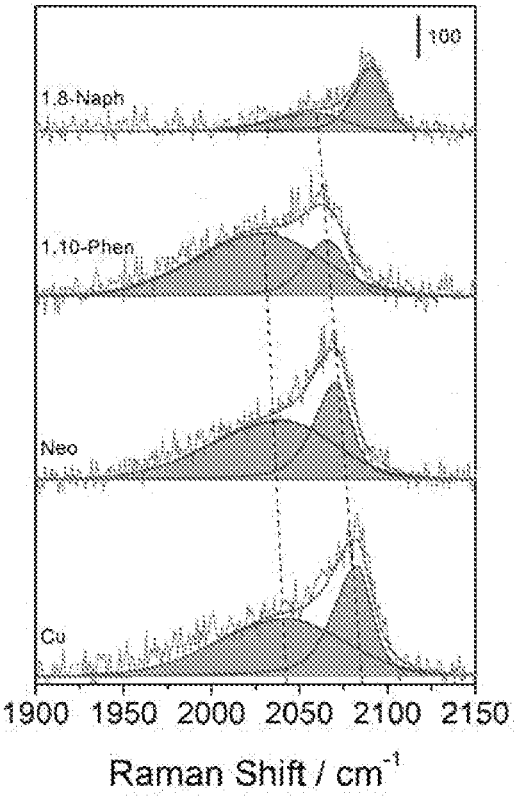
FIG. 30 presents the deconvolution of the v(CO) region of the Cu, Neo, 1,10-Phen and 1,8-Naph SERS spectra, as described in Example 2. The in situ SERS spectra are recorded at −1.8 V vs. Ag/AgCl. The two dashed lines indicate a redshift in the position of the deconvolution components. The concentration of N-heterocycles is 0.25 mM.

Referring to FIG. 30, to evaluate CO speciation on Cu in the absence and presence of N-heterocycles, deconvolution of the v(CO) envelope was performed. The line shape used in the deconvolution is based on asymmetric Voigt functions, a combination of Gaussian and Lorentzian line shapes. In the deconvolution process, the full-width-at-half-maximum (fwhm) and the line shape were fixed, but the peak positions was allowed to change. The v(CO) envelope obtained on Cu was fit first. The line shape and fwhm of the high-frequency band (2082 $cm^{-1}$) were determined by matching the trailing edge (high wavenumber) of the envelope and the final fit. The fwhm and line shape of the low-frequency band (LFB, 2044 $cm^{-1}$) was determined by matching the leading edge of the envelope (low wavenumber) and the final fit. A similar procedure was performed for the peak at 2092 $cm^{-1}$. The peak characteristics determined from Cu were used to fit the low and high frequency components of all other samples The position of the deconvolution components was based on previously reported values of CO adsorption on polycrystalline Cu and Cu single crystals.[66-69]

Figure 22:
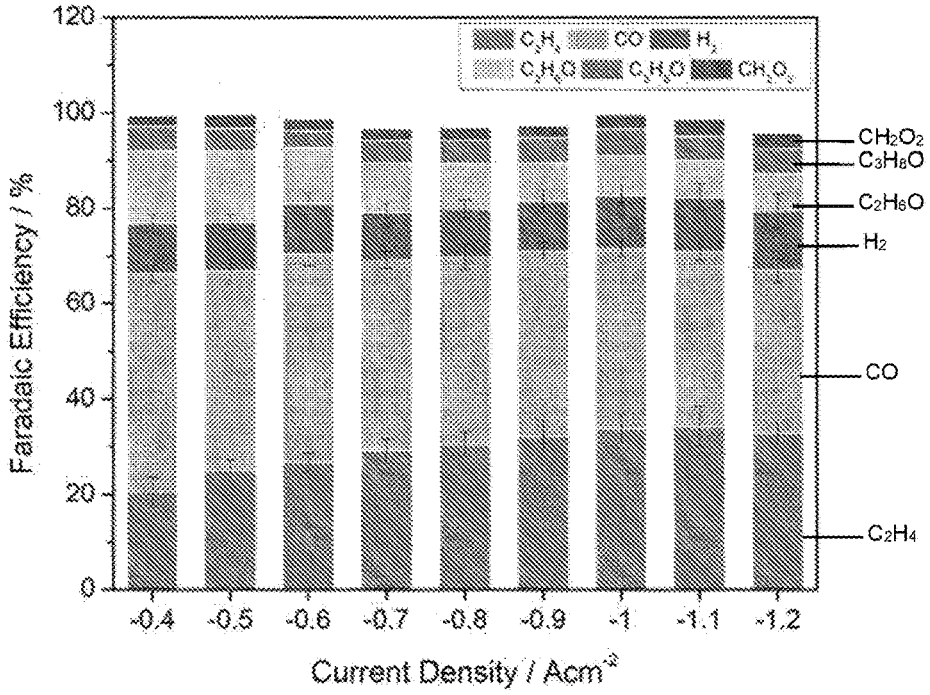
FIG. 22 is a bar graph showing the acidic $CO_2R$ reaction product distribution of a CuNPs catalyst with 0.25 mM of 1,8-Naph, as described in Example 2. The catholyte used was 2.5 M KCl in 0.05 M $H_2SO_4$, and the anolyte was 0.05 M $H_2SO_4$. The $CO_2$ flow rate was 40 sccm. Error bars represent the standard deviation of three measurements from different electrodes.
Figure 23:
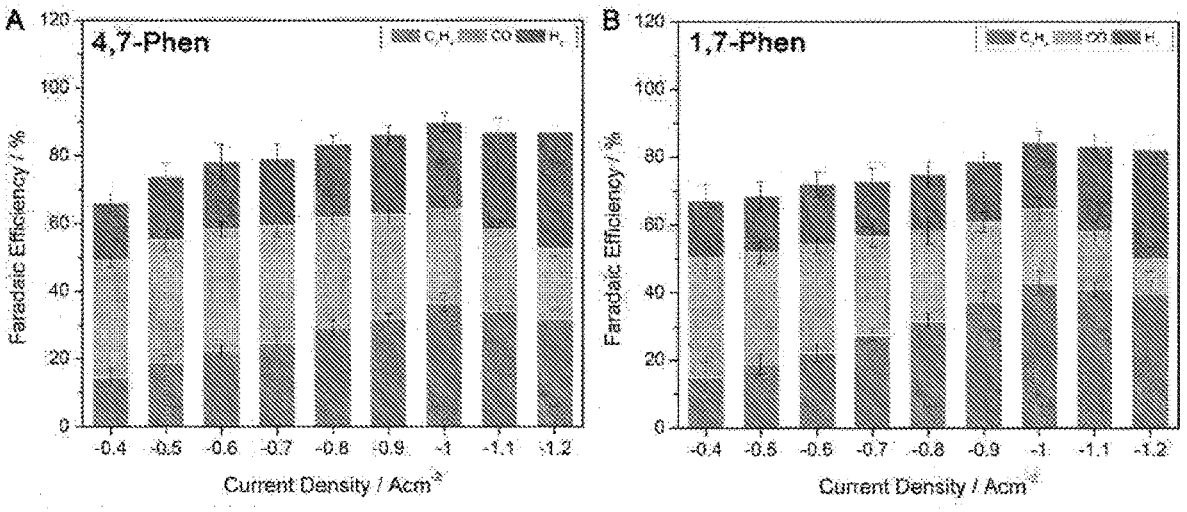
FIG. 23 shows bar graphs showing the acidic $CO_2R$ reaction gas-phase product distribution in (A) of 4,7-Phen; in (B) of 1,7-Phen; in (C) of Ade; and in (D) of Bta, as described in Example 2. The catholyte used was 2.5 M KCl in 0.05 M $H_2SO_4$, and the anolyte was 0.05 M $H_2SO_4$. The $CO_2$ flow rate was 40 sccm. Error bars represent the standard deviation of three measurements from different electrodes. The concentration of N-heterocycles is 0.25 mM.
Figure 23:
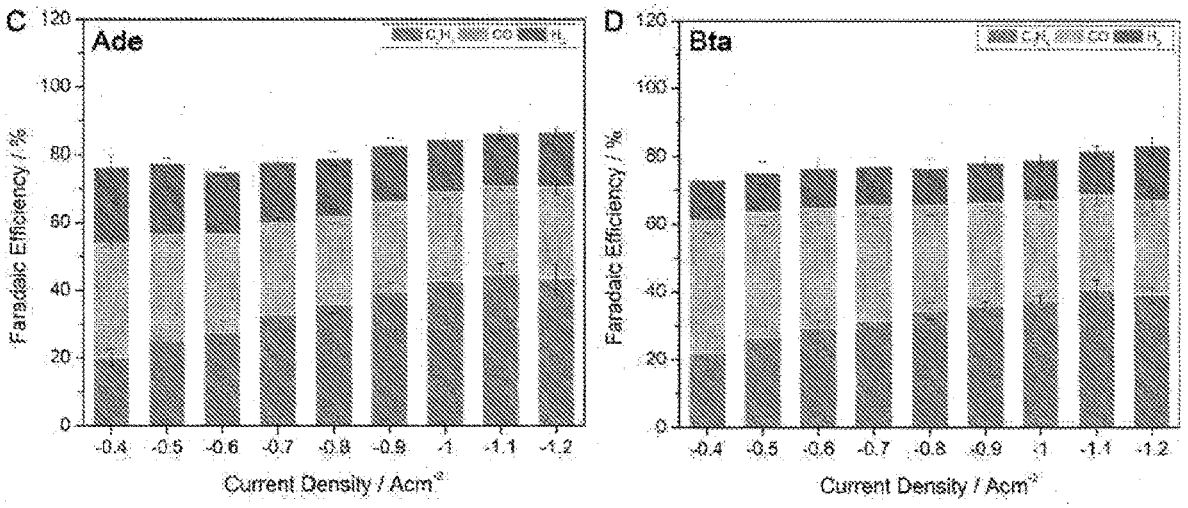
Figure 24:
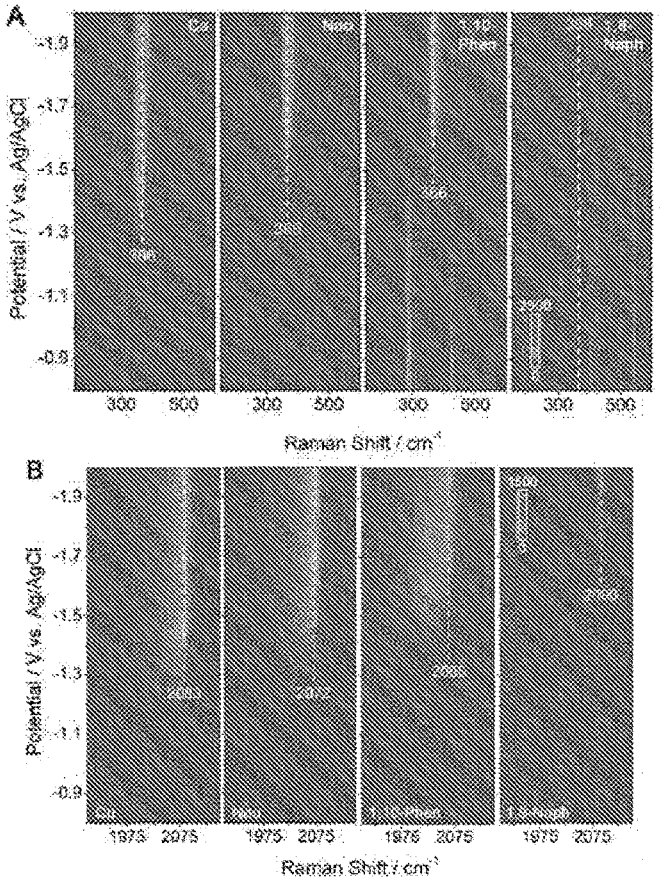
FIG. 24(A) presents in situ SERS of the v (Cu—CO) region under different applied potentials, as described in Example 2. The color scale applies to all subfigures.
FIG. 24(B) presents in situ SERS characterization of the $CO_{top}$ under different applied potentials, as described in Example 2. The color scale applies to all subfigures.
FIG. 24(C) is a graph showing the potential-dependent change in the integrated v(CO) peak area, as described in Example 2.
FIG. 24(D) shows the deconvolution of the v(CO) peak of the SERS spectra showing $CO_{top}$ on different adsorption sites (green: terrace sites; red: low-coordination sites; and blue: isolated sites), as described in Example 2.
FIG. 24(E) is a graph showing the experimental relationship between the adsorption energy of N-heterocycles ($E_{ad,mol}$) and the $FE_{C_2H_4}$, as described in Example 2. The vertical lines indicate the values of $E_{ad,CO}$ and $E_{ad,H}$, and the horizontal line indicates the $FE_{C2H4}$ of CuNPs. Error bars represent standard deviations obtained from three independent measurements from different electrodes.
FIG. 24(F) is a schematic representation of the selective site-blocking mechanism of the N-heterocycles leading to different acidic $CO_2R$ selectivity according to one implementation.
Figure 24:
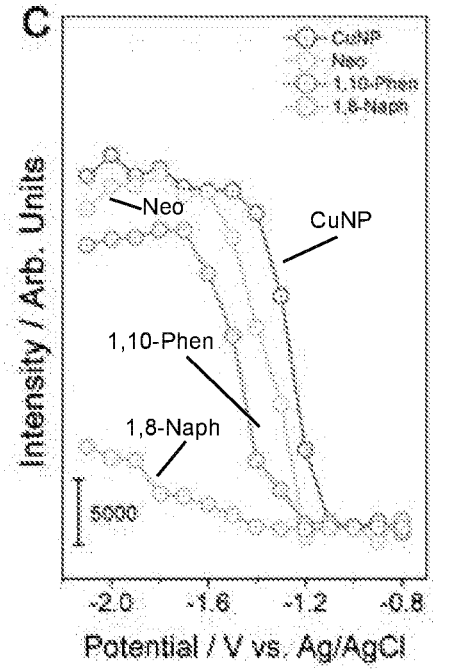
Figure 24:
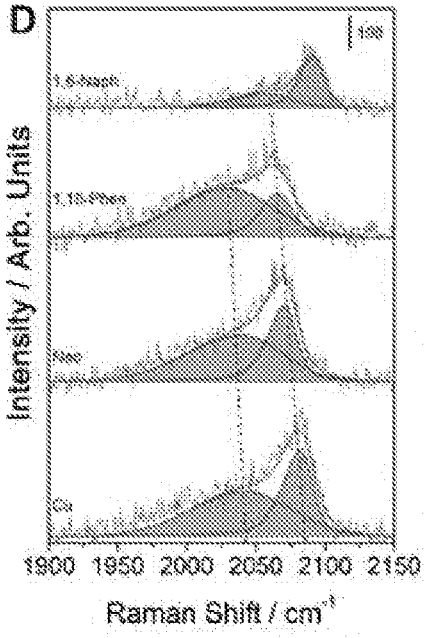
Figure 24:
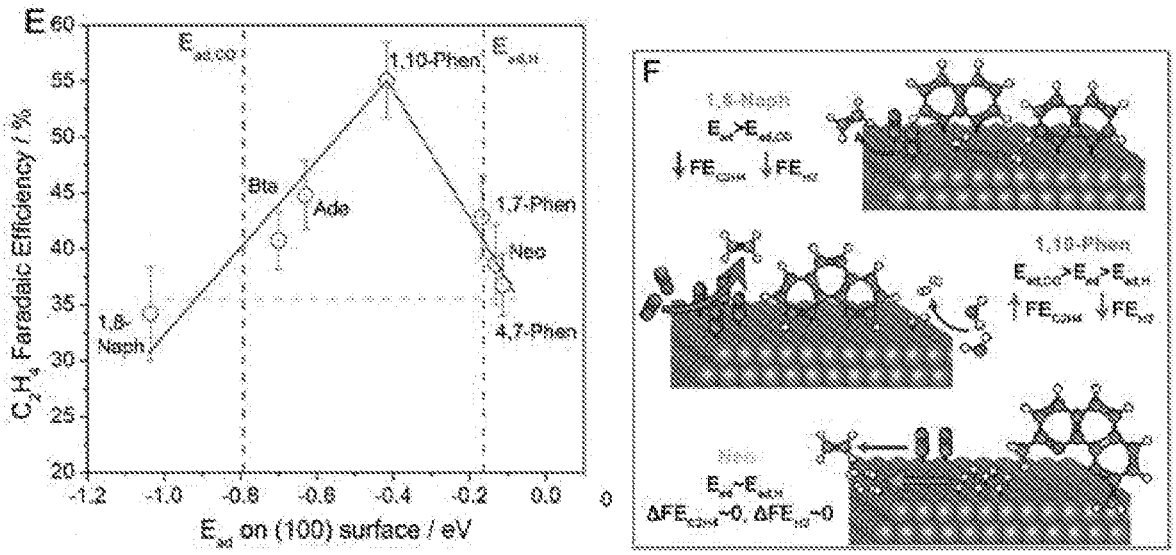
Figure 31:
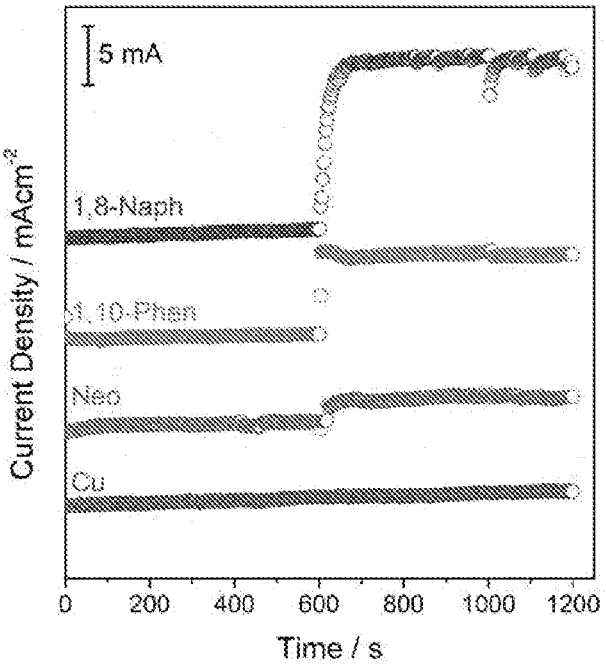
FIG. 31 is a graph of the current density as function of time showing the HER suppression before and after the addition of 0.25 mM of Neo, 1,10-Phen, and 1,8-Naph, as described in Example 2. The electrode potential was held at −2.0 V vs. Ag/AgCl.

The volcano-shaped relation between $FE_{C2H4}$ and $E_{ad,mol}$ (FIG. 24(E)) can be explained by invoking a selective site-blocking mechanism. It was found that high $FE_{C2H4}$ is observed for N-heterocycles with $E_{ad,mol}$ located in the domain that is straddled by $E_{ad,H}$ and $E_{ad,CO}$. This observation suggests that the adsorption of N-heterocycles should be stronger than H but weaker than CO to promote $C_2H_4$ formation in acidic $CO_2R$. When the $E_{ad,mol}$ (e.g., 4,7-Phen and Neo) is similar to that of $E_{ad,H}$, the N-heterocycles are not favorably adsorbed on Cu compared to H and are not effective at suppressing HER, which is reflected in the substantially low $FE_{C2H4}$ and substantially high HER selectivity (FIGS. 19, 20, 23, and 31). In contrast, when the $E_{ad,mol}$ (i.e., 1,8-Naph) is greater than $E_{ad,CO}$, the adsorption of H and CO on Cu are suppressed, which result in a substantially low FE for $H_2$ but a substantially high CO FE (FIGS. 22 and 31). This is detrimental to $C_2H_4$ formation since a high surface coverage of CO is essential for the C—C coupling reaction. As a result, 1,10-Phen, which possesses an $E_{ad,mol}$ between that of $E_{ad,CO}$ and $E_{ad,H}$, reduces H adsorption but does not inhibit CO adsorption, is most effective for $C_2H_4$ generation in acidic conditions (FIG. 24(F)). From additional electron and vibrational spectroscopies, it was determined that 1,10-Phen remains stable on the Cu surface during acidic $CO_2R$, and that it does not undergo chemical change or affect the chemical oxidation state of Cu during catalysis (FIGS. 32 to 37).

Referring to FIG. 31, the ability of N-heterocycles in suppressing $H_2$ formation was assessed independent of $CO_2R$ by performing HER experiments in the same flow cell, but with $N_2$ as a purge gas. After 10 min of continuous HER reaction on Cu catalysts, N-heterocycles were introduced into the catholyte and a decrease in the HER current density was observed. Higher percentage reduction in HER current reflects greater efficiency in HER suppression, Neo (6%)<1,10-Phen (23%)<1,8-Naph (48%). The percentage reduction in the HER current density is in accordance with the $E_{ad,mol}$ predicted by DFT calculations. No $CO_2R$ products were obtained with $N_2$ as a purge gas, which indicates that N-heterocycles do not react to form ostensible $CO_2R$ products.

Figure 32:
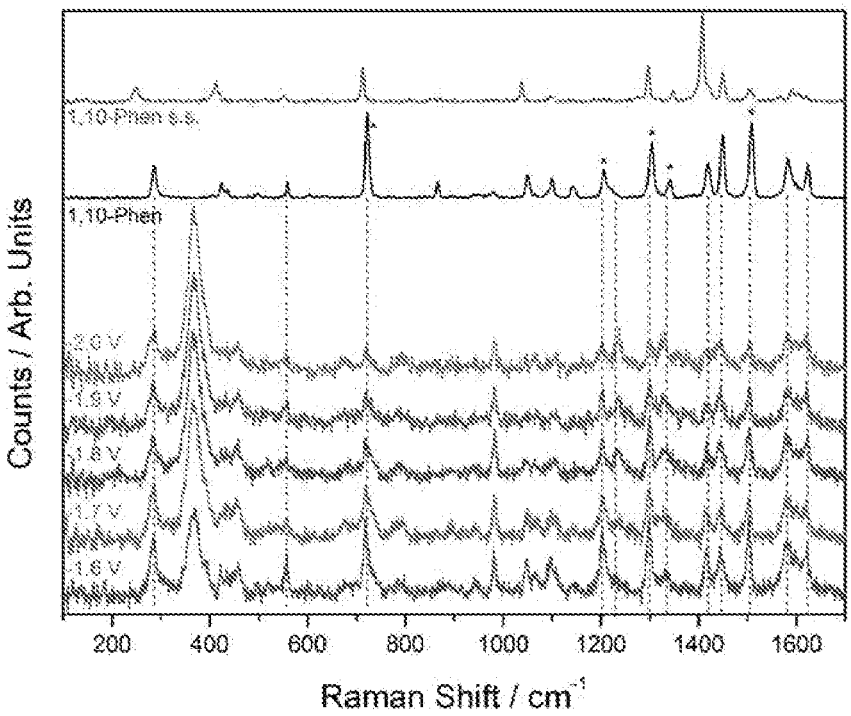
FIG. 32 shows in situ SERS spectra of 1,10-Phen obtained at −0.5 V (black), under high cathodic potentials, and in the solid-state, as described in Example 2. Asterisks indicate peaks with slight shifts in vibrational frequency.

Referring to FIG. 32, under increasing cathodic potentials, a decrease in the peak intensities of 1,10-Phen was observed, which insinuates a decrease in the surface concentration of 1,10-Phen. Lowering of 1,10-Phen coverage under pseudo-steady-state conditions was expected since the $E_{ad}$ of CO is greater than that of 1,10-Phen on the Cu surface. Nonetheless, the apparent vibrational peaks of 1,10-Phen at high potentials offer unambiguous evidence for its co-existence with $CO_{top}$ on the Cu surface during acidic $CO_2R$. Slight shifts in the peak positions by 2-3 $cm^{-1}$ are likely due to the stark effect.

Figure 33:
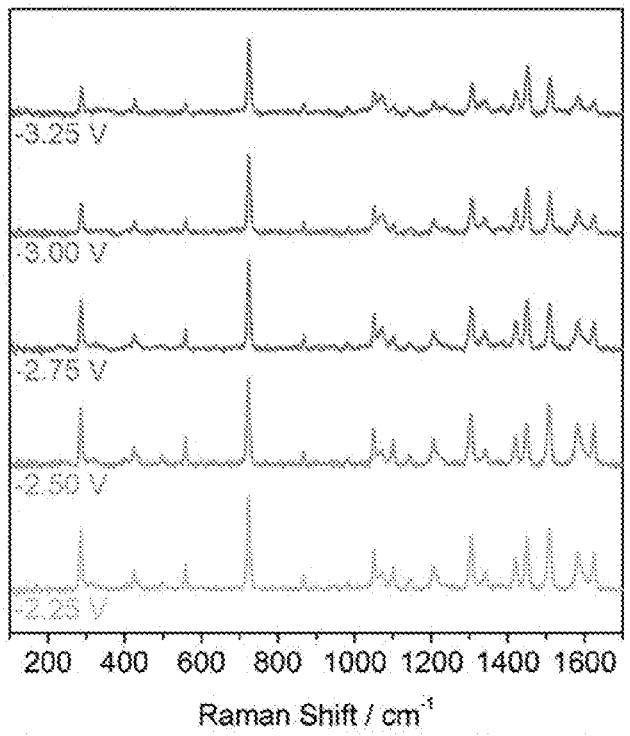
FIG. 33 shows in situ SERS spectra of 1,10-Phen acquired at −1.0 V vs. Ag/AgCl after performing acidic $CO_2R$ at −2.25, −2.50, −2.75, −3.0 and −3.25 V vs. Ag/AgCl, as described in Example 2.

Referring to FIG. 33, at potentials more negative than −2.0 V, $H_2$ bubble formation deteriorates the quality of Raman spectra and prevents the investigation of 1,10-Phen at more reducing potentials. To evaluate the possibility of 1,10-Phen undergoing electrochemical reduction, potentiostatic experiments were performed at increasing negative potentials for 15 min, then the in situ SERS data was acquired at −1.0 V. While the peak intensities are slightly reduced after the potentiostatic experiments, the characteristic vibrations of 1,10-Phen remain unchanged. Thus, it was determined that 1,10-Phen is stable under high cathodic potentials.

Figure 34:
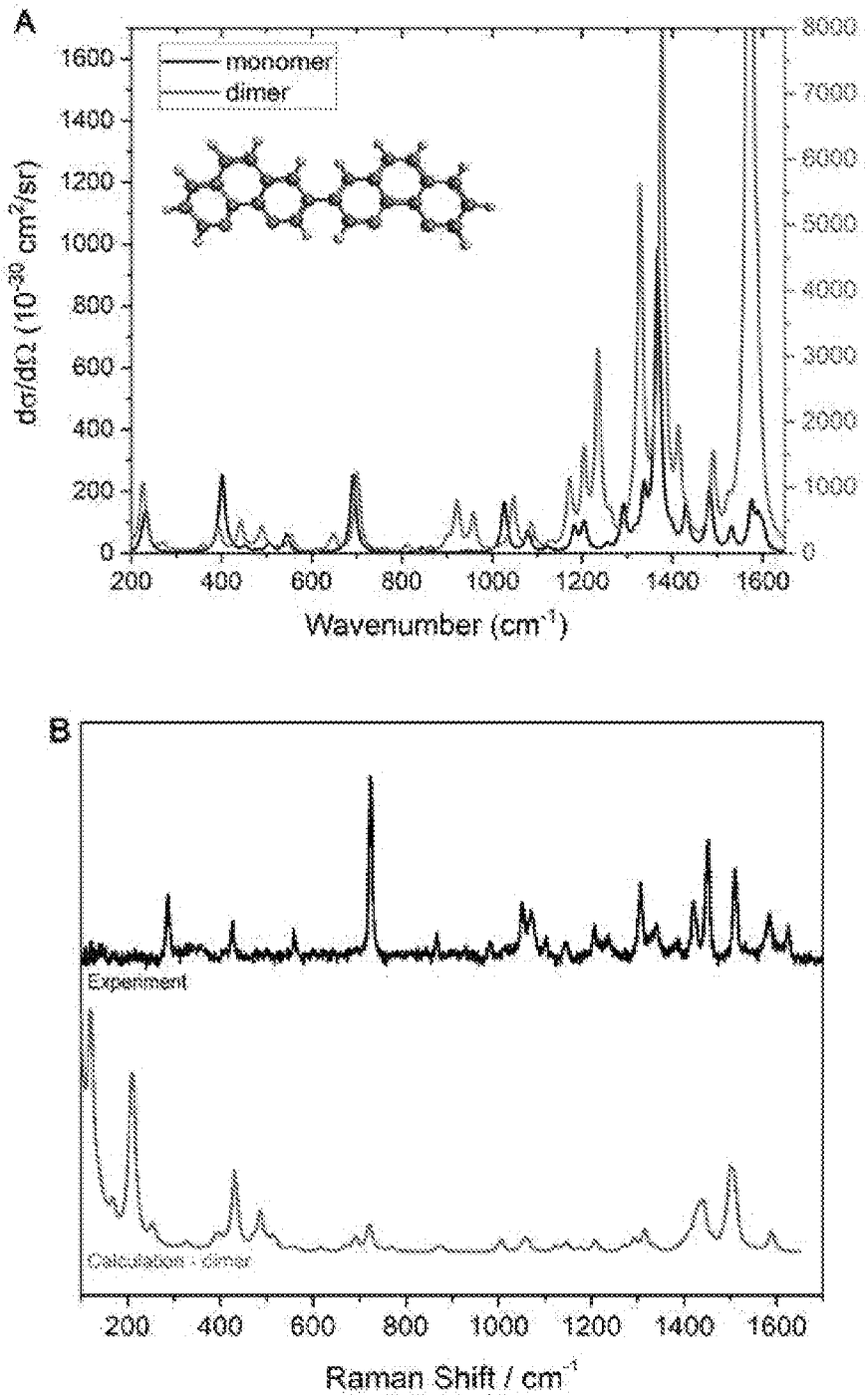
FIG. 34 presents in (A) calculated Raman spectra of 1,10-Phen monomer and dimer, Raman scattering cross-section is plotted on the y-axis; an in (B) calculated Raman spectrum of 1,10-Phen dimer bound to Cu and the corresponding experimental spectrum obtained after about 1.5 hours of $CO_2R$.
Figure 35:
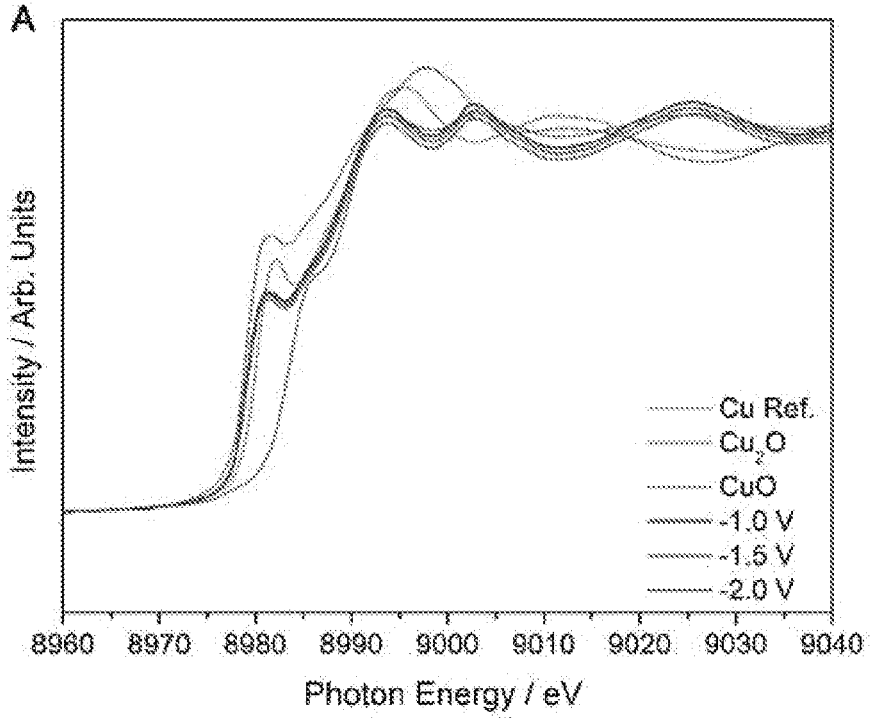
FIG. 35 presents in (A) an X-Ray absorption near edge spectroscopy (XANES) spectrum; and in (B) an extended X-Ray absorption fine structure (EXAFS) spectrum of Cu K-edge obtained by in-situ x-ray absorption spectroscopy (XAS) for Cu catalysts with 0.25 mM of 1,10-Phen.
Figure 35:
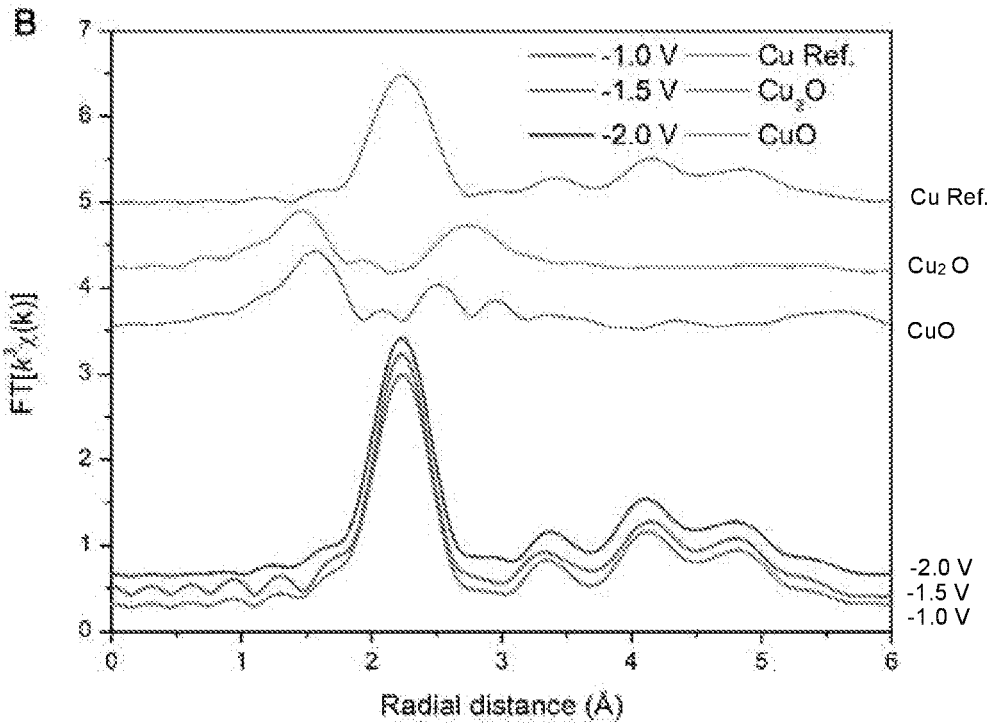

Referring to FIG. 34, based on a previous scanning tunneling microscopy study of 1,10-Phen on Cu in acidic conditions, the 1,10-Phen molecules can form close-packed islands and can diffuse on the Cu surface different applied cathodic potentials.[70] The close-packed nature of the 1,10-Phen molecules places the 3 and 8 position carbon atoms in proximity, which might lead to the formation of 1,10-Phen dimers under reducing potentials commonly employed during $CO_2R$. The calculated Raman spectrum of the free 1,10-Phen monomer and dimer are shown in FIG. 34. The inset in FIG. 34(A) illustrates the potential dimer structure. Based on this result, a significant increase in the peak intensity at about 1595 $cm^{-1}$ would be expected if 1,10-Phen molecules form dimers during $CO_2R$ reaction. Such a change was not observed in the Raman spectrum of 1,10-Phen (FIG. 34(B), black) after a series of potentiostatic experiments from −0.5 V to −3.25 V (a total $CO_2R$ time of about 1.5 hours). The in situ SERS spectrum retains all the characteristic peaks of the pristine 1,10-Phen molecule and is also distinct from the calculated Raman spectrum of a dimer bound with Cu. Thus, it was determined that 1,10-Phen remains unaltered under acidic $CO_2R$ conditions.

Figure 36:
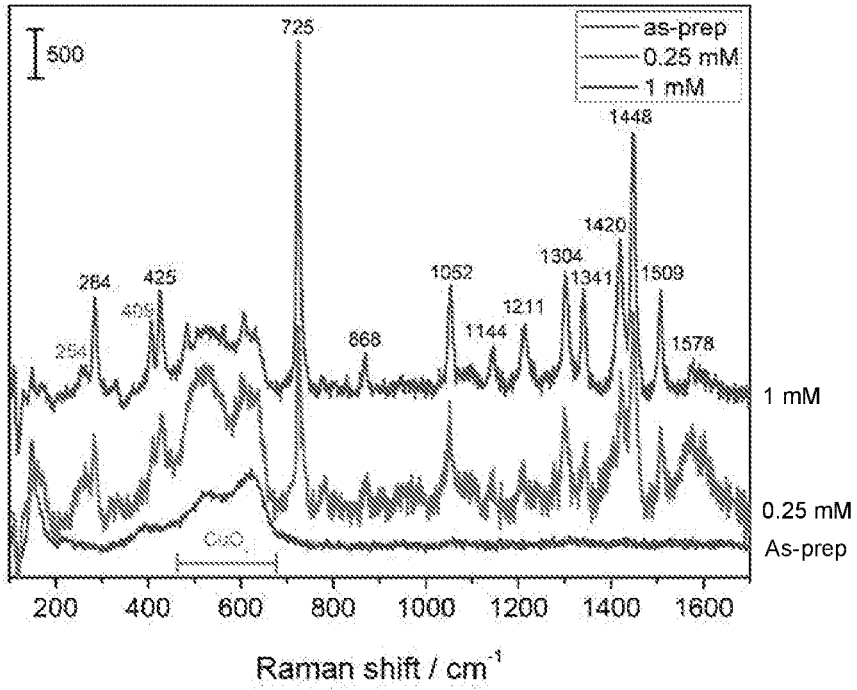
FIG. 36 presents ex-situ Raman spectra obtained for 1,10-Phen on CuNPs after $CO_2R$. The peaks labeled in red indicate vibrational features from 1,10-Phen in the solid-state form.

Referring to FIG. 36, the presence and the chemical nature of 1,10-Phen on CuNPs after $CO_2R$ were assessed with SERS. The as-prepared CuNPs electrode shows only features related to Cu oxides, which are reduced during acidic $CO_2R$. After the $CO_2R$ reaction, the electrodes were rinsed with a substantial amount of deionized water to remove acid, salt, and 1,10-Phen residues (from the electrolyte) on the electrode surface. The electrodes were dried with high purity N2 gas. The Raman spectrum of CuNPs electrodes after reaction shows vibrational features of adsorbed 1,10-Phen indicating that 1,10-Phen was adsorbed on the Cu surface during $CO_2R$, and remains adsorbed on the electrode after the $CO_2R$ reaction. Two small peaks at 254 and 409 $cm^{-1}$ are assigned to 1,10-Phen in the solid-state form, which could come from residual molecule that was not washed away during electrode cleaning.

Figure 37:
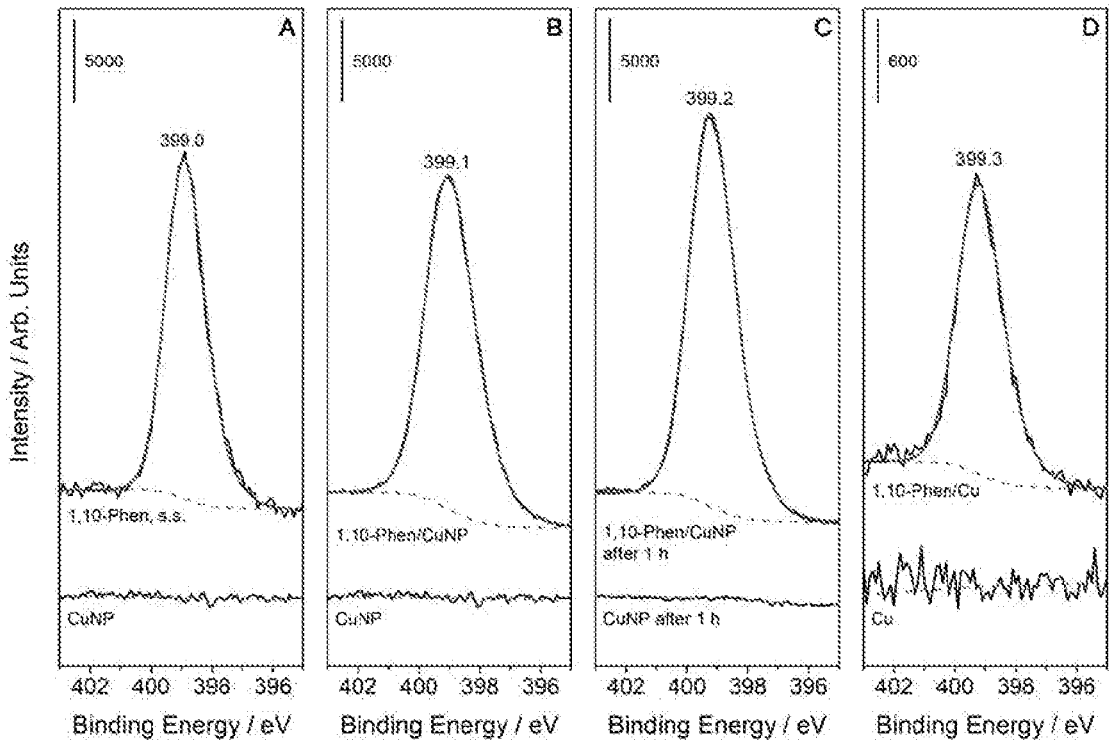
FIG. 37 presents X-ray Photoelectron Spectroscopy (XPS) N 1s core-level spectra of CuNPs; in (A) for 1,10-Phen in the solid-state; in (B) for 1,10-Phen adsorbed on CuNPs; in (C) for 1,10-Phen after 1 hour of reaction; and in (D) for 1,10-Phen adsorbed on Cu.

Referring to FIG. 37, the N 1s core-level spectrum was collected using XPS to compare the surface N species before and after $CO_2R$ reaction. FIG. 37(A) shows that the as-prepared CuNPs electrode does not contain surface N. The binding energy of the pyridinic-N of 1,10-Phen was identified in the solid-state form to be 399.0 eV, which is consistent with prior reports (NIST, XPS database). The N 1s envelope in FIG. 37 can be deconvoluted into a single component using a mixed asymmetric Gaussian-Lorentzian line shape (CasaXPS software, line shape: LF(1.75, 0.75, 15, 250)). This line shape was used for deconvolution of all other N 1s spectra. Based on the N 1s data, very similar surface N species was observed on the surface of the CuNPs and Cu electrodes before and after the reaction. This indicates the presence of pyridinic-N from 1,10-Phen. It is noted that the N 1s binding energy of free and Cu-coordinated pyridinic-N are very similar, which means free 1,10-Phen molecules cannot be distinguished from adsorbed 1,10-Phen using the N 1s binding energy values. However, the lack of a secondary N species indicates no chemical change has taken place. For example, a reduced/hydrogenated pyridinic ring would have a N 1s binding energy at 398.6 eV (piperidine, NIST, XPS database). As such, it is believed that the N 1s core-level spectra support that 1,10-Phen remains unaltered during $CO_2R$.

Figure 38:
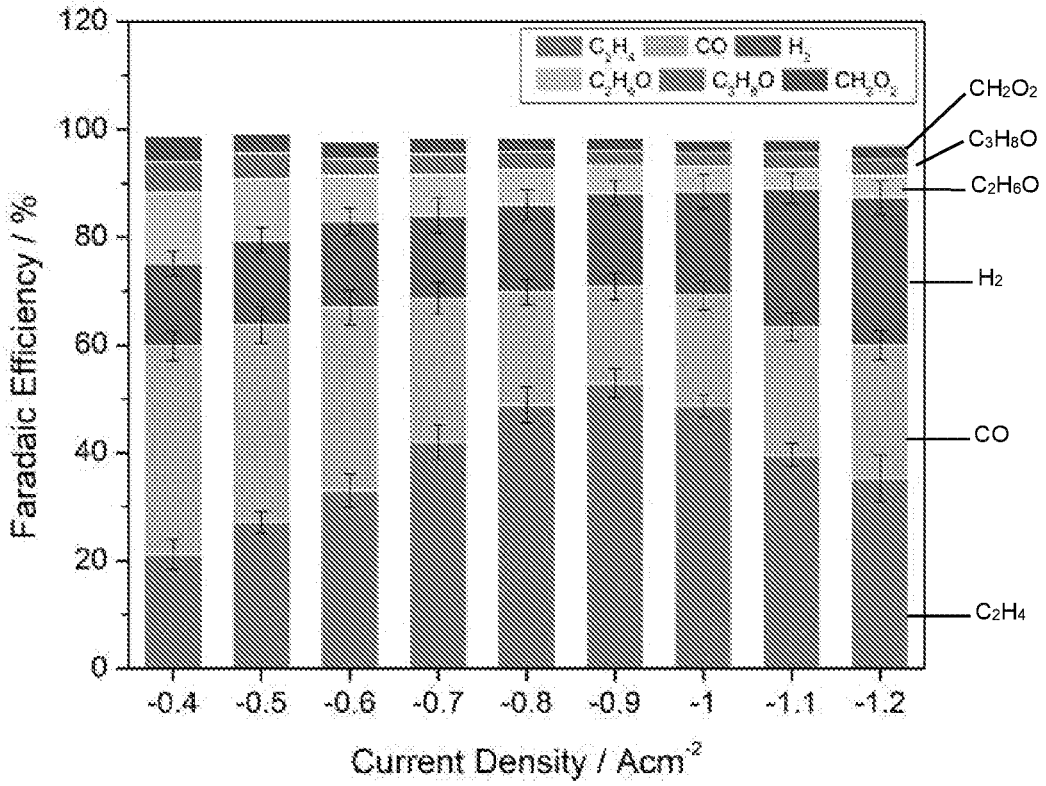
FIG. 38 is a bar graph showing the production distribution of acidic $CO_2R$ on CuNPs catalysts with 0.25 mM of 1,10-Phen and a porous carbon layer.
Figure 39:
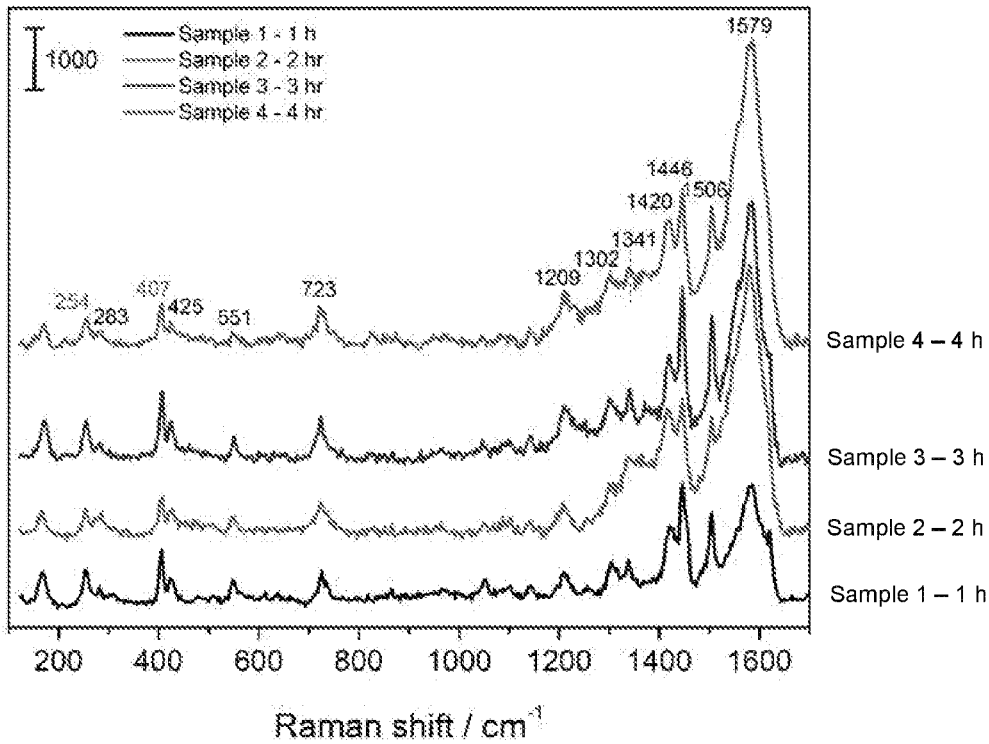
FIG. 39 presents SERS spectra of 1,10-Phen on porous carbon-coated CuNPs electrodes after $CO_2R$. The peaks labeled in red indicate vibrational features from 1,10-Phen in the solid-state form.
Figure 40:
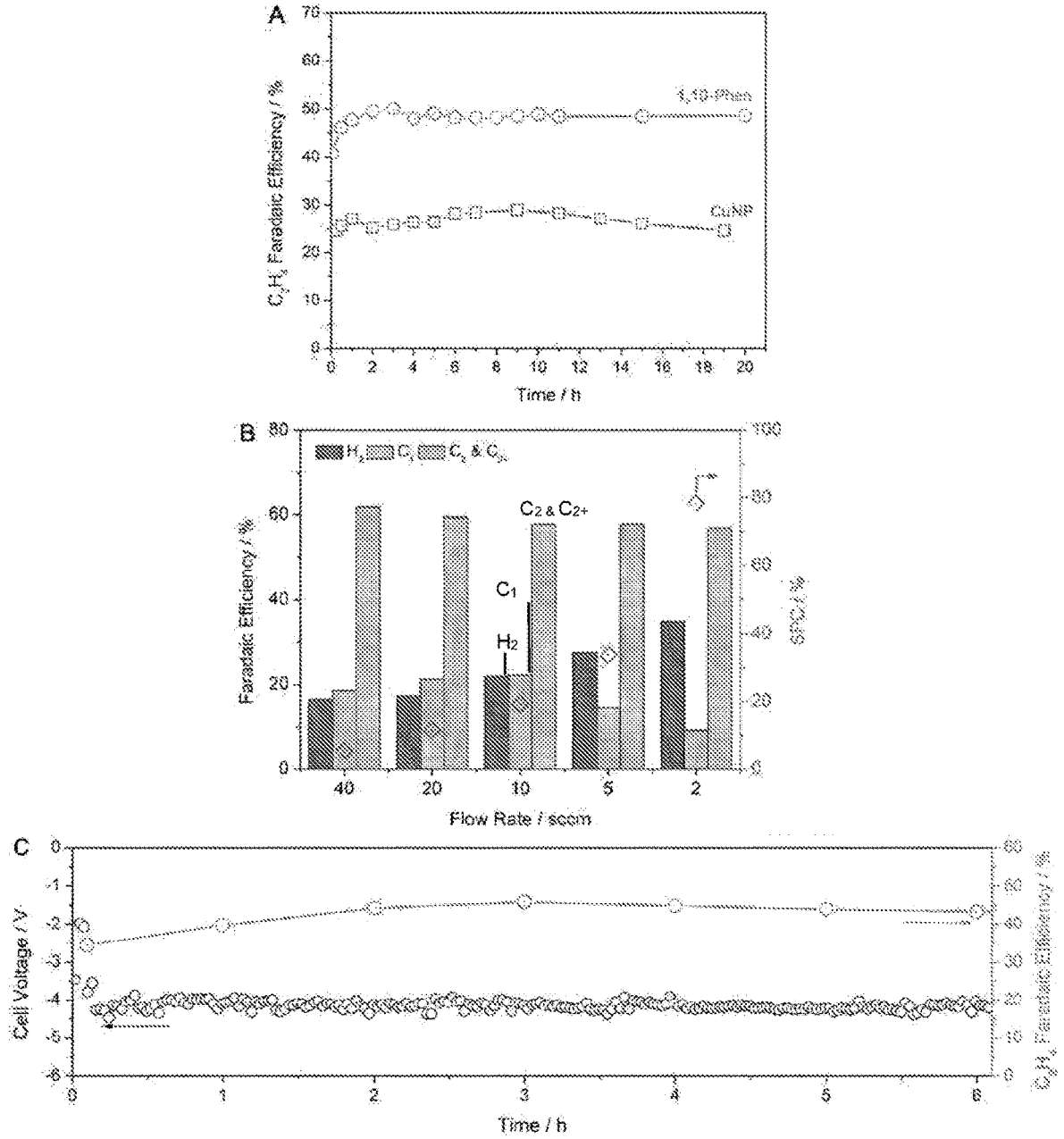
FIG. 40 presents in (A) a graph of the $FE_{C_2H_4}$ as a function of time for a acidic $CO_2R$ at −0.7 $Acm^{-2}$ catalyzed by CuNPs/carbon electrodes with and without 1,10-Phen; in (B) a bar graph showing the single-pass conversion (SPC) of acidic $CO_2R$ using CuNPs/carbon electrodes with 1,10-Phen; and in (C) a graph showing the full cell voltage and $FE_{C_2H_4}$ of acidic $CO_2R$ with 1,10-Phen in a slim flow cell.

Catalysts were prepared for flow-cell studies by forming CuNPs electrodes and then depositing a thin porous layer of carbon nanoparticles as in prior reports (CuNPs/C) (FIG. 38).[3,5] It was found that the porous C layer did not prevent the adsorption of 1,10-Phen on Cu (FIG. 39), and that the $FE_{C2H4}$ of CuNPs/C was improved by about 15% to about 20% with 1,10-Phen addition (FIG. 40(A)). A 78% single-pass conversion (SPC) of $CO_2$ was obtained in acidic conditions (FIG. 40(B)) and 55% $FE_{C2H4}$ when SPC was above 20%. Using a slim flow cell, a stable $CO_2R$ operation in acidic conditions was achieved for 6 hours with 40% $FE_{C2H4}$ at a full cell voltage of 4.2 V (FIG. 40(C)). Based on these values, the energy efficiency towards $C_2H_4$ is improved by 12.3%, over the previous acidic $CO_{-2}$-to-$C_2H_4$ electrosynthesis record.[3]

Referring to FIG. 39, the electrodes were rinsed with deionized water and dried with high purity $N_2$ after $CO_2R$ reaction. The Raman spectra were collected after different reaction times at 400 $mAcm^{-2}$. The characteristic peaks of adsorbed 1,10-Phen on the Cu surface confirm that the porous-C layer did not impede the adsorption of this molecule on Cu. Two peaks at 254 and 407 $cm^{-1}$ are assigned to 1,10-Phen in the solid-state form, which could come from residual free molecules that were not washed away during electrode cleaning. The rising background at frequencies >1200 $cm^{-1}$ can be due to imperfect background removal for the D- and G-bands of the C layer.

Example 3: Supplementary Discussion

The v(CO) peak position of $CO_{top}$ can be influenced by several factors. Two phenomena can affect the peak position as a function of $\theta_{CO}$. The first is the "chemical effect", which arises from the backbonding of metal d orbital with the $2\pi^*$ orbital of the CO molecule.[71] For CO on Cu, this effect shifts the v(CO) peak to a lower frequency.[71] The second coverage-dependent effect is dipolar coupling, which results from the coupling of v(CO) with nearby vibrating dipoles and can give rise to new vibrational modes for the coupled system.[71-73] Dipolar coupling for CO on Cu shifts the peak toward higher frequency.[71-72] One phenomenon that can arise from dipolar coupling is called intensity-borrowing, where the peak intensity of the high-frequency v(CO) mode could be greater than the actual $\theta_{CO}$ due to the formation of new modes. This affects the quantification of surface eco, allowing only a qualitative discussion using the integrated peak areas. Furthermore, with the application of electrode potentials, the d-$2\pi^*$ back-donation from Cu to CO is affected, and the coverage of CO is also affected (due to the $CO_2R$ reaction). This results in the well-known Stark effect.[74-75] Lastly, surface restructuring can lead to the formation of new adsorption sites for CO and depending on the coordination number of these sites, a diverse CO binding energy can result in a different v(CO) peak position. Therefore, the potential dependent behavior of CO on Cu depends on the relative magnitude of different physical effects. A potential dependent red-shift, blue-shift, and no-shift in the peak position have all been reported and attributed to one or multiple of the physical effects discussed above.[59, 76-77] As a result, the potential dependent shifts of our SERS data were not overinterpreted, especially in the studies where N-heterocycles have been added. Instead, the v(CO) region at −1.8 V was analyzed because the peak intensity of $CO_{top}$ has reached a plateau value, which suggests that the CO coverage is saturated, and a pseudo-steady state condition is achieved.

Figure 19:
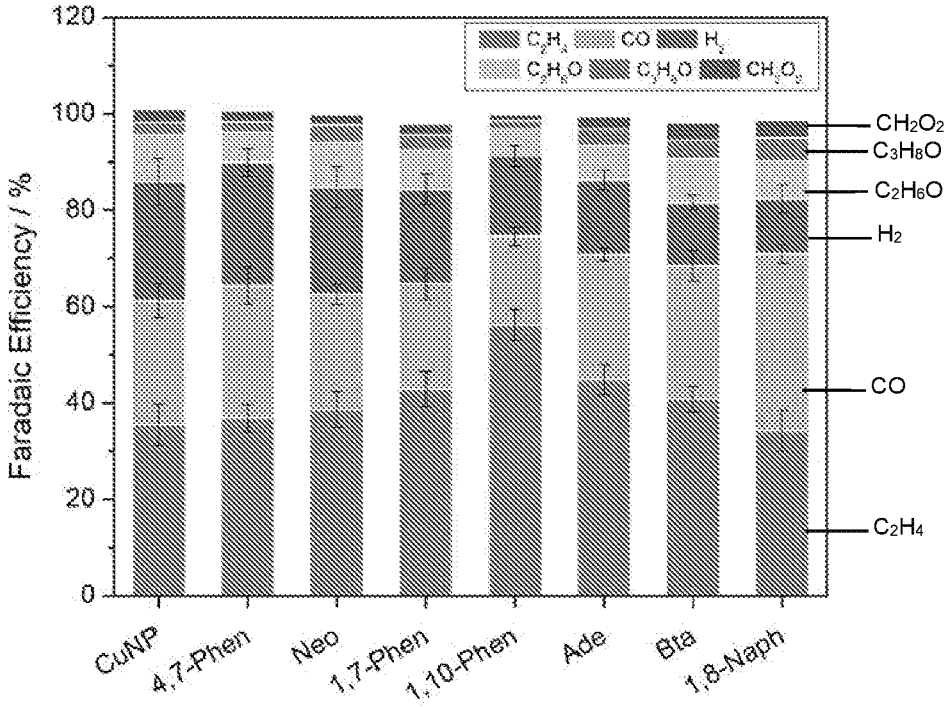
FIG. 19 is a bar graph showing the acidic $CO_2R$ reaction product distributions of CuNPs catalysts with and without N-heterocycles at the highest FECHA conditions, as described in Example 2. The catholyte used was 2.5 M KCl in 0.05 M $H_2SO_4$, and the anolyte was 0.05 M $H_2SO_4$. The $CO_2$ flow rate was 40 sccm. The FE data was obtained at −1.0 $Acm^{-2}$ for CuNPs catalysts, 4,7-Phen and 1,7-Phen; at −0.9 $Acm^{-2}$ for Neo; and at −1.1 $Acm^{-2}$ for 1,10-Phen, Ade, Bta and 1,8-Naph. Error bars represent the standard deviation of three measurements from different electrodes. The concentration of N-heterocycles is 0.25 mM.
Figure 20:
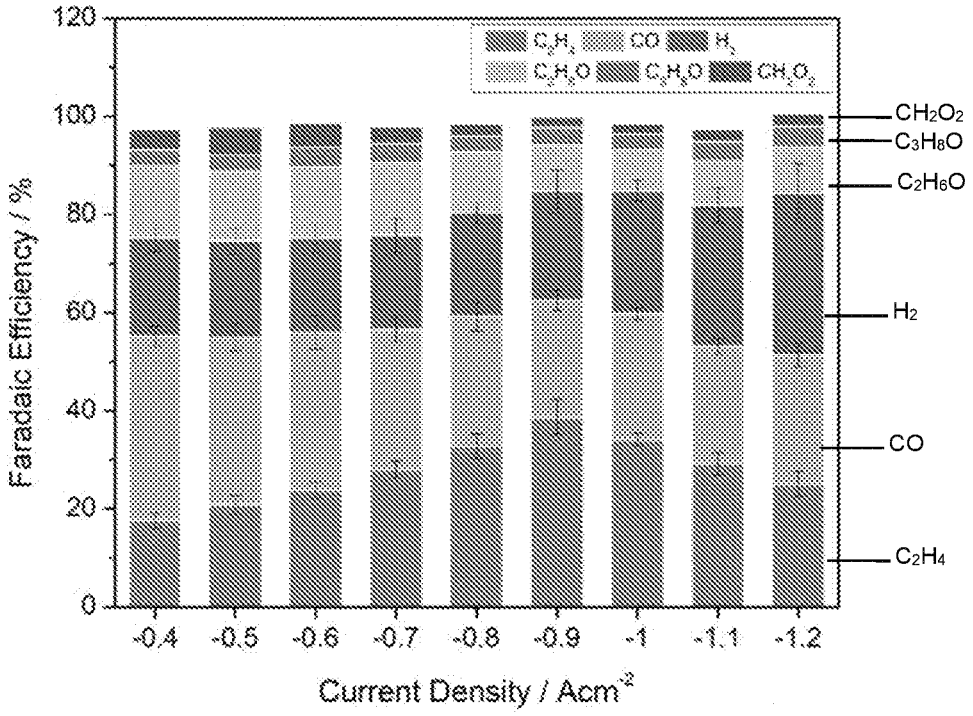
FIG. 20 is a bar graph showing the acidic $CO_2R$ reaction product distribution of a CuNPs catalyst with 0.25 mM of Neo, as described in Example 2. The catholyte used was 2.5 M KCl in 0.05 M $H_2SO_4$, and the anolyte was 0.05 M $H_2SO_4$. The $CO_2$ flow rate was 40 sccm. Error bars represent the standard deviation of three measurements from different electrodes. The loading of CuNPs on the three electrodes was between 1.2 to 1.3 mg $cm^{-2}$.
Figure 21:
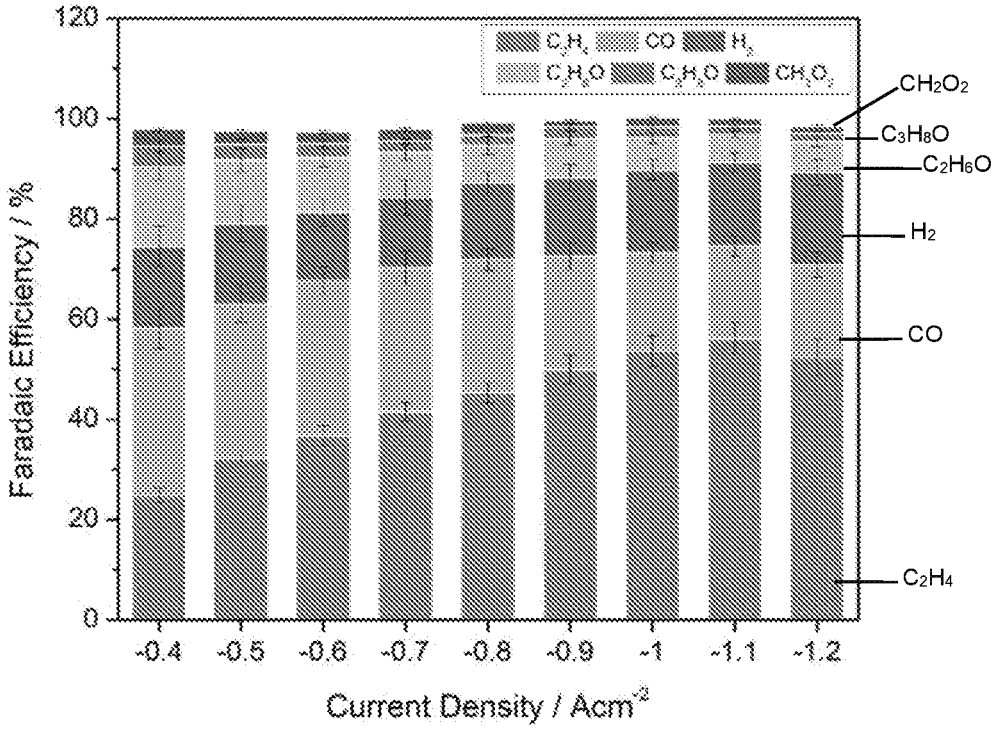
FIG. 21 is a bar graph showing the acidic $CO_2R$ reaction product distribution of a CuNPs catalyst with 0.25 mM of 1,10-Phen, as described in Example 2. The catholyte used was 2.5 M KCl in 0.05 M $H_2SO_4$, and the anolyte was 0.05 M $H_2SO_4$. The $CO_2$ flow rate was 40 sccm. Error bars represent the standard deviation of three measurements from different electrodes.

A qualitative assessment of v(CO) peak area is provided in the present example, which shows similar CO coverage ($\theta_{CO}$) for Cu with and without Neo, but a noticeable decrease with the introduction of 1,10-Phen and 1,8-Naph (FIGS. 24(A) to (C)). The change in $\theta_{CO}$ is consistent with the relative value of $E_{ad,mol}$ and $E_{ad,CO}$, and it suggests partial coverage of the Cu surface by 1,10-Phen and 1,8-Naph, which reduces the number of available sites for CO adsorption. The time-averaged $\theta_{CO}$ value is the sum result of CO adsorption, desorption, and reaction under pseudo-steady-state conditions. Indeed, $CO_{top}$ can be quite labile and has been shown to undergo dynamic exchange with dissolved CO.[58] Therefore, the substantial decrease in $\theta_{CO}$ with 1,8-Naph incorporation could be partially due to the increased desorption of $CO_{top}$ in tandem with reduced availability of surface sites. This proposition is substantiated by the high FE of gaseous CO with 1,8-Naph addition (FIGS. 19 and 22). The discussion of $CO_{top}$ is limited at one applied potential since multiple factors, other than electrode potential can influence the line shape, peak position, peak shift, and perceived CO coverage.[71-72, 74-75, 78] Lastly, it is noted that the amplitude of CO adsorbed on bridge sites ($CO_{bridge}$) is below the signal-to-noise limit. Thus, $CO_{bridge}$ is not considered as the dominant surface species and a decrease in the $CO_{top}$ population is unlikely to be due to its conversion to $CO_{bridge}$.[79-80]

Example 4: Supplementary Discussion (a) In Situ SERS of Cu with and without Neo

The high-frequency band (HFB) of atop-bound CO ($CO_{top}$) is shifted from 2082 $cm^{-1}$ to 2072 $cm^{-1}$, and the low-frequency band (LFB) is shifted from 2043 $cm^{-1}$ to 2040 $cm^{-1}$ when Neo is added. The red-shift in the position of HFB and LFB could be due to 1) a weakening of the CO bond, or 2) CO adsorption at sites with lower binding energy. The former is not believed to be a probable reason for the red-shift due to the weak interaction of Neo with $CO_{ad}$ and its desorption from the Cu surface under high cathodic potentials. Rather the red-shift is likely caused by changes to CO adsorption sites. A study by Malkani et al. have demonstrated that organic additives in the electrolyte (i.e., crown ether) can affect the binding of CO on step sites without itself being specifically adsorbed on the Cu surface.[77] Similar effect is observed in our experiments with the addition of Neo.

(b) In Situ SERS Spectra of Cu with and without 1,10-Phen

The HFB and LFB experience red-shifts from 2081 $cm^{-1}$ to 2065 $cm^{-1}$, and 2043 $cm^{-1}$ to 2035 $cm^{-1}$, respectively. A continued redshift in the v(CO) frequency compared to Cu in the presence of 1,10-Phen could indicate weaker binding of $CO_{top}$ on the Cu surface[81-82] or a change in $CO_{top}$ binding sites. Additionally, the significantly decreased HFB indicates a reduced occupation of the low-coordination sites by CO, most likely due to preferential adsorption of 1,10-Phen on such sites. Ovalle et al. investigated CO speciation on Cu surface with and without organic additives containing pyridinic groups.[83] The author discovered that organic molecules with pyridinic functionalities preferentially adsorb at the defect/undercoordinated sites. In particular, the authors found that pyridine molecule at 10 mM would almost completely saturate defects sites on the Cu surface. The in situ SERS of the present work results agree well with the study by Ovalle et al. Therefore, the shift in the $CO_{top}$ peak with the occupation of strong-CO-binding low-coordination sites by 1,10-Phen was explained.

(c) In Situ SERS Spectra of Cu with and without 1.8-Naph

First, it is noted that the $CO_{top}$ peak area is significantly less than that of Cu (~18%). This means the 1,8-Napth molecules occupy a large number of terrace and low-coordination sites. The $CO_{top}$ peak consists of a primary component located at 2092 $cm^{-1}$. For CO adsorption on Cu, an increase in v(CO) for $CO_{top}$ indicates a strong Cu binding.[81, 84] The presence of 2092 $cm^{-1}$ peak suggests that only $CO_{top}$ with very high binding energy is able to remain on the surface in the presence of 1,8-Naph. Strong CO binding is associated with high CO selectivity, and the peak at 2092 $cm^{-1}$ has also been associated with gas-phase CO production. 76, 85 Additionally, the lower concentration of CO also suggests more sparsely located $CO_{top}$, which would reduce the probability for CO dimer formation and the subsequent $C_2/C_{2+}$ product formation.

The following documents and any others mentioned herein are incorporated herein by reference in their entirety.

REFERENCES (1) De Luna, Phil, et al. "What would it take for renewably powered electrosynthesis to displace petrochemical processes?." *Science* 364.6438 (2019): eaav3506.

(2) Lewandowski, Steve. "Ethylene-Global." *Asia chem. conf.* 2016.

(3) Huang, Jianan Erick, et al. "$CO_2$ electrolysis to multicarbon products in strong acid." *Science* 372.6546 (2021): 1074-1078.

(4) Rabinowitz, Joshua A., and Matthew W. Kanan. "The future of low-temperature carbon dioxide electrolysis depends on solving one basic problem." *Nature Communications* 11.1 (2020): 1-3.

(5) Dinh, Cao-Thang, et al. "$CO_2$ electroreduction to ethylene via hydroxide-mediated copper catalysis at an abrupt interface." *Science* 360.6390 (2018): 783-787.

(6) García de Arquer, F. Pelayo, et al. "$CO_2$ electrolysis to multicarbon products at activities greater than 1 A $cm^{-2}$." *Science* 367.6478 (2020): 661-666.

(7) Chen, Xinyi, et al. "Electrochemical $CO_2$-to-ethylene conversion on polyamine-incorporated Cu electrodes." *Nature Catalysis* 4.1 (2021): 20-27.

(8) Kim, Jinmo, et al. "Branched copper oxide nanoparticles induce highly selective ethylene production by electrochemical carbon dioxide reduction." *Journal of the American Chemical Society* 141.17 (2019): 6986-6994.

(9) Zhang, Bingxing, et al. "Highly electrocatalytic ethylene production from $CO_2$ on nanodefective Cu nanosheets." *Journal of the American Chemical Society* 142.31 (2020): 13606-13613.

(10) Li, Jun, et al. "Constraining CO coverage on copper promotes high-efficiency ethylene electroproduction." *Nature Catalysis* 2.12 (2019): 1124-1131.

(11) Wang, Yuhang, et al. "Catalyst synthesis under $CO_2$ electroreduction favours faceting and promotes renewable fuels electrosynthesis." Nature Catalysis 3.2 (2020): 98-106.

(12) Zhong, Miao, et al. "Accelerated discovery of $CO_2$ electrocatalysts using active machine learning." *Nature* 581.7807 (2020): 178-183.

(13) Lin, Song, et al. "Covalent organic frameworks comprising cobalt porphyrins for catalytic $CO_2$ reduction in water." *Science* 349.6253 (2015): 1208-1213.

(14) Zhou, Yansong, et al. "Dopant-induced electron localization drives $CO_2$ reduction to $C_2$ hydrocarbons." *Nature chemistry* 10.9 (2018): 974-980.

(15) Wang, Xue, et al. "Efficient upgrading of CO to $C_3$ fuel using asymmetric CC coupling active sites." *Nature communications* 10.1 (2019): 1-7.

(16) Clark, Ezra L., et al. "Electrochemical $CO_2$ reduction over compressively strained CuAg surface alloys with enhanced multi-carbon oxygenate selectivity." *Journal of the American Chemical Society* 139.44 (2017): 15848-15857.

(17) Kim, Dohyung, et al. "Synergistic geometric and electronic effects for electrochemical reduction of carbon dioxide using gold-copper bimetallic nanoparticles." *Nature communications* 5.1 (2014): 1-8.

(18) Peterson, Andrew A., and Jens K. Nørskov. "Activity descriptors for $CO_2$ electroreduction to methane on transition-metal catalysts." *The Journal of Physical Chemistry Letters* 3.2 (2012): 251-258.

(19) Kuhl, Kendra P., et al. "Electrocatalytic conversion of carbon dioxide to methane and methanol on transition metal surfaces." *Journal of the American Chemical Society* 136.40 (2014): 14107-14113.

(20) Liu, Xinyan, et al. "Understanding trends in electrochemical carbon dioxide reduction rates." *Nature communications* 8.1 (2017): 1-7.

(21) Li, Fengwang, et al. "Molecular tuning of $CO_2$-to-ethylene conversion." *Nature* 577.7791 (2020): 509-513.

(22) Li, Fengwang, et al. "Cooperative $CO_2$-to-ethanol conversion via enriched intermediates at molecule-metal catalyst interfaces." *Nature Catalysis* 3.1 (2020): 75-82.

(23) Xie, Ming Shi, et al. "Amino acid modified copper electrodes for the enhanced selective electroreduction of carbon dioxide towards hydrocarbons." *Energy & Environmental Science* 9.5 (2016): 1687-1695.

(24) Thevenon, Arnaud, et al. "In-situ nanostructuring and stabilization of polycrystalline copper by an organic salt additive promotes electrocatalytic $CO_2$ reduction to ethylene." *Angewandte Chemie* 131.47 (2019): 17108-17114.

(25) Kim, Chanyeon, et al. "Tailored catalyst microenvironments for $CO_2$ electroreduction to multicarbon products on copper using bilayer ionomer coatings." *Nature Energy* 6.11 (2021): 1026-1034.

(26) Ahn, Sunyhik, et al. "Poly-amide modified copper foam electrodes for enhanced electrochemical reduction of carbon dioxide." *ACS Catalysis* 8.5 (2018): 4132-4142.

(27) Wei, Xing, et al. "Highly selective reduction of $CO_2$ to $C_{2+}$ hydrocarbons at copper/polyaniline interfaces." *ACS Catalysis* 10.7 (2020): 4103-4111.

(28) Hod, Idan, et al. "Fe-porphyrin-based metal-organic framework films as high-surface concentration, heterogeneous catalysts for electrochemical reduction of $CO_2$." *ACS Catalysis* 5.11 (2015): 6302-6309.

(29) Kornienko, Nikolay, et al. "Metal-organic frameworks for electrocatalytic reduction of carbon dioxide." *Journal of the American Chemical Society* 137.44 (2015): 14129-14135.

(30) Nam, Dae-Hyun, et al. "Metal-organic frameworks mediate Cu coordination for selective $CO_2$ electroreduction." *Journal of the American Chemical Society* 140.36 (2018): 11378-11386.

(31) Fan, Lei, et al. "Proton sponge promotion of electrochemical $CO_2$ reduction to multi-carbon products." *Joule* 6.1 (2022): 205-220.

(32) De Luna, Phil, et al. "Catalyst electro-redeposition controls morphology and oxidation state for selective carbon dioxide reduction." *Nature Catalysis* 1.2 (2018): 103-110.

(33) Hoang, Thao T H, et al. "Nanoporous copper-silver alloys by additive-controlled electrodeposition for the selective electroreduction of $CO_2$ to ethylene and ethanol." *Journal of the American Chemical Society* 140.17 (2018): 5791-5797.

(34) Gabardo, Christine M., et al. "Continuous carbon dioxide electroreduction to concentrated multi-carbon products using a membrane electrode assembly." *Joule* 3.11 (2019): 2777-2791.

(35) Ozden, Adnan, et al. "Cascade $CO_2$ electroreduction enables efficient carbonate-free production of ethylene." *Joule* 5.3 (2021): 706-719.

(36) Huang, Jianan Erick, et al. "$CO_2$ electrolysis to multicarbon products in strong acid." *Science* 372.6546 (2021): 1074-1078.

(37) Te Velde, G. T., et al. "Chemistry with ADF." *Journal of Computational Chemistry* 22.9 (2001): 931-967.

(38) Neugebauer, Johannes, et al. "Quantum chemical calculation of vibrational spectra of large molecules-Raman and IR spectra for buckminsterfullerene." *Journal of computational chemistry* 23.9 (2002): 895-910.

(39) Hahn, Christopher, et al. "Engineering Cu surfaces for the electrocatalytic conversion of $CO_2$: Controlling selectivity toward oxygenates and hydrocarbons." *Proceedings of the National Academy of Sciences* 114.23 (2017): 5918-5923.

(40) Kim, Youn-Geun, et al. "The evolution of the polycrystalline copper surface, first to Cu(111) and then to Cu(100), at a fixed $CO_2$RR potential: A study by operando EC-STM." *Langmuir* 30.50 (2014): 15053-15056.

(41) Pérez-Gallent, Elena, et al. "Structure- and potential-dependent cation effects on CO reduction at copper single-crystal electrodes." *Journal of the American Chemical Society* 139.45 (2017): 16412-16419.

(42) Sandberg, Robert B., et al. "CO—CO coupling on Cu facets: Coverage, strain and field effects." *Surface Science* 654 (2016): 56-62.

(43) Schouten, Klaas Jan P., Elena Perez Gallent, and Marc™ Koper. "The influence of pH on the reduction of CO and $CO_2$ to hydrocarbons on copper electrodes." *Journal of Electroanalytical Chemistry* 716 (2014): 53-57.

(44) Gao, J. S., and Z. Q. Tian. "Surface enhanced Raman scattering of pyridine at copper electrodes excited with a 514.5 nm line." *Chemical physics letters* 262.1-2 (1996): 151-154.

(45) Buckley, Aya K., et al. "Electrocatalysis at organic-metal interfaces: identification of structure-reactivity relationships for $CO_2$ reduction at modified Cu surfaces." *Journal of the American Chemical Society* 141.18 (2019): 7355-7364.

(46) Hope, Gregory A., and Ronald Woods. "Transient adsorption of sulfate ions during copper electrodeposition." *Journal of The Electrochemical Society* 151.9 (2004): C550-C553.

(47) Solovyeva, Elena V., et al. "SERS investigation of neocuproine adsorption on silver: Influence of electrode potential on methyl groups." *Journal of Raman Spectroscopy* 49.2 (2018): 207-214.

(48) Zhan, Chao, et al. "Revealing the CO coverage-driven C—C coupling mechanism for electrochemical $CO_2$ reduction on $Cu_2O$ nanocubes via operando Raman spectroscopy." *ACS catalysis* 11.13 (2021): 7694-7701.

(49) Hori, Yoshio, et al. "Infrared spectroscopy of adsorbed CO and intermediate species in electrochemical reduction of $CO_2$ to hydrocarbons on a Cu electrode." *Electrochimica acta* 40.16 (1995): 2617-2622.

(50) Koga, O., et al. "Infrared spectroscopic and voltammetric study of adsorbed CO on stepped surfaces of copper monocrystalline electrodes." *Electrochimica acta* 50.12 (2005): 2475-2485.

(51) Hope, Gregory A., and Ronald Woods. "Transient adsorption of sulfate ions during copper electrodeposition." *Journal of The Electrochemical Society* 151.9 (2004): C550-C553.

(52) Lane, Melissa D. "Mid-infrared emission spectroscopy of sulfate and sulfate-bearing minerals." *American Mineralogist* 92.1 (2007): 1-18.

(53) Niaura, Gediminas, et al. "Surface-enhanced Raman spectroscopy of phosphate anions: adsorption on silver, gold, and copper electrodes." *The Journal of Physical Chemistry B* 101.45 (1997): 9250-9262.

(54) Batista, Elisete A., and Marcia L A Temperini. "Spectroscopic evidences of the presence of hydrogenated species on the surface of copper during $CO_2$ electroreduction at low cathodic potentials." *Journal of Electroanalytical Chemistry* 629.1-2 (2009): 158-163.

(55) Katayama, Yu, et al. "An in situ surface-enhanced infrared absorption spectroscopy study of electrochemical $CO_2$ reduction: selectivity dependence on surface C-bound and O-bound reaction intermediates." *The Journal of Physical Chemistry C* 123.10 (2018): 5951-5963.

(56) Andrade, Gustavo F S, and Marcia L A Temperini. "1,10-Phenanthroline adsorption on iron electrode monitored by surface-enhanced Raman scattering (SERS). Comparison to SERS of Phen and its transition metal complex on silver electrode." *The Journal of Physical Chemistry C* 111.37 (2007): 13821-13830.

(57) Muniz-Miranda, et al. "SERS and DFT investigation on the adsorption of 1,10-phenanthroline on transition metal surfaces." *Physical Chemistry Chemical Physics* 12.5 (2010): 1145-1151.

(58) Wuttig, Anna, et al. "Tracking a common surface-bound intermediate during $CO_2$-to-fuels catalysis." *ACS central science* 2.8 (2016): 522-528.

(59) Gunathunge, Charuni M., et al. "Probing promoting effects of alkali cations on the reduction of CO at the aqueous electrolyte/copper interface." *Physical Chemistry Chemical Physics* 19.44 (2017): 30166-30172.

(60) Gunathunge, Charuni M., et al. "Revealing the Predominant Surface Facets of Rough Cu Electrodes under Electrochemical Conditions." *ACS Catalysis* 10.12 (2020): 6908-6923.

(61) Gunathunge, Charuni M., et al. "Spectroscopic observation of reversible surface reconstruction of copper electrodes under $CO_2$ reduction." *The Journal of Physical Chemistry C* 121.22 (2017): 12337-12344.

(62) Hori, Y., et al. "FTIR measurements of charge displacement adsorption of CO on poly- and single crystal (100) of Cu electrodes." *Electrochimica acta* 44.8-9 (1998): 1389-1395.

(63) An, Hongyu, et al. "Sub-Second Time-Resolved Surface-Enhanced Raman Spectroscopy Reveals Dynamic CO Intermediates during Electrochemical $CO_2$ Reduction on Copper." *Angewandte Chemie International Edition* 60.30 (2021): 16576-16584.

(64) Ovalle, Vincent J., and Matthias M. Waegele. "Understanding the impact of N-arylpyridinium ions on the selectivity of $CO_2$ reduction at the Cu/electrolyte interface." *The Journal of Physical Chemistry C* 123.40 (2019): 24453-24460.

(65) Reske, Rulle, et al. "Particle size effects in the catalytic electroreduction of $CO_2$ on Cu nanoparticles." *Journal of the American Chemical Society* 136.19 (2014): 6978-6986.

(66) Hori, Y., et al. "FTIR measurements of charge displacement adsorption of CO on poly- and single crystal (100) of Cu electrodes." *Electrochimica acta* 44.8-9 (1998): 1389-1395.

(67) Koga, O., et al. "Infrared spectroscopic and voltammetric study of adsorbed CO on stepped surfaces of copper monocrystalline electrodes." *Electrochimica acta* 50.12 (2005): 2475-2485.

(68) Hori, Yoshio, et al. "Infrared spectroscopy of adsorbed CO and intermediate species in electrochemical reduction of $CO_2$ to hydrocarbons on a Cu electrode." *Electrochimica acta* 40.16 (1995): 2617-2622.

(69) Gunathunge, Charuni M., et al. "Spectroscopic observation of reversible surface reconstruction of copper electrodes under $CO_2$ reduction." *The Journal of Physical Chemistry C* 121.22 (2017): 12337-12344.

(70) Sugimasa, Masatoshi, Junji Inukai, and Kingo Itaya. "Adlayer of 1,10-Phenanthroline on Cu(111) in acidic Solution: An in situ STM Study." *Journal of The Electrochemical Society* 150.5 (2003): E266-E270.

(71) Woodruff, D. P., et al. "Dipole coupling and chemical shifts in IRAS of CO adsorbed on Cu (110)." *Surface Science* 123.2-3 (1982): 397-412.

(72) Hayden, B. E., K. Kretzschmar, and A. M. Bradshaw. "An infrared spectroscopic study of CO on Cu(111): The linear, bridging and physisorbed species." *Surface Science* 155.2-3 (1985): 553-566.

(73) Gunathunge, Charuni M., et al. "Revealing the Predominant Surface Facets of Rough Cu Electrodes under Electrochemical Conditions." *ACS Catalysis* 10.12 (2020): 6908-6923.

(74) Li, Jingyi, et al. "Hydrogen bonding steers the product selectivity of electrocatalytic CO reduction." *Proceedings of the National Academy of Sciences* 116.19 (2019): 9220-9229.

(75) Chang, Xiaoxia, et al. "Determining intrinsic stark tuning rates of adsorbed CO on copper surfaces." *Catalysis Science & Technology* 11.20 (2021): 6825-6831.

(76) An, Hongyu, et al. "Sub-Second Time-Resolved Surface-Enhanced Raman Spectroscopy Reveals Dynamic CO Intermediates during Electrochemical $CO_2$ Reduction on Copper." *Angewandte Chemie International Edition* 60.30 (2021): 16576-16584.

(77) Malkani, A. S., et al. "Understanding the electric and nonelectric field components of the cation effect on the electrochemical CO reduction reaction." *Science advances* 6.45 (2020): eabd2569.

(78) Borguet, Eric, and Hai-Lung Dai. "Site-specific properties and dynamical dipole coupling of CO molecules adsorbed on a vicinal Cu(100) surface." *The Journal of chemical physics* 101.10 (1994): 9080-9095.

(79) Zhu, Shangqian, et al. "$CO_2$ electrochemical reduction as probed through infrared spectroscopy." *ACS Energy Letters* 4.3 (2019): 682-689.

(80) Gunathunge, Charuni M., et al. "Existence of an electrochemically inert CO population on Cu electrodes in alkaline pH." *ACS Catalysis* 8.8 (2018): 7507-7516.

(81) Eren, Baran, et al. "Structural changes of Cu(110) and Cu(110)-(2×1)-O surfaces under carbon monoxide in the Torr pressure range studied with scanning tunneling microscopy and infrared reflection absorption spectroscopy." *The Journal of Physical Chemistry C* 120.15 (2016): 8227-8231.

(82) Solymosi, Frigyes. "The bonding, structure and reactions of $CO_2$ adsorbed on clean and promoted metal surfaces." *Journal of Molecular Catalysis* 65.3 (1991): 337-358.

(83) Ovalle, Vincent J., and Matthias M. Waegele. "Understanding the impact of N-arylpyridinium ions on the selectivity of $CO_2$ reduction at the Cu/electrolyte interface." *The Journal of Physical Chemistry C* 123.40 (2019): 24453-24460.

(84) Hollins, P., K. J. Davies, and J. Pritchard. "Infrared spectra of CO chemisorbed on a surface vicinal to Cu(110): The influence of defect sites." *Surface science* 138.1 (1984): 75-83.

(85) Reske, Rulle, et al. "Particle size effects in the catalytic electroreduction of $CO_2$ on Cu nanoparticles." *Journal of the American Chemical Society* 136.19 (2014): 6978-6986.

The invention claimed is:

1. A method for electrochemical production of ethylene comprising the steps of:

providing an acidic catholyte;

providing a multilayer cathode in said acidic catholyte; wherein the multilayer cathode comprises a gas diffusion layer and a cathode catalyst layer;

contacting carbon dioxide with the multilayer cathode, such that the carbon dioxide diffuses through the gas diffusion layer and contacts the cathode catalyst layer;

applying a voltage to provide a current density to cause the carbon dioxide contacting the cathode catalyst layer to be electrochemically reduced into the ethylene; and recovering ethylene;

wherein the multilayer cathode comprises a surface-modified catalyst deposited on the gas diffusion layer, wherein the surface-modified catalyst comprises:

a cathode catalyst material with a surface presenting at least one active site for sustaining reduction of $CO_2$ into ethylene, wherein the cathode catalyst material is copper or an alloy thereof; and one or more heterocyclic organic molecules which are adsorbed on the surface of the cathode catalyst material, wherein the one or more heterocyclic organic molecules are or comprise one or more aromatic heterocyclic amine molecules selected from 1,7-phenanthroline, 1,10-phenanthroline, adenine, and benzotriazole;

the acidic catholyte has a pH ranging from 0.5 to 2.8 the one or more heterocyclic organic molecules are provided in the acidic catholyte stream that flows along the cathode catalyst layer at a concentration ranging from 0.1 mM to 1.0 mM.

2. The method according to claim 1 is characterized in that the acidic catholyte has a pH ranging from 0.8 to 2.5.

3. The method according to claim 1 is characterized in that the acidic catholyte comprises one or more acids at a concentration ranging from 0.01 to 1.0 M and one or more alkali metal cation donors at a concentration ranging from 0 to 3 M.

4. The method according to claim 3 is characterized in that the one or more alkali metal cation donors at a concentration ranging from 0 to 3 M.

5. The method according to claim 1 is characterized in that the acidic catholyte comprises one or more acids selected from hydrochloric acid, sulfuric acid, hydrobromic acid, hydriodic acid, perchloric acid, and chloric acid.

6. The method according to claim 5 is characterized in that the one or more acids are present at a concentration ranging from 0.01 to 2.0 M.

7. The method according to claim 1 is characterized in that the acidic catholyte comprises one or more alkali metal cation donors being one or more alkali metal halide; wherein the one or more alkali metal halides are selected from caesium chloride, caesium iodide, caesium sulfate, caesium phosphate, caesium hydroxide, potassium chloride, potassium phosphate monobasic, potassium sulfate, potassium iodide, potassium hydroxide, lithium chloride, lithium iodide, lithium sulfate, lithium phosphate, lithium hydroxide, sodium chloride, sodium sulphate, sodium iodide, sodium phosphate, and sodium hydroxide.

8. The method according to claim 1 is characterized in that the acidic catholyte comprises one or more alkali metal cation donors being one or more alkali metal halide; wherein the one or more alkali metal halide are or comprise one or more alkali metal chloride selected from lithium chloride (LiCl), sodium chloride (NaCl), potassium chloride (KCl), rubidium chloride (RbCl), and caesium chloride (CsCl).

9. The method according to claim 1 is characterized in that the one or more heterocyclic organic molecules are or comprise substituted or unsubstituted dinitrogen heterocyclic amines.

10. The method according to claim 1 is characterized in that at least one heterocyclic organic molecule is 1,10-phenanthroline.

11. The method according to claim 1 is characterized in that the one or more heterocyclic organic molecules are provided in the acidic catholyte stream at a concentration ranging from 0.15 mM to 0.8 mM.

12. The method according to claim 1 is characterized in that the cathode catalyst material comprises one or more of Cu(100), Cu(111), and Cu(110) as determined by XRD.

13. The method according to claim 1 is characterized in that the cathode catalyst material is an alloy comprising copper and at least one other element selected from silver, gold, nickel, tin, gallium, zinc, palladium, cadmium, indium, platinum, mercury, thallium, lead, bismuth and cobalt.

14. The method according to claim 1 is characterized in that the anode catalyst layer comprises an anode catalyst material that is a metal or a metal oxide.

15. The method according to claim 14 is characterized in that the metal oxide is selected from iridium oxide, nickel oxide, iron oxide, cobalt oxide, nickel-iron oxide, iridium-ruthenium oxide and platinum oxide.

16. The method according to claim 15, wherein the metal oxide is iridium oxide.

17. The method according to claim 14, wherein the metal is a noble metal.

18. The method according to claim 17, wherein the noble metal is platinum.

19. The method according to claim 1 is characterized in that the multilayer cathode further comprises a current collector adjacent to the gas diffusion layer.

20. The method according to claim 1 is characterized in that the gas diffusion layer in the multilayer cathode comprises a porous material.

21. The method according to claim 20, wherein the porous material is a fluoropolymer.

22. The method according to claim 21, wherein the fluoropolymer is polytetrafluoroethylene or expanded polytetrafluoroethylene.

23. The method according to claim 1 is characterized in that the gas diffusion layer in the multilayer cathode is made of a polytetrafluoroethylene filter or a carbon paper substrate treated with polytetrafluoroethylene.

24. The method according to claim 1 is characterized in that the cathode catalyst layer in the multilayer cathode has a thickness in the range of from 5 μm to about 10 μm as determined by scanning electron microscopy.

25. The method according to claim 1 is characterized in that the multilayer cathode further comprises a cation conducting ionomer layer deposited onto the cathode catalyst layer.

26. The method according to claim 25, wherein the multilayer cathode further comprises an additional electrically conductive layer deposited onto the cation conducting ionomer layer.

* * * * *